US007201972B2

(12) United States Patent
Shiozaki et al.

(10) Patent No.: US 7,201,972 B2
(45) Date of Patent: Apr. 10, 2007

(54) METAL THIN FILM DISPERSING A SUPER-FINE DIAMOND PARTICLE, A METAL MATERIAL HAVING THE METAL THIN FILM, AND A METHOD FOR PREPARING THE SAME

(75) Inventors: Shigeru Shiozaki, Machida (JP); Masato Sone, Koganei (JP); Hideo Yoshida, Higashimurayama (JP); Kiyohito Sakon, Higashimurayama (JP); Tadamasa Fujimura, D-1404, Chuougaiku, 535-2, Shinanochou, Totuka-Ku, Yokohama-shi, Kanagawa-ken, 244-0801 (JP)

(73) Assignee: Tadamasa Fujimura, Kanagawa-ken (JP)

( * ) Notice: Subject to any disclaimer, the term of this patent is extended or adjusted under 35 U.S.C. 154(b) by 234 days.

(21) Appl. No.: 10/460,660

(22) Filed: Jun. 13, 2003

(65) Prior Publication Data

US 2004/0011433 A1 Jan. 22, 2004

(30) Foreign Application Priority Data

Jun. 13, 2002 (JP) ..... P2002-173372

(51) Int. Cl.

| | |
|---|---|
| ***B32B 5/16*** | (2006.01) |
| ***B32B 5/02*** | (2006.01) |
| ***B32B 15/00*** | (2006.01) |
| ***C25C 5/00*** | (2006.01) |

(52) U.S. Cl. ..... 428/614; 428/539.5; 205/152; 205/109; 205/110

(58) Field of Classification Search ..... 205/109, 205/92, 110, 152; 428/614, 539.5
See application file for complete search history.

(56) References Cited

U.S. PATENT DOCUMENTS 3,596,649 A * 8/1971 Olivieri ..... 125/11.01

(Continued)

FOREIGN PATENT DOCUMENTS

JP 63-33988 7/1988

(Continued)

OTHER PUBLICATIONS

English Machine translation of 10-146770, Mitsubishi Materials Corp, Electroplated grinding wheel, Jun. 1998.*

(Continued)

*Primary Examiner*—Jennifer McNeil
*Assistant Examiner*—Jason L. Savage
(74) *Attorney, Agent, or Firm*—Westerman, Hattori, Daniels & Adrian, LLP.

(57) ABSTRACT

There is provided a metal thin film comprising a metal plate and a diamond particle dispersed in the metal plate. According to the present invention, the metal thin film has a film thickness of 5 nm to 35000 nm. The diamond particle is dispersed almost homogeneously over the direction of the film thickness of the metal thin film. The metal thin film has the diamond particle at a concentration of 1 to 12%. According to the present invention, based on conversion into an equivalent circle, the diamond particle has a first particle size distribution with respect to a first particle of a first particle size of 16 nm or less, at a first number average existence rate of 50% or more; the diamond particle has a second particle size distribution with respect to a second particle having a second particle size of 50 nm or more, at a second number average existence rate of substantially 0%; and the diamond particle has a third particle size distribution with respect to a third particle having a third particle size of 2 nm or less, at a third number average existence rate of substantially 0%.

8 Claims, 29 Drawing Sheets

U.S. PATENT DOCUMENTS

| | | | | | |
|---|---|---|---|---|---|
| 4,505,746 | A | * | 3/1985 | Nakai et al. | 75/243 |
| 5,709,577 | A | * | 1/1998 | Jin et al. | 445/24 |
| 5,759,216 | A | * | 6/1998 | Kanada et al. | 51/309 |
| 5,977,697 | A | * | 11/1999 | Jin et al. | 313/310 |
| 2003/0228249 | A1 | * | 12/2003 | Fujimara et al | |

FOREIGN PATENT DOCUMENTS

| | | | |
|---|---|---|---|
| JP | 63-286548 | * | 11/1988 |
| JP | 4-333599 | | 11/1992 |
| JP | 05-106125 | * | 4/1993 |
| JP | 08-337883 | * | 12/1996 |
| JP | 10-146765 | * | 6/1998 |
| JP | 10-146770 | * | 6/1998 |
| JP | 2002-265968 | * | 9/2002 |

OTHER PUBLICATIONS

English Machine translation of 10-146765, Mitsubishi Materials Corp, Grindstone with thin blade, Jun. 1998.*

English Machine translation of 05-106125, Kanai H, Spinning machinery metal traveller production, Apr. 1993.*

Evgeny N. Loubnin, et al.; *Electroplating of Gold-Nanodiamond Composite Coatings*; New Diamond and Frontier Carbon Technology; 1999, vol. 9, No. 4; pp. 273-282.

* cited by examiner

TNT−HRX

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 52.18 | 11.33 | 41 | 91.09 | 100.00 | 0.00 |
| 2 | 0.12 | 0.00 | 0.00 | 22 | 3.58 | 63.65 | 11.47 | 42 | 108.01 | 100.00 | 0.00 |
| 3 | 0.14 | 0.00 | 0.00 | 23 | 4.24 | 74.63 | 10.98 | 43 | 128.07 | 100.00 | 0.00 |
| 4 | 0.17 | 0.00 | 0.00 | 24 | 5.03 | 83.98 | 9.35 | 44 | 151.86 | 100.00 | 0.00 |
| 5 | 0.20 | 0.00 | 0.00 | 25 | 5.97 | 91.07 | 7.09 | 45 | 180.07 | 100.00 | 0.00 |
| 6 | 0.23 | 0.00 | 0.00 | 26 | 7.07 | 96.02 | 4.95 | 46 | 213.51 | 100.00 | 0.00 |
| 7 | 0.28 | 0.00 | 0.00 | 27 | 8.39 | 98.77 | 2.75 | 47 | 253.17 | 100.00 | 0.00 |
| 8 | 0.33 | 0.00 | 0.00 | 28 | 9.95 | 99.99 | 1.22 | 48 | 300.19 | 100.00 | 0.00 |
| 9 | 0.39 | 0.01 | 0.01 | 29 | 11.79 | 100.00 | 0.01 | 49 | 355.95 | 100.00 | 0.00 |
| 10 | 0.46 | 0.12 | 0.11 | 30 | 13.98 | 100.00 | 0.00 | 50 | 422.06 | 100.00 | 0.00 |
| 11 | 0.55 | 0.34 | 0.22 | 31 | 16.58 | 100.00 | 0.00 | 51 | 500.45 | 100.00 | 0.00 |
| 12 | 0.65 | 0.64 | 0.30 | 32 | 19.66 | 100.00 | 0.00 | 52 | 593.40 | 100.00 | 0.00 |
| 13 | 0.77 | 0.73 | 0.09 | 33 | 23.31 | 100.00 | 0.00 | 53 | 703.61 | 100.00 | 0.00 |
| 14 | 0.92 | 1.84 | 1.11 | 34 | 27.64 | 100.00 | 0.00 | | | | |
| 15 | 1.09 | 4.34 | 2.50 | 35 | 32.78 | 100.00 | 0.00 | | | | |
| 16 | 1.29 | 8.57 | 4.23 | 36 | 38.86 | 100.00 | 0.00 | | | | |
| 17 | 1.53 | 14.55 | 5.98 | 37 | 46.08 | 100.00 | 0.00 | | | | |
| 18 | 1.81 | 21.97 | 7.42 | 38 | 54.64 | 100.00 | 0.00 | | | | |
| 19 | 2.15 | 30.91 | 8.94 | 39 | 64.79 | 100.00 | 0.00 | | | | |
| 20 | 2.55 | 40.85 | 9.94 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 54.20 | 11.87 | 41 | 91.09 | 100.00 | 0.00 |
| 2 | 0.12 | 0.00 | 0.00 | 22 | 3.58 | 66.74 | 12.54 | 42 | 108.01 | 100.00 | 0.00 |
| 3 | 0.14 | 0.00 | 0.00 | 23 | 4.24 | 78.33 | 11.59 | 43 | 128.07 | 100.00 | 0.00 |
| 4 | 0.17 | 0.00 | 0.00 | 24 | 5.03 | 87.39 | 9.06 | 44 | 151.86 | 100.00 | 0.00 |
| 5 | 0.20 | 0.00 | 0.00 | 25 | 5.97 | 93.48 | 6.09 | 45 | 180.07 | 100.00 | 0.00 |
| 6 | 0.23 | 0.00 | 0.00 | 26 | 7.07 | 97.30 | 3.82 | 46 | 213.51 | 100.00 | 0.00 |
| 7 | 0.28 | 0.00 | 0.00 | 27 | 8.39 | 99.29 | 1.99 | 47 | 253.17 | 100.00 | 0.00 |
| 8 | 0.33 | 0.00 | 0.00 | 28 | 9.95 | 99.99 | 0.70 | 48 | 300.19 | 100.00 | 0.00 |
| 9 | 0.39 | 0.04 | 0.04 | 29 | 11.79 | 100.00 | 0.01 | 49 | 355.95 | 100.00 | 0.00 |
| 10 | 0.46 | 0.26 | 0.22 | 30 | 13.98 | 100.00 | 0.00 | 50 | 422.06 | 100.00 | 0.00 |
| 11 | 0.55 | 0.77 | 0.51 | 31 | 16.58 | 100.00 | 0.00 | 51 | 500.45 | 100.00 | 0.00 |
| 12 | 0.65 | 1.56 | 0.79 | 32 | 19.66 | 100.00 | 0.00 | 52 | 593.40 | 100.00 | 0.00 |
| 13 | 0.77 | 2.32 | 0.76 | 33 | 23.31 | 100.00 | 0.00 | 53 | 703.61 | 100.00 | 0.00 |
| 14 | 0.92 | 4.59 | 2.27 | 34 | 27.64 | 100.00 | 0.00 | | | | |
| 15 | 1.09 | 8.42 | 3.83 | 35 | 32.78 | 100.00 | 0.00 | | | | |
| 16 | 1.29 | 13.43 | 5.01 | 36 | 38.86 | 100.00 | 0.00 | | | | |
| 17 | 1.53 | 19.15 | 5.72 | 37 | 46.08 | 100.00 | 0.00 | | | | |
| 18 | 1.81 | 25.40 | 6.25 | 38 | 54.64 | 100.00 | 0.00 | | | | |
| 19 | 2.15 | 33.03 | 7.63 | 39 | 64.79 | 100.00 | 0.00 | | | | |
| 20 | 2.55 | 42.33 | 9.30 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 53.38 | 11.87 | 41 | 91.09 | 100.00 | 0.00 |
| 2 | 0.12 | 0.00 | 0.00 | 22 | 3.58 | 66.12 | 12.74 | 42 | 108.01 | 100.00 | 0.00 |
| 3 | 0.14 | 0.00 | 0.00 | 23 | 4.24 | 78.06 | 11.94 | 43 | 128.07 | 100.00 | 0.00 |
| 4 | 0.17 | 0.00 | 0.00 | 24 | 5.03 | 87.46 | 9.40 | 44 | 151.86 | 100.00 | 0.00 |
| 5 | 0.20 | 0.00 | 0.00 | 25 | 5.97 | 93.75 | 6.29 | 45 | 180.07 | 100.00 | 0.00 |
| 6 | 0.23 | 0.00 | 0.00 | 26 | 7.07 | 97.60 | 3.85 | 46 | 213.51 | 100.00 | 0.00 |
| 7 | 0.28 | 0.00 | 0.00 | 27 | 8.39 | 99.48 | 1.88 | 47 | 253.17 | 100.00 | 0.00 |
| 8 | 0.33 | 0.00 | 0.00 | 28 | 9.95 | 99.99 | 0.51 | 48 | 300.19 | 100.00 | 0.00 |
| 9 | 0.39 | 0.05 | 0.05 | 29 | 11.79 | 100.00 | 0.01 | 49 | 355.95 | 100.00 | 0.00 |
| 10 | 0.46 | 0.27 | 0.22 | 30 | 13.98 | 100.00 | 0.00 | 50 | 422.06 | 100.00 | 0.00 |
| 11 | 0.55 | 0.79 | 0.52 | 31 | 16.58 | 100.00 | 0.00 | 51 | 500.45 | 100.00 | 0.00 |
| 12 | 0.65 | 1.59 | 0.80 | 32 | 19.66 | 100.00 | 0.00 | 52 | 593.40 | 100.00 | 0.00 |
| 13 | 0.77 | 2.39 | 0.80 | 33 | 23.31 | 100.00 | 0.00 | 53 | 703.61 | 100.00 | 0.00 |
| 14 | 0.92 | 4.66 | 2.27 | 34 | 27.64 | 100.00 | 0.00 | | | | |
| 15 | 1.09 | 8.46 | 3.80 | 35 | 32.78 | 100.00 | 0.00 | | | | |
| 16 | 1.29 | 13.40 | 4.94 | 36 | 38.86 | 100.00 | 0.00 | | | | |
| 17 | 1.53 | 18.97 | 5.57 | 37 | 46.08 | 100.00 | 0.00 | | | | |
| 18 | 1.81 | 24.99 | 6.02 | 38 | 54.64 | 100.00 | 0.00 | | | | |
| 19 | 2.15 | 32.37 | 7.38 | 39 | 64.79 | 100.00 | 0.00 | | | | |
| 20 | 2.55 | 41.51 | 9.14 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 57.12 | 11.09 | 41 | 91.09 | 100.00 | 0.00 |
| 2 | 0.12 | 0.00 | 0.00 | 22 | 3.58 | 68.80 | 11.68 | 42 | 108.01 | 100.00 | 0.00 |
| 3 | 0.14 | 0.00 | 0.00 | 23 | 4.24 | 79.76 | 10.96 | 43 | 128.07 | 100.00 | 0.00 |
| 4 | 0.17 | 0.00 | 0.00 | 24 | 5.03 | 88.42 | 8.66 | 44 | 151.86 | 100.00 | 0.00 |
| 5 | 0.20 | 0.00 | 0.00 | 25 | 5.97 | 94.23 | 5.81 | 45 | 180.07 | 100.00 | 0.00 |
| 6 | 0.23 | 0.00 | 0.00 | 26 | 7.07 | 97.80 | 3.57 | 46 | 213.51 | 100.00 | 0.00 |
| 7 | 0.28 | 0.00 | 0.00 | 27 | 8.39 | 99.55 | 1.75 | 47 | 253.17 | 100.00 | 0.00 |
| 8 | 0.33 | 0.00 | 0.00 | 28 | 9.95 | 100.00 | 0.45 | 48 | 300.19 | 100.00 | 0.00 |
| 9 | 0.39 | 0.04 | 0.04 | 29 | 11.79 | 100.00 | 0.00 | 49 | 355.95 | 100.00 | 0.00 |
| 10 | 0.46 | 0.26 | 0.22 | 30 | 13.98 | 100.00 | 0.00 | 50 | 422.06 | 100.00 | 0.00 |
| 11 | 0.55 | 0.79 | 0.53 | 31 | 16.58 | 100.00 | 0.00 | 51 | 500.45 | 100.00 | 0.00 |
| 12 | 0.65 | 1.59 | 0.80 | 32 | 19.66 | 100.00 | 0.00 | 52 | 593.40 | 100.00 | 0.00 |
| 13 | 0.77 | 2.29 | 0.70 | 33 | 23.31 | 100.00 | 0.00 | 53 | 703.61 | 100.00 | 0.00 |
| 14 | 0.92 | 4.68 | 2.39 | 34 | 27.64 | 100.00 | 0.00 | | | | |
| 15 | 1.09 | 9.00 | 4.32 | 35 | 32.78 | 100.00 | 0.00 | | | | |
| 16 | 1.29 | 14.92 | 5.92 | 36 | 38.86 | 100.00 | 0.00 | | | | |
| 17 | 1.53 | 21.79 | 6.87 | 37 | 46.08 | 100.00 | 0.00 | | | | |
| 18 | 1.81 | 29.03 | 7.24 | 38 | 54.64 | 100.00 | 0.00 | | | | |
| 19 | 2.15 | 37.08 | 8.05 | 39 | 64.79 | 100.00 | 0.00 | | | | |
| 20 | 2.55 | 46.03 | 8.95 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 65.09 | 11.08 | 41 | 91.09 | 100.00 | 0.00 |
| 2 | 0.12 | 0.00 | 0.00 | 22 | 3.58 | 76.46 | 11.37 | 42 | 108.01 | 100.00 | 0.00 |
| 3 | 0.14 | 0.00 | 0.00 | 23 | 4.24 | 86.45 | 9.99 | 43 | 128.07 | 100.00 | 0.00 |
| 4 | 0.17 | 0.00 | 0.00 | 24 | 5.03 | 93.51 | 7.06 | 44 | 151.86 | 100.00 | 0.00 |
| 5 | 0.20 | 0.00 | 0.00 | 25 | 5.97 | 97.47 | 3.96 | 45 | 180.07 | 100.00 | 0.00 |
| 6 | 0.23 | 0.00 | 0.00 | 26 | 7.07 | 99.21 | 1.74 | 46 | 213.51 | 100.00 | 0.00 |
| 7 | 0.28 | 0.00 | 0.00 | 27 | 8.39 | 100.00 | 0.79 | 47 | 253.17 | 100.00 | 0.00 |
| 8 | 0.33 | 0.01 | 0.01 | 28 | 9.95 | 100.00 | 0.00 | 48 | 300.19 | 100.00 | 0.00 |
| 9 | 0.39 | 0.12 | 0.11 | 29 | 11.79 | 100.00 | 0.00 | 49 | 355.95 | 100.00 | 0.00 |
| 10 | 0.46 | 0.62 | 0.50 | 30 | 13.98 | 100.00 | 0.00 | 50 | 422.06 | 100.00 | 0.00 |
| 11 | 0.55 | 1.80 | 1.18 | 31 | 16.58 | 100.00 | 0.00 | 51 | 500.45 | 100.00 | 0.00 |
| 12 | 0.65 | 3.81 | 2.01 | 32 | 19.66 | 100.00 | 0.00 | 52 | 593.40 | 100.00 | 0.00 |
| 13 | 0.77 | 6.40 | 2.59 | 33 | 23.31 | 100.00 | 0.00 | 53 | 703.61 | 100.00 | 0.00 |
| 14 | 0.92 | 10.75 | 4.35 | 34 | 27.64 | 100.00 | 0.00 | | | | |
| 15 | 1.09 | 16.60 | 5.85 | 35 | 32.78 | 100.00 | 0.00 | | | | |
| 16 | 1.29 | 23.39 | 6.79 | 36 | 38.86 | 100.00 | 0.00 | | | | |
| 17 | 1.53 | 30.41 | 7.02 | 37 | 46.08 | 100.00 | 0.00 | | | | |
| 18 | 1.81 | 37.32 | 6.91 | 38 | 54.64 | 100.00 | 0.00 | | | | |
| 19 | 2.15 | 45.03 | 7.71 | 39 | 64.79 | 100.00 | 0.00 | | | | |
| 20 | 2.55 | 54.01 | 8.98 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 46.21 | 10.96 | 41 | 91.09 | 100.00 | 0.00 |
| 2 | 0.12 | 0.00 | 0.00 | 22 | 3.58 | 58.37 | 12.16 | 42 | 108.01 | 100.00 | 0.00 |
| 3 | 0.14 | 0.00 | 0.00 | 23 | 4.24 | 70.29 | 11.92 | 43 | 128.07 | 100.00 | 0.00 |
| 4 | 0.17 | 0.00 | 0.00 | 24 | 5.03 | 80.43 | 10.14 | 44 | 151.86 | 100.00 | 0.00 |
| 5 | 0.20 | 0.00 | 0.00 | 25 | 5.97 | 88.20 | 7.77 | 45 | 180.07 | 100.00 | 0.00 |
| 6 | 0.23 | 0.00 | 0.00 | 26 | 7.07 | 93.88 | 5.68 | 46 | 213.51 | 100.00 | 0.00 |
| 7 | 0.28 | 0.00 | 0.00 | 27 | 8.39 | 97.61 | 3.73 | 47 | 253.17 | 100.00 | 0.00 |
| 8 | 0.33 | 0.00 | 0.00 | 28 | 9.95 | 99.59 | 1.98 | 48 | 300.19 | 100.00 | 0.00 |
| 9 | 0.39 | 0.02 | 0.02 | 29 | 11.79 | 99.95 | 0.36 | 49 | 355.95 | 100.00 | 0.00 |
| 10 | 0.46 | 0.11 | 0.09 | 30 | 13.98 | 100.00 | 0.05 | 50 | 422.06 | 100.00 | 0.00 |
| 11 | 0.55 | 0.33 | 0.22 | 31 | 16.58 | 100.00 | 0.00 | 51 | 500.45 | 100.00 | 0.00 |
| 12 | 0.65 | 0.58 | 0.25 | 32 | 19.66 | 100.00 | 0.00 | 52 | 593.40 | 100.00 | 0.00 |
| 13 | 0.77 | 0.58 | 0.00 | 33 | 23.31 | 100.00 | 0.00 | 53 | 703.61 | 100.00 | 0.00 |
| 14 | 0.92 | 1.95 | 1.37 | 34 | 27.64 | 100.00 | 0.00 | | | | |
| 15 | 1.09 | 4.99 | 3.04 | 35 | 32.78 | 100.00 | 0.00 | | | | |
| 16 | 1.29 | 9.39 | 4.40 | 36 | 38.86 | 100.00 | 0.00 | | | | |
| 17 | 1.53 | 14.57 | 5.18 | 37 | 46.08 | 100.00 | 0.00 | | | | |
| 18 | 1.81 | 20.24 | 5.67 | 38 | 54.64 | 100.00 | 0.00 | | | | |
| 19 | 2.15 | 27.04 | 6.80 | 39 | 64.79 | 100.00 | 0.00 | | | | |
| 20 | 2.55 | 35.25 | 8.21 | 40 | 76.82 | 100.00 | 0.00 | | | | |

A Particle Size ($\mu$m)
B Accumulation Rate (%)
C Range (%)

| Ch. | A | B | C | Ch. | A | B | C | Ch. | A | B | C |
|---|---|---|---|---|---|---|---|---|---|---|---|
| 1 | 0.10 | 0.00 | 0.00 | 21 | 3.02 | 40.83 | 7.23 | 41 | 91.09 | 100.00 | 0.00 |
| 2 | 0.12 | 0.00 | 0.00 | 22 | 3.58 | 49.14 | 8.31 | 42 | 108.01 | 100.00 | 0.00 |
| 3 | 0.14 | 0.00 | 0.00 | 23 | 4.24 | 57.45 | 8.31 | 43 | 128.07 | 100.00 | 0.00 |
| 4 | 0.17 | 0.00 | 0.00 | 24 | 5.03 | 64.59 | 7.14 | 44 | 151.86 | 100.00 | 0.00 |
| 5 | 0.20 | 0.00 | 0.00 | 25 | 5.97 | 70.33 | 5.74 | 45 | 180.07 | 100.00 | 0.00 |
| 6 | 0.23 | 0.00 | 0.00 | 26 | 7.07 | 75.31 | 4.98 | 46 | 213.51 | 100.00 | 0.00 |
| 7 | 0.28 | 0.00 | 0.00 | 27 | 8.39 | 79.86 | 4.55 | 47 | 253.17 | 100.00 | 0.00 |
| 8 | 0.33 | 0.00 | 0.00 | 28 | 9.95 | 83.93 | 4.07 | 48 | 300.19 | 100.00 | 0.00 |
| 9 | 0.39 | 0.03 | 0.03 | 29 | 11.79 | 87.18 | 3.25 | 49 | 355.95 | 100.00 | 0.00 |
| 10 | 0.46 | 0.18 | 0.15 | 30 | 13.98 | 89.54 | 2.36 | 50 | 422.06 | 100.00 | 0.00 |
| 11 | 0.55 | 0.52 | 0.34 | 31 | 16.58 | 91.16 | 1.62 | 51 | 500.45 | 100.00 | 0.00 |
| 12 | 0.65 | 0.99 | 0.47 | 32 | 19.66 | 92.66 | 1.50 | 52 | 593.40 | 100.00 | 0.00 |
| 13 | 0.77 | 1.23 | 0.24 | 33 | 23.31 | 94.42 | 1.76 | 53 | 703.61 | 100.00 | 0.00 |
| 14 | 0.92 | 3.08 | 1.85 | 34 | 27.64 | 96.40 | 1.98 | | | | |
| 15 | 1.09 | 6.90 | 3.82 | 35 | 32.78 | 98.27 | 1.87 | | | | |
| 16 | 1.29 | 12.16 | 5.26 | 36 | 38.86 | 99.62 | 1.35 | | | | |
| 17 | 1.53 | 17.86 | 5.70 | 37 | 46.08 | 99.96 | 0.34 | | | | |
| 18 | 1.81 | 23.18 | 5.32 | 38 | 54.64 | 100.00 | 0.04 | | | | |
| 19 | 2.15 | 28.33 | 5.15 | 39 | 64.79 | 100.00 | 0.00 | | | | |
| 20 | 2.55 | 33.60 | 5.27 | 40 | 76.82 | 100.00 | 0.00 | | | | |

A Particle Size ($\mu$m)
B Accumulation Rate (%)
C Range (%)

SEM Image of a Surface of a UDD and Ni Composite Thin Film

SEM Image of a Cross-Section Surface of a UDD and Ni Composite Thin Film (×1,000)

with agitation (Ex. 6) without agitation (Ex. 7)

A Magnified View of a UDD and Ni Composite Thin Film (Ex. 8)

i ) SEM Image (A portion at 5.0 A/dm$^2$)

ii ) SEM Image (A portion at 5.0 A/dm$^2$)

SEM Image of a Cross-Section Surface of a UDD and Ni Composite Thin Film
Sample No Ex. 2
Ni-UDD layer
High magnification for observation of a UDD (×200,000)

SEM Image (Au-UDD plate)

(Current Density: 0.5A/dm$^2$, magnification: ×10,000)

TEM Image of a UDD-Au Composite Thin Film
Sample No. Ex. 11 (Au-UDD film)

25 nm ×800,000

TEM Image of a UDD-Au Composite Thin Film
Sample : No. 11 (Au-UDD film)

METAL THIN FILM DISPERSING A SUPER-FINE DIAMOND PARTICLE, A METAL MATERIAL HAVING THE METAL THIN FILM, AND A METHOD FOR PREPARING THE SAME

TECHNICAL FIELD OF THE INVENTION

The present invention relates to a metal thin film, a metal material comprising the metal thin film, and a method for preparing the same. The metal thin film of the present invention comprises a super-fine diamond having a particle size having a unit of nanometer, which is stably dispersed in an aqueous suspension solution. Generally, the super-fine diamond having a particle size of 4 to 70 nm, and in particularly, of 4 to 40 nm, and it is hereinafter referred to as "nanometer diamond," "ultra dispersed diamond," or "UDD." The super-fine diamond forms an aggregation of a UDD powder, the aggregation comprising at least four particles of the nanometer diamond to several hundreds particles of the nanometer diamond. The UDD powder has, based on number average, a particle diameter of 300 to 500 nm, rarely having a particle size of 1000 nm or more, as well as rarely having a particle size of 30 nm or less.

RELATED ART

Conventionally, a metal thin film containing a super-fine diamond particle therein was known. Also, such a super-fine diamond particle has been used to study to increase physical strength of a metal thin film, to improve lubricity to improve wear resistance, and to utilize its low dielectric constant to incorporate it into various electronic components. For example, "*Kuuki-Senjyo* (*Air Clarification*)," Vol. 38, $4^{th}$, page 238, (2000) discloses that in order to lower a dielectric constant of a ULSI board as a computer device, a diamond particle having a particle size of 5 nm is formed into an aqueous colloid state, into which polyethylene glycol as a surfactant is added, with which a surface of a silicon substrate is coated and dried, so as to obtain a thin film having a dielectric constant of 2.7, approximately, by means of reflective index measurement by using a Ellipsometry. "*Sosei-to-Kako* (*Processing and Plasticity*)," Vol. 41, No. 474, page 716 (July, 2000) discloses that for the purpose of development of a solid composite lubrication material, a cluster diamond powder is dispersed in a material having an aluminum matrix followed by sintering it to obtain the composite material. It discloses that the composite material has a friction coefficient at minimum when it has the cluster diamond at a concentration of 1 volume %, but the decreasing of a friction coefficient is less than expected, and there is still an objective to improve it more. "*Diamond and Related Materials,*" Vol. 9, (2000), pages 1600 to 1603 discloses that a diamond fine particle having a particle size of 6 nm, approximately, provided on a board of Si, has a conductivity affected by a temperature. It discloses that as being raised up to 273° F., conductivity tends to be decreased, and as being raised over 273° F., conductivity tends to be increased and falls in $10^{-8}$ Ωcm, approximately. "*J. Appl. Phys.,*" Vol. 87, No. 11 (2000), pages 8187 to 8191 discloses a technology for printing a super-fine diamond particle having a particle diameter of 50 nm on a substrate, to provide it thereon. "*New Diamond and Frontier Technology,*" (in Russian), Vol. 9, No. 4, (1999), pages 273 to 282 discloses a gold and diamond composite film produced by using a gold plating bath including a super-dispersion diamond (UDD) manufactured by means of explosion of a detonating agent having a strong explosive power. It discloses that the thin film includes a UDD, in an Au matrix, at a concentration of less than 1 wt %. It also discloses that the thin film includes the UDD at a higher concentration at the surface thereof than at the inside thereof, but compared with a thin film of gold, the gold alone and diamond composite thin film has a high hardness, and an improved wear resistance to some extent. "*Diamond films technology,*" Vol. 7, No. 5/6, (1997), pages 273 to 276 discloses that a colloidal solution (a dilute solution having a concentration of 0.01 ct/liter) comprising a dispersed nanometer diamond particle having a particle size of 5 to 10 nm is prepared, in which an n-type (100) Si substrate is provided as an anode, and a Pt is provided as a cathode, with an electrode interval of 8 mm, so as to carry out electrophoresis at an applied voltage of 25 to 100V for a period of 0 to 30 minutes. It discloses that as forming and growing a core stuff of the nanometer diamond particle on the substrate, the crystal of the diamond grows with time of electrophoresis, to become a particle having a core density of 70 pieces/10 $cm^2$ at the time of 30 minutes. "*Journal of Chemical vapor deposition,*" Vol. 6, No. 1, (1997), pages 35 to 39 discloses that a UDD powder is dispersed in a distilled water by means of a supersonic wave, followed by carrying out centrifugation, to obtain a colloid solution, with which a board having a flatness and smoothness is coated and dried. It discloses that the resultant colloid thin film of a hydrosol does not remove water even heating it at a temperature of 150° C., which indicates that it is an effective method to extend a shelf stability of a UDD powder.

Japanese Examined Patent Publication No. 63-33988 discloses that a fine particle such as a diamond and, cubic boron nitride, are given a hydrophilicity by adding a cation surfactant, to disperse it in an electroplating bath of, for example, nickel and copper. It also discloses that thereafter, electrolysis is carried out to deposit the metal and the particle simultaneously on a substrate on a cathode, so as to prepare an electro-deposition grinding stone. Japanese Laid-Open Patent Publication No. 4-333599 discloses a method to provide a device having an improved lubricity and wear resistance, having a flat and smooth surface, without damaging another parts when it slides to contact. It discloses a diamond fine particle and metal (such as nickel, nickel cobalt alloy, nickel tungsten alloy, chromium, cobalt, cobalt alloy and copper) eutectoid film, which includes a diamond fine particle in a material having a metal matrix, is prepared by means of an electroplating method. It discloses that during the plating, dispersion of the diamond fine particle is stabilized in the plating bath by subjecting the plating bath to an ultrasonic treatment. It also discloses that the plating bath should be maintained to be a dilute suspension solution, having a diamond fine particle at a concentration of 20 ct/liter or less. Since "one carat" corresponds to "0.205 g," the concentration disclosed is 4.1 g/liter or less. It also discloses that a surfactant is added.

There are some objectives in the conventional technologies. In particular, an electroplating bath dispersing a diamond fine particle is used, to carry out an electroplating method, to obtain a diamond fine particle and metal eutectoid film is obtained. However, the diamond fine particle has a poor dispersibility in the plating bath, resulting in impossibility to stably disperse the diamond fine particle in the plating bath at a high concentration necessary to well improve the properties of the obtained thin metal film. Thus, it is impossible to increase a content of the diamond fine particle included in the obtained thin film, while the diamond fine particle cannot be homogenously dispersed in a metal film.

OBJECTIVE OF THE PRESENT INVENTION

Therefore, it is an objective of the present invention to provide a diamond fine particle and metal eutectoid film, in which the diamond fine particle is dispersed in a thin film homogenously and at a high concentration. Moreover, it is an objective of the present invention to provide an improved method to prepare a diamond fine particle and metal eutectoid film, by means of a plating method using an electroplating bath.

The objectives of the present invention is accomplished as follows:

[1] A metal thin film dispersed a diamond particle therein, comprising:

(i) the metal thin film having a film thickness of 5 nm (0.005 μm) to 35000 nm (35.0 μm);

(ii) the diamond particle being dispersed almost homogeneously over the direction of the film thickness of the metal thin film;

(iii) the metal thin film having the diamond particle at a concentration of 1 to 12%;

(iv) the diamond particle having a particle size distribution with respect to a particle size of 16 nm or less, at a number average existence rate of 50% or more, based on a conversion into a circle having an equivalent area;

(v) the diamond particle having a particle size of 50 nm or more, at a number average existence rate of substantially 0%; and (vi) the diamond particle having a particle size of 2 nm or less, at a number average existence rate of substantially 0%.

According to the present invention, the number average existence rate means a rate as to number of a specific particle having a specific particle size among all the particles included therein. Also, according to the present invention, the conversion into a circle having an equivalent area means that for example, a photograph is taken to measure an area of a particle, which is calculated to convert into a circle having the same area as the particle.

[2] A metal thin film according to the above section [1], wherein the metal thin film comprises a metal material selected from a group consisting of Au, Cr, Cu, In, Mo, Ni, Pd, Rh, V, or W.

[3] A metal thin film according to the above section [1] or [2], wherein the metal thin film has a film thickness of 32 nm (0.032 μm) to 30000 nm (30.0 μm).

[4] A metal thin film according to any of the above sections [1] to [3], wherein the diamond particle has a particle size distribution with respect to a particle size of 16 nm or less, at a number average existence rate of 70% or more, based on a conversion into a circle having an equivalent area.

[5] A metal thin film according to any of the above sections [1] to [4], wherein the metal thin film comprises the diamond particle having a ratio, of a long axis to a short axis, of 2.2 or less, at an appearance ratio of substantially 100%, by means of an image analysis by SEM.

[6] A metal thin film according to any of the above sections [1] to [5], wherein the metal thin film comprises the diamond particle having a ratio, of a long axis to a short axis, of 1.4 or less, at an appearance ratio of 70% or more, by means of an image analysis by SEM.

[7] A metal material comprising:

a metal thin film according to any of the above sections [1] to [6] provided on a surface of a carrier metal.

[8] A method for forming a metal thin film dispersing a diamond particle:

using a plating bath having a suspension of a diamond fine particle in a plating solution; and carrying out an electrolytic plating method to obtain a metal thin film dispersing a diamond particle, (i) wherein the diamond particle has a particle size distribution with respect to a particle size of 16 nm or less, at a number average existence rate of 50% or more, based on a conversion into a circle having an equivalent area, and wherein the diamond particle has a particle size of 50 nm or more, at a number average existence rate of substantially 0%, and wherein the diamond particle has a particle size of 2 nm or less, at a number average existence rate of substantially 0%, and wherein the diamond particle is suspended at a concentration of 0.01 to 120 g per a liter of the plating solution; and (ii) wherein the diamond particle is dispersed almost homogeneously over the direction of the film thickness of the metal thin film, having the film thickness of 40 nm (0.04 μm) to 60000 nm (60.0 μm).

Figure 1:
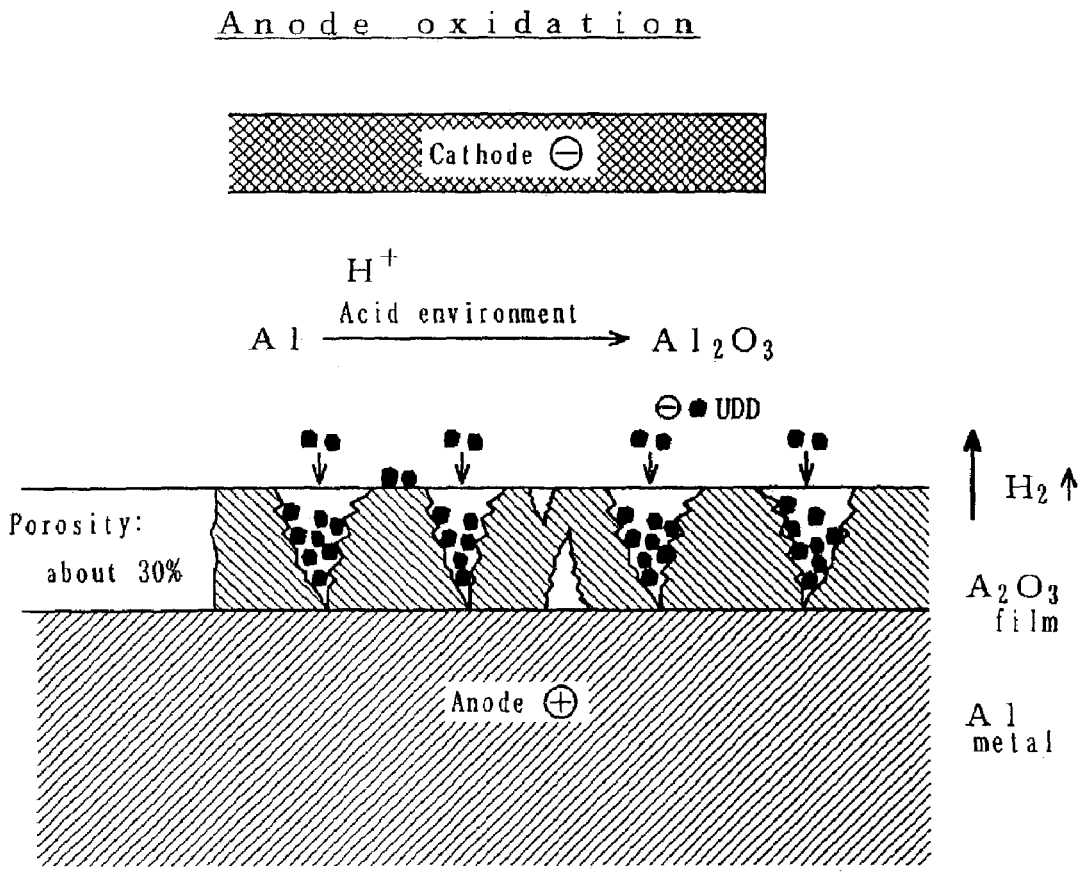
FIG. 1 shows a cross-sectional view of an anode-oxidized aluminum film, which is denaturalized by the UDD according to the present invention.

The present invention is described in details.

According to the present invention, "a metal thin film dispersing a diamond particle therein" may be obtained by using a super-fine diamond (UDD) powder. The super-fine diamond powder is of an aggregation comprising several particles of diamond to several hundreds particles of diamond. The aggregation is in a state capable of separation each other, having a narrow particle size distribution. Also, it may be obtained by using an aqueous suspension solution containing the UDD, which is excellent in dispersion stability. The present invention may be accomplished by means of an electroplating method (an electrolysis or non-electrolytic plating).

Although the present invention is not limited thereto. such a super-fine particle diamond (UDD) powder and an aqueous suspension solution containing the UDD having an excellent dispersion stability may include those which are previously disclosed in Japanese Patent Application No. 2001-262303, and Japanese Patent Application No. 2002-173167. This UDD is fully purified, and does not substantially contain graphite carbon nor amorphous carbon. It has an activity surface area 10 times as large as a conventional diamond. It also has a density of an active site per unit surface area extremely larger than that of a conventional diamond. Thus, it is excellent in surface activity. Also, it is excellent in dispersion stability in a solution and a metal film. However, as a UDD powder and a UDD aqueous suspension solution, any other UDD powder and UDD aqueous suspension solution than those disclosed in Japanese Patent Application No. 2001-262303 may be used.

Those application disclose a suspension solution of a diamond fine particle, comprising:

84 to 99.95 parts by weight of water; and 0.05 to 16 parts by weight of a diamond fine particle, having the following characteristics:

(i) when dried, the diamond fine particle having an element composition including 72 to 89.5% of total carbon, 0.8 to 1.5% of hydrogen, 1.5 to 2.5% of nitrogen, and 10.5 to 25.0% of oxygen;

(ii) the diamond fine particle having a volumetric average particle size of 50 nm±25 nm, wherein most of the diamond fine particle has a particle size of 10 nm to 100 nm (namely, it is included at a concentration of 80% or more based on number average, or at a concentration of 70% or more based on weight average);

(iii) when dried, the diamond fine particle, when analyzed by an X-ray diffraction (XD) spectrum analysis using Cu—Kα radiation, having the largest peak at a Bragg angle of 43.9° (2θ±2°), strong and characteristic peaks at either of Bragg angles of 73.5° and 95°, a significantly biased halo at a Bragg angle of 17°, and essentially no peak at a Bragg angle of 26.5°; and (iv) when dried, the diamond fine particle having a specific surface area of $1.50\times10^5$ $m^2/kg$ or more, wherein all of the surface carbon atoms are substantially bonded with hetero atoms, wherein the diamond fine particle has a total absorption space of 0.5 $m^3/kg$ or more.

Also, those application disclose a diamond powder prepared by using the suspension solution as described above, having the following characteristics:

(i) when dried, the diamond fine particle having an element composition including 72 to 89.5% of total carbon, 0.8 to 1.5% of hydrogen, 1.5 to 2.5% of nitrogen, and 10.5 to 25.0% of oxygen;

(ii) the diamond fine particle having no particle size over 1000 nm or below 30 nm, having a narrow distribution of number average particle diameter (Mn) of 150 to 650 nm;

(iii) the diamond fine particle, when analyzed by an X-ray diffraction (XD) spectrum analysis using Cu—Kα radiation, having the largest peak at a Bragg angle of 43.9° (2θ±2°), strong and characteristic peaks at either of Bragg angles of 73.5° and 95°, a significantly biased halo at a Bragg angle of 17°, and essentially no peak at a Bragg angle of 26.5°; and (iv) the diamond fine particle having a specific surface area of $1.50\times10^5$ $m^2/kg$ or more, wherein all of the surface carbon atoms are substantially bonded with hetero atoms, wherein the diamond fine particle has a total absorption space of 0.5 $m^3/kg$ or more.

Also, those applications discloses a suspension solution of a diamond fine particle. and a diamond powder having the following characteristics:

the diamond fine particle having a specific density in a range of $3.20\times10^3$ kg/m$^3$ to $3.40\times10^3$ kg/m$^3$; and the diamond fine article of the present invention having an infrared ray (IR) absorption spectrum showing the largest and broad band near a wavelength of 3500 cm$^{-1}$; a strong and broad peak at a wavelength between 1730 and 1790 cm$^{-1}$, while being biased above and below to extend broadly; a strong and broad band at a wavelength of 1170 cm$^{-1}$; and a moderately strong band at a wavelength of 610 cm$^{-1}$.

In connection with a metal thin film, those applications include a description of a metal plate solution as follows:

A metal plate solution having a suspension of a UDD at a concentration of 0.01 g to 120 g per one liter of a metal plate solution, wherein the UDD has the following characteristics:

(i) the diamond fine particle having an elemental composition including 72 to 89.5% of the whole of carbon, 0.8 to 1.5% of hydrogen, 1.5 to 2.5% of nitrogen, and 10.5 to 25.0% of oxygen;

(ii) the diamond fine particle excluding those having particle size over 1000 nm or below 30 nm, having a narrow distribution of number average particle diameter (ϕMn) of 150 to 650 nm;

(iii) the diamond fine particle, when analyzed by an X-ray diffraction (XD) spectrum using Cu—Kα radiation, having the largest peak at a Bragg angle of 43.9°, large and specific peaks at either of Bragg angles of 73.5° and 95°, a significantly biased halo at a Bragg angle of 17°, and essentially no peak at a Bragg angle of 26.5°; and (iv) the diamond fine particle having a specific surface area of $1.50\times10^5$ m$^2$/kg or more, wherein all of the carbon atoms existing on the surface are substantially bonded with hetero atoms, wherein the diamond fine particle has a total absorption space of 0.5 m$^3$/kg or more.

In connection with a metal thin film, those applications include another description of a metal plate solution having the following characteristics:

A metal film having a thickness of 0.1 to 350 μm comprising a UDD at a concentration of 0.1 to 0.2%, wherein the UDD having the following characteristics:

(i) the diamond fine particle having an element composition including 72 to 89.5% of total carbon, 0.8 to 1.5% of hydrogen, 1.5 to 2.5% of nitrogen, and 10.5 to 25.0% of oxygen;

(ii) the diamond fine particle having an averaged particle size of 2 nm to 70 nm (wherein it is included at a concentration of 80% or more based on number average, or at a concentration of 70% or more based on weight average);

(iii) the diamond fine particle, when analyzed by an X-ray diffraction (XD) spectrum analysis using Cu—Kα radiation, having the largest peak at a Bragg angle of 43.9° (2θ±2°), strong and characteristic peaks at either of Bragg angles of 73.5° and 95°, a significantly biased halo at a Bragg angle of 17°, and essentially no peak at a Bragg angle of 26.5°; and (iv) the diamond fine particle having a specific surface area of $1.50\times10^5$ m$^2$/kg or more, wherein all of the surface carbon atoms are substantially bonded with hetero atoms, wherein the diamond fine particle has a total absorption space of 0.5 m$^3$/kg or more.

As mentioned above, according to the present invention, a super fine diamond having an excellent in dispersion stability and an aqueous suspension solution excellent in dispersion stability containing the UDD are used. In this invention, the super-fine diamond particle may be referred to as "nanometer diamond." The nanometer diamond forms an aggregation comprising at least four pieces thereof, and generally, ten pieces to several thousands pieces thereof, and in particular, ten pieces to several hundreds pieces thereof, the aggregation being in a state of separation, which may be refereed to as "Ultra Dispersed Diamond" or "UDD."

A conventional super-fine diamond having a particle size having a unit of nanometer has a relatively small specific surface area (m$^2$/g), a small active site density per a unit surface area, and a large width of particle size distribution, having a small amount of a particle having a relatively large particle size. Thus, such a conventional super-fine diamond has an insufficient dispersion stability in a liquid solvent, being insufficient in an activity. Also, such a conventional super-fine diamond is impossible to use in the present invention from the points of its adsorbent, contact stability with other materials, and mixing stability.

For example, the diamond fine particle manufactured by means of an explosion method is disclosed in *Bull. Soc. Chim. Fr.* Vol. 134 (1997) pages 875 to 890. Usually, a diffraction line of an X ray diffraction has a peak corresponding to a (111) crystal at a Bragg angle (2θ) of 44°±2°, and in addition, a reflective peak showing a presence of an unchanged graphite structure at a Bragg angle (2θ) of 26.5°±2°. The X ray diffraction is, for example, scanned at a tube voltage of 30 kV, and at a pipe current of 15 mA by using a Cu—Kα ray.

UDD Suspension, UDD Powder, and Method for Preparing the Same

According to the present invention, a purified super-fine diamond having a particle size having a unit of nanometer (for example, having an averaged particle size of 4.2 nm) may be used. The super-fine diamond is hereinafter referred to as "nanometer diamond," "Ultra Dispersed Diamond," or "UDD." Also, according to the present invention, an aqueous suspension solution having an excellent dispersion stability may be used, which contains a particle aggregating several pieces of the nanometer diamond. The aggregation comprises at least four pieces of the nanometer diamond, and generally, several pieces to a few hundreds pieces of the nanometer diamond, each particle having a particle size of 4 nm to 70 nm, and in particular, of 4 nm to 40 nm. Further, according to the present invention, a diamond powder may be used, which is prepared by drying the aqueous suspension solution to remove water.

As described above, according to the present invention, the following aqueous suspension solution may be used: A suspension solution of a diamond fine particle, comprising:

84 to 99.95 parts by weight of water; and 0.05 to 16 parts by weight of a diamond fine particle, having the following characteristics:

(i) at the time of being dried, the diamond fine particle having an element composition including 72 to 89.5% of total carbon, 0.8 to 1.5% of hydrogen, 1.5 to 2.5% of nitrogen, and 10.5 to 25.0% of oxygen;

(ii) the diamond fine particle having an averaged particle size of 2 nm to 70 nm (wherein it is included at a concentration of 80% or more based on number average, or at a concentration of 70% or more based on weight average);

(iii) at the time of being dried, the diamond fine particle, when analyzed by an X-ray diffraction (XD) spectrum analysis using Cu—Kα radiation, has the largest peak at a Bragg angle of 43.9° (2θ±2°), strong and characteristic peaks at either of Bragg angles of 73.5° and 95°, a significantly biased halo at a Bragg angle of 17°, and essentially no peak at a Bragg angle of 26.5°; and (iv) the diamond fine particle having a specific surface area of $1.50\times10^5$ m$^2$/kg or more, wherein all of the surface carbon atoms are substantially bonded with hetero atoms, wherein the diamond fine particle has a total absorption space of 0.5 $m^3$/kg or more.

Also, according to the present invention, the following UDD powder may be used: A UDD powder having the following characteristics:

the UDD powder being made from the aqueous suspension solution as described above;

the UDD powder comprising an aggregation of the nanometer diamond, wherein the number of the nanometer diamond composed of the aggregation is from at least four to several thousands pieces, and in particular, from 10 pieces to several hundreds pieces; and the UDD powder generally having a particle size of 300 nm to 500 nm based on number average, having no content of a particle having a particle size of 1000 nm or more, and having no content of a particle having a particle size of 30 nm or less, and preferably having a narrow distribution having a particle size of 150 nm to 650 nm.

The UDD powder of an aggregation may be divided into an original UDD particle, for example, by means of ultrasonic dispersion processing in an aqueous solvent in an acid atmosphere. It may be prepared at a yield of 1 to 5%.

An onion-shaped carbon made of a ultra-dispersed diamond is disclosed in *Chemical Physics Letters,* 222 (May, 1994), pages 343–346. As disclosed therein, a UDD, per se, is conventionally known, having a particle size of 3.0 to 7.0 nm, and an averaged particle size of 4.5 nm.

Namely, among diamond crystals, an octahedron diamond particle is most stable, comprising 1683 carbon atoms. Among them, 530 carbon atoms are located on the surface thereof. It has a particle size of 2.14 nm. There is a cubic diamond particle, having the same quantity as the octahedron diamond particle, comprising 1683 carbon atoms, and in case of the cubic diamond particle, 434 carbon atoms are located on the surface thereof. In the article, there is a description to prepare a UDD by means of an explosion method, having a particle size of 3.0 to 7.0 nm, an averaged particle size of 4.5 nm, and a basic cell constant $\alpha$ of 0.3573 nm. Also, it discloses that an X ray diffraction data shows that the UDD has a phase interval of a face (111) reflection of 0.2063 nm, while a diamond lump has a phase interval of D (111) reflection of 0.205 nm.

Only in view of density, a diamond lump has a basic cell constant $\alpha$ of 0.35667 nm. According to Example 3 in the specifications in the previous applications by the inventions of this application, the UDD preferably used in this present invention has a basic cell constant $\alpha$ of 0.3565 nm, which has a lower density than a conventional diamond lump. However, removal or refining of a non-diamond carbon is more perfectly made, resulting in having a high activity in spite of having a high density than the case of $\alpha$=0.3573 nm.

The particle size of the nanometer diamond particle and the UDD particle of the present invention is measured by means of dynamic light scattering measurement, using an electrophoresis light scattering photometer model ELS-8000. The electrophoresis light scattering method was carried out in the range of 1.4 nm to 5 μm. The particle existing in this range makes Brownian motion, including translation, rotation and refraction, so as to change its position, direction, and shape, with time. Using this phenomenon, a particle size is measured based on the relationship between a size of the particle, which sinks in a medium, and a sinking rate thereof. When a laser light is irradiated at the particle in a Brownian motion, a dispersion light from the particle has a fluctuation corresponding to each of the particle size. By means of a photon detecting method, the fluctuation is detected, and then, the result is analyzed by means of a photon correlation method. (The photon correlation method is one of analysis techniques for random changes; "*Rikagaku giten* (*a dictionary of physics and chemistry*)")

Also, an averaged particle diameter and particle size distribution of the nanometer diamond particle, including those in the UDD and metal composite film, and the UDD are based on image analysis of a SEM photograph image.

The UDD and the UDD suspension solution according to the present invention may be prepared from a crude diamonds. As disclosed in Japanese Patent Application No. 2001-262303, the crude diamond (which is hereinafter referred to as blend diamond or BD) may be synthesized by means of shock conversion method (or an explosion method), as described in: *Science,* Vol. 133, No. 3467 (1961), pages 1821–1822; Japanese Laid-Open Patent Publications Nos. 1-234311 and 2-141414; *Bull. Soc. Chim. Fr.* Vol. 134 (1997), pages. 875–890; *Diamond and Related Materials,* Vol. 9 (2000), pages. 861–865; *Chemical Physics Letters,* 222 (1994), pages. 343–346; *Carbon,* Vol. 33, No. 12 (1995), pages. 1663–1671; *Physics of the Solid State,* Vol. 42, No. 8 (2000), pages. 1575–1578; *Carbon,* Vol. 33. No. 12 (1995), pages 1663–1671; *Energetic Materials,* K. Xu. Z. Jin, F. Wei and T. Jiang, 1,19 (1993) (in Chinese); Japanese Laid-Open Patent Publications Nos. 63-303806 and 56-26711; British Patent No. 1154633, Japanese Laid-Open Patent Publication No. 3-271109, Japanese Laid-Open International Patent Publication No. 6-505694 (PCT WO 93/13016); *Carbon,* Vol. 22, No. 2, pages 189–191 (1984); *Appl. Phys.,* Van Thiei. M. & Rec., F. H., J. 62, pages 1761–1767 (1987); Japanese Laid-Open International Patent Publication of No. 7-505831 (WO 94/18123); U.S. Pat. No. 5,861,349. Preferable methods in the present invention will be explained later in detail.

The crude diamond (blended diamond or BD) prepared by means of such a shock conversion method (explosion method) has a particle size of ten nanometers to a few hundred nanometers, or in some cases, to several hundred nanometers, being in a form of mixture of UDD particles and non-graphite particles. Each particle of the UDD is composed of an aggregation in which diamond units (nanometer diamond) in a very small size of nanometer cluster having a particle size of 1.5 to 7 nm are strongly aggregated to the extent impossibly or hardly to mechanically crash the aggregation. In other words, the UDD is composed of a hard aggregation having at least four pieces, and generally ten pieces to several hundred pieces, of nanometer diamond. The BD includes UDD particles, showing a detection of, at a very few amount, fine particles of amorphous diamond, graphite, and non-graphite carbon, having a particle size of 1.5 nm or less.

In order to prepare the UDD fine particle used in the present invention, a condensation carbon phase is formed by transition by means of explosion of a detonating agent, followed by subjecting to oxidation treatment in a liquid phase to decompose a non-diamond portion thereof. Such oxidation treatment may be made by using nitric acid. If desired, impurities of metal oxide are previously dissolved out by means of treatment of hydrochloric acid. First of all, the condensation carbon phase surrounding the blended diamond is oxidized to decompose so as to separate a diamond component from the other carbon components.

Then, the non-diamond carbon covering the surface of the crude diamond is oxidized to decompose and subjected to oxidation etching, for removal. Furthermore, the non-diamond carbon formed on a surface of the diamond is subjected to oxidation etching for removal. A non-diamond carbon covering the surface of the diamond as well as a non-diamond carbon formed on a surface of the diamond are generally considered to be generated by a mechanism that a formed diamond, in a process of transition by means of explosion of a detonating agent, is affected in a rapid reduction of a pressure while remaining a raised temperate. The non-diamond carbon covering the surface of the diamond and the non-diamond carbon formed on a surface of the nanometer diamond may be oxidized to decompose and subjected to oxidation etching, possibly at a simultaneous manner, but preferably at a sequence process.

The nanometer diamond constituting the UDD product purified has an average diameter of $42\pm2\times10^{-10}$ m when measured by coherent scattering photoelectric field (CSF). According to the result of the measurement of the product of the present invention, a property derived from a diamond crystalline lattice in the core portion of the UDD is detected, and also a small amount of aggregations of carbon atom having an atom interval smaller than $1.5\times10^{-10}$ m, which is not forming a lattice and dispersed in the UDD particle, is detected. On the other hand, another measurement is made to reveal to have a property of aggregations of carbon atom at a very small amount at the internal interface of the particle in the purified product. Since its interatomic distance is plotted in a Gaussian distribution, it is found that that the aggregation body of carbon atoms formed at the internal interface of the particle is of amorphous.

Conventionally, such kind of UDD fine particles have a specific surface area of (2.5 to 3.5)$\times10^3$ $m^2/g$ and a porous volume of (0.3 to 1.0)$\times10^{-3}$ $m^3/kg$, showing a reduction in specific surface area when being heated at 1273° K. Also, conventional UDD fine particles have, in a state of suspension, a particle size as large as $1000\times10^{-6}$ m, but when being dried, the conventional UDD fine particles aggregate to be polydisperse powder. Also, when being heated under an inert atmosphere, the UDD fine particles are increasing to change it into a spherollite form at a temperature as low as 873° K. The UDD fine particle in a spherollite form may be broken by imposing a mechanical pressure of (100 to 150)$\times10^6$ Pa. Thereafter, it will be less possible to aggregate again nor to form a polydisperse powder.

On the contrary, the UDD fine particle of the present invention is prepared under an uneven condition in a process of synthesis in the present invention, so as to have defects in a high density, a large surface of $1.50\times10^5$ $m^2/kg$ or more, the surface being remarkably large compared with the conventional ones. Also, such a large surface, as a whole, has a highly developed activity to have an excess enthalpy. Also, the UDD fine particle has a total absorption space of 0.5 $m^3/kg$ or more based on the condition of $p/p_s=0.995$ (wherein "p" represents surface area inside the pore filled with $N_2$ gas and "$p_s$" represents a partial pressure of nitrogen gas for forming a single layer of $N_2$ gas), whose value is remarkably different from that of the conventional ones. These properties should support the utility of the UUD fine particle of the present invention.

Furthermore, the UDD fine particle of the present invention has a number of volatile substances and solid impurities deposited on the surface thereof, which are necessary for a severe condition to remove them. The volatile substances may be acid residues (in a state after chemical purification process) such as CO, $CO_2$, $N_2$, $H_2O$, $H_2SO_4$, and $HNO_3$, and the solid impurities may be insoluble compounds or salts such as non-diamond, metal oxides, or carbide. Eventually, the UDD fine particle of the present invention comprises 72 to 89.5% of whole carbon, 0.8 to 1.5% of hydrogen, 1.5 to 2.5% of nitrogen, and 10.5 to 25.0% of oxygen (which is compared with a conventional diamond comprising 90 to 99% of whole carbon, 0.5 to 1.5% of hydrogen, 2 to 3% of nitrogen, and less than 10% of oxygen), as elemental composition. Among all forms of carbon contained, 90 to 97% of carbon is in a state of diamond crystal and 10 to 3% of carbon is in a state of non-diamond.

The impurities in the UDD fine particle may theoretically be classified into (i) a water soluble (ionized) electrolyte, (ii) a hydrolysable and ionic impurity, which is chemically combined with a diamond surface (in a salt form of a functional group on the surface), (iii) a water insoluble impurity (that is, an impurity of insoluble salt or an insoluble oxide mechanically disposed on the surface thereof), and (iv) an impurity trapped inside the crystal lattice of the diamond particle or encapsulated thereinside. The impurities (i) and (ii) are formed in the process of purification of the UDD fine particle. The primary impurity of water soluble electrolyte (i) may be removed by washing the UDD with water. However, an ion-exchange resin may be preferably used for more advanced washing steps.

Almost all the functional groups on the surface of the UDD fine particle of the present invention may be negative groups such as —COOH, —OH, —$SO_3H$, —$NO_3$, and —$NO_2$ groups, but also there exists amino group (which is considered to be generated in a neutralization stage).

Therefore, the diamond of the present invention is per se considered to be an ion exchange material. That the aqueous suspension solution of the UDD fine particle is treated with an ion exchange material to have a surface group in a state of non-salt is considered to be effective in view of the subsequent process.

The water soluble impurity (iii) may be both of an isolated micro particle comprising metals, metal oxides, metal carbides, and metal salts (sulfates, silicates, and carbonates) and an inseparable surface salt or a surface metal oxide. To remove them, i.e. to transfer them into a soluble form, an acid is used according to the present invention.

According to the present invention, the impurities (I), (ii) and (iii) can be removed up to 40 to 95% thereof, by means of various methods, but it is impossible to completely remove those impurities, and also, it is not essential to completely remove them according to the present invention. Those impurities of the UDD does not adversely affect measurement of the using of a DNA chip of the present invention, trapping of a virus, and preparation of a vaccine. Apart from the complete removal of the impurities (iii), it is not considered to be practical to remove the impurities (iv) by means of chemical treatment. Basically, elements to form the impurities may be include silicon, calcium, iron, sulfur, titanium, copper, chromium, and potassium, which are practically and always present in a small amount. Since the UDD of the present invention, having a highly activated surface, is able to absorb impurities in a solution for removal, it may be useful to such an application. Therefore, a part of the impurities, that is, silicon, potassium and iron, may, on the contrary, decrease the water hardness used in the purification technique of the UDD. Iron is fundamentally one of technological impurities (that is, a material applicable to be used in a shock conversion method), and it is difficult to remove it up to a concentration less than 1.0 or 0.5 wt. %. Iron in such a concentration may be there mainly at the surface thereof.

The UDD fine particle of the present invention contains a great number of kinds and amounts of volatile impurities (as much as 10% by weight). They can be decreased by purification by means of heat treatment under a vacuum condition of 0.01 Pa. An appropriate temperature for heating it in a process may be set up to 400° C., and the optimum temperature for heating it may be set up to 250° C.

The BD is subjected to various oxidizing systems based on nitric acid, and alternatively, to various non-oxidizing systems based on an organic solvent (that is, hydrocarbon, alcohol), so as to obtain the UDD, whose compositions and properties are summarized in Table 1.

TABLE 1

| BD-sample Treatment conditions (wt. %) | UDD gross-formula | Relative quantity of heteroatoms on 100 atoms of carbon |
|---|---|---|
| initial, $\alpha = 0$ | $C_{100}H_{5.3}N_{2.8}O_{4.1}$ C:86.48%, H:0.81%, N:2.22%, O:10.49% | 12.2 |
| treatment with hydrocarbons $CnH_{2n+2}$ | $C_{100}H_{13.8}N_{2.9}O_{4.6}$ C:90.36%, H:1.04%, N:3.06%, O:5.56% | 21.3 |
| treatment with alcohols $CnH_{2n+1}OH$ | $C_{100}H_{15.3}N_{2.6}O_{8.0}$ C:86.96%, H:1.12%, N:2.24%, O:9.28% | 26.1 |

Degree of oxidative decomposition $\alpha$ = [(C"ox in Cox)/Cox ] × 100 (Where Cox is total mass for oxidizable carbon in DB or UDD, and C"ox in Cox is the same in an oxidated sample)

A non-oxidative treatment of the BD with an organic solvent (hydrocarbon $CnH_2n+_2$, and an alcohol $CnH_2n+_1OH$) does not affect the carbon skeleton of the UDD particle, but changes surface functional groups resulting in changing an elemental composition of the BD. In other words, as hydrocarbon and alcohol are bonded to and consumed by the UDD, the contents of hydrogen and oxygen are relatively increased. Thus, the total number of the hetero elements (hydrogen, nitrogen, and oxygen) are increased double.

Manufacture of the UDD

Method for preparing an improved UDD fine particle used in the present invention comprises the steps of: preparing an initial mixture of a diamond and non-diamond mixture (initial BD) by means of explosion of a detonating agent (shock conversion); subjecting the initial mixture to an oxidation treatment to obtain a suspension solution including the diamond; separating a phase including the diamond, wherein after the oxidation treatment, a basic material having per se volatility or to generate a decomposed material having volatility is added, to neutralize with nitric acid, and thereby obtained a diamond fine particle having a functional group on the surface thereof.

It is preferable that the oxidation treatment is performed to repeat a step of heating at a temperature of 150 to 250° C. under a pressure of 14 to 25 atm for a period of at least 10 to 30 minutes several times. Also, it is preferable that the oxidation treatment comprises an oxidative decomposition step by using nitric acid, an oxidative etching step with nitric acid after the oxidative decomposition step, and a neutralization step to decompose nitric acid after the oxidative etching step.

Further, the oxidative etching step is preferably carried out at a higher pressure and a higher temperature than those of the condition for the oxidative decomposition step. Furthermore, the oxidative etching step preferably comprises a primary oxidative etching step and a secondary oxidative etching step, the secondary oxidative etching step being preferably carried out at a higher pressure and a higher temperature than those of the condition for the primary oxidative etching step. While the neutralization step by the basic material produces a suspension solution including the diamond, it is also preferable that the phase including the diamond is obtained by adding water and decanting it, thereby separating the phase including the diamond from the other phase without the diamond.

After the step of decanting with water for separating the phase including the diamond from another phase without the diamond, the obtained suspension solution is preferably subjected to washing with nitric acid, to divide it into a lower suspension liquid containing the prepared diamond particles and an upper drain liquid, and then, the lower suspension liquid containing the prepared diamond particles is separated from the upper drain liquid. Also, the step of separating the lower suspension liquid containing the prepared diamond particles from the upper drain liquid may preferably comprise a step of leaving the suspension liquid washed with nitric acid as it is for a while.

Moreover, the method may further comprise a step of subjecting the lower suspension liquid containing the prepared diamond particles, to a pH- and concentration-adjustment treatments so as to adjust a pH value of 1.0 to 7.9, and preferably, of 1.5 to 6.95, and more preferably, of 2 to 6.0, and a diamond fine particle concentration of 0.05 to 16%, and preferably, of 0.1 to 12%, and more preferably, of 1 to 10%.

Accordingly, a favorable method for preparing an improved UDD suspension liquid according to the present invention comprises the steps of: preparing an initial mixture including a diamond and a non-diamond (an initial BD) by explosion of a detonating agent (shock conversion); subjecting the mixture including the diamond and the non-diamond to an oxidative decomposition treatment; subjecting the mixture including the diamond and the non-diamond to an oxidative etching treatment to prepare a nitric acid solution including a UDD fine diamond particle; adding a basic material having per se volatility or to generate a decomposed material having volatility to neutralize by generating a decomposition reaction with nitric acid; decanting the obtained suspension solution with water; washing the decanted suspension solution with nitric acid followed by leaving it as it is to form a lower suspension liquid containing the UDD fine particles and an upper drain liquid; taking out the lower suspension liquid followed by washing it with nitric acid; subjecting the suspension liquid to centrifugal separation; and if necessary, subjecting the suspension liquid to pH- and concentration adjustment treatments to finally prepare an aqueous suspension liquid of the UDD fine particles.

Further, the powder of the UDD fine particle according to the present invention is prepared by subjecting the suspension liquid including the UDD fine particle to centrifugal separation to take out the UDD fine particle, followed by drying it at a temperature of 400° C. or less, and preferably at a temperature of 250° C. or less.

However, the UDD aqueous suspension solution of the present invention doe not necessarily include a surfactant for the purpose of an extended shelf stability. A surfactant added sometimes improves dispersion stability. However, a surfactant may decrease dispersion stability of the UDD suspension solution. In particular, if the UDD aqueous suspension solution is thick and in a state of paste for an extended storage, a surfactant may decrease dispersion stability. A UDD and metal composite film of the present invention may be typically prepared by using a plating bath including a UDD aqueous suspension solution.

A UDD and metal composite film of the present invention has a film thickness of 5 nm (0.005 μm) to 35000 nm (35.0 μm), and in particular, of 32 nm (0.032 μm) to 30000 nm (30.0 μm), by means of image analysis of a SEM photograph. A metal thin film having a film thickness of less than 5 nm may be useful in an operation of a vapor deposition method or spatter method, but it is difficult to be controlled in an operation of an electroplating method. On the other hand, a metal thin film having a film thickness of more than 35.0 μm may be prepared if the plating is continued for an extended period. However, a metal thin film having a film thickness of more than 35.0 μm is less practical to be used especially in case where a scale reduction for reducing a size and weight, as well as an improved physical hardness and wear resistant, are demanded.

According to the present invention, the UDD and metal composite film has a diamond particle almost homogenously dispersed in the direction of the film thickness, which means that, as being clear in the description hereinafter, the diamond particle homogenously disperses not only in the direction parallel to the surface thereof but also in the direction of the film thickness. The metal thin film has a UDD dispersed at an almost constant concentration, at any portions inside the metal thin film.

The UDD and metal composite film of the present invention has a UDD particle at a concentration of 0.8% to 12%, and in particular, of 1% to 8%. Generally, the composite thin film having a UDD particle at a concentration of less than 0.8% would be insufficient in a property, which is expected to improve by the UDD particle. On the other hand, the composite thin film having a UDD particle at a concentration of more than 12% would be difficult in controlling for homogenously dispersing it in the metal thin film.

The UDD used in the present invention is a small particle, having a particle size of 16 nm or less at a number average existence rate of 50% or more, based on a conversion into a circle having an equivalent area. In addition, the UDD of the present invention has a narrow particle size distribution, having a particle size more than 50 nm or less than 2 nm, at a number average existence rate of substantially 0%. Furthermore, it is preferable to use a UDD particle having an almost sphere shape with a projection image thereof, whose ratio of a long axis to a short axis is 2.2 or less, and in particular, 1.4 or less.

A metal constituting the UDD and metal composite film of the present invention may include Au, Cr, Cu, In, Mo, Ni, Pd, Rh, V, and W. Among them, it is practical to use a metal selected from the group consisting of Au, Cr, In, Mo, Ni, and V since these metal may be combined with a UDD by means of a plating method, to remarkably improve physical hardness.

The UDD fine particle used in the present invention has a high hardness and a low electric conductivity, which are specific to a diamond. In addition, it is excellent in electromagnetic properties such as low dielectric property and low magnetic sensitivity, good in lubricity, high in thermal conductivity, and excellent in heat resistance. It is also excellent in dispersion property, which is specific to a super fine particle having a narrow particle size distribution. It is also excellent in surface activity, and ion or cation exchange property, and good in compatibility with a metal material and ceramics. Furthermore, the UDD fine particle of the present invention generally has a crystal shape specific to a diamond, that is a cubic form. In other words, the UDD fine particle of the present invention generally does not have a twin-crystal having a shape of rectangular or striped flattened form. Also, the UDD particles of the present invention has in fact a porous active surface having a round shape derived from an oxidative decomposing treatment and an oxidative. etching treatment subjected to the BD.

The UDD fine particle is colorless and transparent. When it is mixed with another material, it is dispersed uniformly therein, thus being very difficult to visually observe the appearance of such a mixed material by naked eyes. Also, the UDD fine particle of the present invention, when it is dispersed into a solid composition, can not be observed. Thus, this UDD fine particle can be used in the field of molds for parts of automobile and motorcycle, equipment materials for aircraft and space industry, elements and parts for chemical plant, computer and electronics, and optical elements and parts for office automation (OA) and camera, and recording medias such as magnetic tape and compact disc. It may be added to improve, for example, slidability, lubricity, abrasive resistance, heat resistance, thermal expansion resistance, peel-off resistance, water and chemical resistances, gas-corrosive resistance, appearance, touch feeling, color tone, and specific gravity, and density. However, the best performance of the present invention is expected where the UDD fine particle is used in a condition of suspension solution, especially, aqueous suspension solution, to show its good dispersibility.

As explained hereinafter concretely and in details, the metal thin film of the present invention has a high mechanical strength, since it includes a super-fine UDD particle having a narrow particle size distribution at a high density. In other words, the UDD included has a high activity, so that it may be introduced in a thin film at a high concentration, the UDD having a very small particle size with a narrow particle size distribution.

Namely, a metal and diamond composite plating film has a properties, such as wear resistance, micro hardness, corrosion resistance, low porosity, reduction of a friction coefficient, adhesion and aggregation, and a high dispersion property in an electrolyte. An eutectoid film of a UDD and a metal has been studied to use it in the field of machine manufacture, shipbuilding, airplane manufacture, tool manufacture, electronics, electric technology, radio technology, medical science, and jewelry industry, and some products has been already practically used. In other words, the use of a UDD in electroplating has characteristic as follows:

1. Improvement in Quality and Competitiveness of a Product.

(I) Remarkable Wear Resistance and High Micro Hardness (See the followings.)

| (1) UDD + Metal | Wear Resistance Magnification | Micro Hardness $(h \cdot 10^{-3})$ kg · mm$^{-2}$ |
|---|---|---|
| Cr | 2–12 | 1.4 |
| Ni | 5–8 | 0.68 |
| Cu | 9–10 | 0.154 |
| Au | 1.8–5.5 | 0.18 |
| Ag | 4–12 | 0.25 |
| Sn | 3 | — |
| Al | 10–13 | 1.5 |

(2) Improvement in Adsorption and Decrease of Friction Coefficient (3) Low Porosity: For example, a plating of a UDD and Zn has a porosity decreased by 6 to 8 times. A plating of a UDD and Sn has a porosity decreased by 7 times. A plating of a UDD and Au has a porosity decreased by 8 times. A plating of a UDD and Cu has no porosity.

(4) High Insulation of an Anodized Aluminum Film: This film has a weight increased by 2.0 to 3.5 times.

(5) Corrosion Resistance: A plate of a UDD and Cu has no weight loss in a usual test for examining corrosion resistance. A plate of a UDD and Zn has a corrosion resistance improved by 2 to 4 times.

(6) Increased Dispersion of an Electrolyte: A dispersion property of a plate of a UDD and Cu is increased by 3 times. A dispersion of a plate of a UDD and Zn is increased by 1.5 to 2.0 times.

(7) Improvement in Elasticity: A plate of a UDD and Cu has a elasticity increased by 2 to 4 times.

(II) Extension of Duration by 2 to 10 Times (III) Save of Materials, Energy, and Processing: The plate has a thickness increased by 2 to 3 times.

(IV) A productivity in a plating line is increased by 20 to 50%: This is come from the reducing of a plating thickness and the increasing of a rate to form a film.

(V) The environment in a plating process is improved.

(1) The addition of a UDD into an electrolyte for a chemical nickel plate may improve duration of a nickel plate by 4 to 9 times.

(2) A metal plate has a UDD at a content of 0.1–1.5% by weight, and an anode oxidation film has a UDD at a content of 0.5–40% by weight, in all the weight of metals therein.

A metal film having a thickness of $1\cdot10^{-6}$ m has a UDD's consumption rate of 1 carat($2\cdot10^{-4}$ mkg)/1 $m^2$.

(VI) A developed plate has a dielectric property as follows:

(1) At −4000 MHz, it has a dielectric property of 2.58 to 2.71. A dielectric loss angle tan δ diamonds on a film thickness.

(2) At −5000 MHz, it has a passage coefficient of 15.0, and a reflective coefficient of 12.4, which depend on a film thickness.

(3) At −11000 MHz, it has a passage coefficient of 14.3, and a reflective coefficient of 12.4, which depend on a film thickness.

(4) The plate preserves a physical machine characteristics and a work capability at a load of an order of $2\cdot10^6$ $kg\cdot m^{-2}$.

With respect to deformation of a particle aggregation, a stress is considered which deforms a solid material such as a thin film comprising a large numbers of fine particles, or that including them in a state of a multiplayer. At a surface having a gap between two layers in a multilayer structure having a fine particle included, the two layers are divided into an upper layer and a lower layer, to diphase them by a distance "x." At that time, the stress "τ" is necessary for making such a diphase. For simplification, a particle interval "b" between the particles constituting each of the layers may be expressed by a periodic function, which is expressed as follows:

$$\tau=k \sin (2\pi x/b).$$

The particle interval "b" is a distance between a first particle and a second particle next to the first particle. In details, the particle distance "b" is a distance between a first center of the first particle and a second center of the second particle. When the first particle has a particle size same as that of the second particle, it is referred to as a "particle size." (In the later description, it is similar with respect to a "phase interval between particles 'a.'" in the perpendicular direction.)

Where "x" is small, the case is in accordance with a Hooke's law, resulting in expressing as follow:

$$\tau=\mu(x/a),$$

wherein "μ" represents a rigidity, and "a" represents a phase interval between particles.

Also, in the formula of $\tau=k \sin (2\pi x/b)$, when a distance "x" is much smaller than a particle distance "b," or when a distance "x" is extremely small, the formula is changed as follows: $\tau\sim k(2\pi x/b)$. ("*Study for Material Strength,*" Baifukan Co., Ltd., published on Jan. 20, 1983, written by Naomichi Igata, page 38.)

In other words, a stress necessary for a gap is inversely proportional to a distance "a" between particles included, and a particle interval "b." That is, a solid material such as a thin film, including a much volume of particles filled therein, has a stress necessary for making a mechanical gap, which is inversely proportional to a particle size of a fine particle included.

Moreover, there is a formula of Hall-Patch to express a stress required for an internal transition of a particle in a filled material "*Study for Material Strength,*" Baifukan Co., Ltd., published on Jan. 20, 1983, written by Naomichi Igata, page 108.

Moreover, there is a formula of Hall-Petch, which expresses a relationship among a stress $\sigma_y$ for making internal transition, initial friction $\sigma_0$, and a particle size "d" of a particle, as follows:

$$\sigma_y=\sigma_0+k_y d^{-1/2}.$$

This formula shows that a stress a $\sigma_y$ for making internal transition depends on a square root of a particle size "d" of a particle. In this formula, "$k_y$" represents a constant varied by a temperature.

According to the formula, a stress $\sigma_y$ for making internal transition depends on an initial friction $\sigma_0$ between particles, and in addition, on a constant $k_y$. In any event, it shows that the smaller a particle size "d" of a particle becomes, the more a stress $\sigma_y$ for making internal transition is required.

Therefore, these conventional theories relating to a fine particle aggregation well correspond to the fact that a metal thin film of the present invention includes a super-fine UDD particle having a narrow particle size distribution at a high density, resulting in having a high mechanical strength.

An aqueous suspension solution including the UDD fine particle of the present invention in an amount of 15.5% (Volume: 1100 g, the content of the UDD: 170 g), the UDD fine particle comprising 98.22% of carbon, 0.93% of oxidizable residual carbon in the oxidative purification treatment, 0.85% of incombustible residue, based on a dried powder, has a warrantee of durability of 24 months as a commercial product.

An aqueous suspension solution including the UDD fine particle of the present invention in an amount of 12.5% (Volume: 2010 g, the content of the UDD: 251 g), the UDD fine particle comprising 98.40% of carbon, 0.85% of oxidizable residual carbon in the oxidative purification treatment, 0.75% of incombustible residue, based on a dried powder, has also a warrantee of durability of 24 months as a commercial product.

An aqueous suspension solution including the UDD fine particle of the present invention in an amount of 11.0%

(Volume: 552 g, the content of the UDD: 56 g), the UDD fine particle comprising 98.87% of carbon, 0.73% of oxidizable residual carbon in the oxidative purification treatment, 0.4% of incombustible residue, based on a dried powder, has also a warrantee of durability of 24 months as a commercial product.

An aqueous suspension solution including the UDD fine particle of the present invention in an amount of 11.5% (Volume: 1044 g, the content of the UDD: 120 g), the UDD fine particle comprising 98.8% of carbon, 0.8% of oxidizable residual carbon in the oxidative purification treatment, 0.4% of incombustible residue based on a dried powder, has also a warrantee of durability of 24 months as a commercial product.

The UDD fine particle of the present invention, in the form of a suspension liquid at a concentration as high as 16%, does not aggregate and precipitate during storage for six months at a room temperature (15 to 25° C.). In general, any aqueous composition is degraded at a double rate, as a storage temperature is raised by 10° C. For example, since almost all of the metal plating process are carried out under a condition of an elevated temperature, the aqueous suspension liquid of the UDD fine particle of the present invention, having a resistance to high temperature as above mentioned, may be a good advantage. However, it is preferable to store the aqueous suspension liquid of the UDD fine particle, usually at a temperature of −15° C. to 10° C.

Since the UDD fine particle of the present invention has various carboxyl groups on the surface, it is improved in dispersion stability and activity as described above. The behavior of the UDD fine particle is similar to that of n-type semiconductors. The UDD fine particle exhibits to be weak acid, showing a slightly low electric conductivity. The UDD fine particle may be durable for the using under an elevated temperature as high as 60 or 70° C., but it is preferable to avoid the using in the condition exceeding such a temperature. The aqueous suspension liquid of the UDD fine particle of the present invention is, in general, adjusted to a pH value of 4.0 to 10.0, and preferably of 6.0 to 7.5. If its pH value exceeds 10, the suspension liquid is apt to be unstable.

As described in Japanese Examined Patent Publication No. 63-33988, and Japanese Laid-Open Patent Publication Nos. 4-333599 and 8-20830, *"Material Inspection Technology,"* Vol. 40, No. 4, page 95, and *"Coloring Materials,"* Vol. 71, No. 9, pages 541–547, a plating electrolytes having a suspension of a particle, such as a diamond particle, generally requires to add a surfactant for the purpose of dispersion stability of the suspended particle.

However, an aqueous suspension solution of the UDD fine particle according to the present invention does not necessarily require to add a surfactant. The addition of a surfactant may maintain its dispersion property, but in many cases, the addition of a surfactant will decrease the dispersion property of the aqueous solution of the UDD fine particle of the present invention. Therefore, the UDD aqueous suspension solution used in the present invention may be preferably subjected to an electrolytic plating.

A UDD and Metal Composite Film and Method for Preparing the Same

As described above, the UDD and metal composite film is prepared by using a UDD dispersed suspension solution of the present invention, by means of a plating method using a plating bath.

When the UDD aqueous suspension solution is subjected to plating, a metal to be plated is selected from the group consisting of Ia, IIIa, Vb, VIa, VIb, and VIII of the periodic table of Elements. In details, the metal belonging to the group Ia may include Cu and Au. The metal belonging to the group IIIa may include In. The metal belonging to the group Vb may include V. The metal belonging to the group VIa may include Sn. The metal belonging to the group VIb may include Cr, Mo, and W. The metal belonging to the group VIII may include Ni, Pt, Rh, and Lu. In addition, alloys thereof may be used. Such a metal is commonly provided in a form of a water soluble metal salt or complex salt. As an acid source, an inorganic compound such as hydrochloric acid, sulfuric acid, boric acid, stannic acid, fluoroboric acid, chromic acid, and cyanic acid, and an organic compound such as sulfamic acid, acetic acid, benzenedisulfonic acid, cresolsulfonic acid, and naphthol disulfonic acid may be selected.

The plating process may be electroplating, electroless plating, or electro-forming. The plating bath (plating solution) is prepared by adding the UDD of the present invention at a concentration of 0.01 to 120 g, preferably of 0.05 to 32 g, and more preferably of 1.0 to 16 g, per a liter of the plating solution. It may be understood, that the concentration of the UDD in the plating solution can easily be controlled in a desired level, from the concentration of the UDD in its suspension liquid of the present invention. Also, as the plating solution according to the present invention occurs no aggregation of the UDD, even if the UDD is added in a higher concentration than that of a conventional method, it can inhibit the UDD particles to precipitate in the bath, by generation of a gas bubble near the electrodes during operation. Further, the UDD particle is certainly prevented to precipitate, by stirring operation that is usually carried out in a plating process. The thickness of a plated metallic layer of the present invention is in a range of 0.1 to 350 μm, preferably 0.2 to 100 μm, depending on a plating condition, an application of the plated material, and a kind of a substrate to be plated. For example, the electroplating may be in a range of 0.1 to 0.5 μm thickness in a case of Au layer, in arrange of 0.1 to 10 μm thickness in a case of Rh layer, in a range of, 3 to 30 μm thickness in a case of Ni layer, and in a range of 5 to 100 μm thickness in a case of Cr layer. In case of electro-forming which may produce a metal layer having a relatively large film thickness, and for example, in case of a Ni layer electro-forming, the film thickness may be formed to have a thickness as large as 350 μm.

As shown in FIG. 1, in case of an Al plating, however, an $Al_2O_3$ layer may be formed by anodization, and thereby formed $Al_2O_3$ film is porous, thereby allowing the UDD particles to irreversibly enter the pores to improve a property of the layer.

A UDD aqueous suspension liquid of the present invention can be stably used at a concentration of 16% at maximum, in a condition without stirring. When the concentration of the UDD in the suspension liquid is high, the UDD particles can be increased to be deposited in the resultant plated metallic layer. For example, in case of a Ni plating, the UDD can be contained in an amount of 1 g in one of liter of a plating liquid, and it produces a Ni layer having a UDD content of 0.2% by weight. Also, by the Ni plating liquid containing a UDD at a concentration of 10 g per liter, a Ni plating layer produced includes the UDD at a content of 0.7% by weight. Accordingly, the content of the UDD in the plating layer can be increased ($10^{-2}$ g for 1 g of the plating layer) almost in proportional to a common logarithm of the UDD content in the suspension (g/liter). Thus, the Ni plating layer produced may increase Ni content to usually 1% to maximum 12% (under stirring) by weight of the UDD. Similarly, a resultant Ag plating layer may contain usually 0.1 to 0.2% by weight and 5% of maximum content, and, a Cr plating layer may contain 7.0% (under stirring) by weight.

However, when the UDD suspension is too high concentration, UDD particles may easily apt to be precipitated or aggregated thus declining the stability. In reverse, when the UDD suspension is too low concentration, the UDD content in the resultant plating layer may declined to unfavorably level. The concentration of the UDD in the suspension liquid is hence favorable in the level of 0.05 to 1.6%, preferably 0.1 to 12%, or more preferably 1 to 10%. When concentration is lower than 0.05%, the UDD will hardly be deposited at a desired rate in the plating layer. When the concentration exceeds 16%, the suspension liquid will becomes unstable.

The UDD of the present invention has a large amount of negative charge functional groups formed on the surface thereof, and thus, it is excellent in surface activity and the affinity. Also, since the UDD fine particle does not include ones having a particle size larger than the predetermined range, resulting in a narrow particle size distribution. Therefore, the UDD fine particle of the present invention can hardly be aggregated and precipitated, which is unlike the conventional super fine particles of diamond. The UDD fine particle of the present invention may produce an aqueous suspension solution in which it is dispersed in a stable state. As described before, when the suspension solution of the UDD fine particle is aqueous, the addition of a surfactant is not essential, and rather, it may result in decreasing its dispersion stability. It is considered that such decrease of stability may occur by the following reason:

Namely, the conventional UDD fine particle includes a cationic surfactant added. However, if the suspension solution of the present invention include it, the cationic portion in the surfactant tends to be drawn to the negative charge functional groups on the surface of the UDD fine particle as shown in FIG. (2A) model. As a result, each hydrophobic long-chain hydrocarbon group of the surfactant is oriented with facing to the outside of thereof, resulting in being lacking in hydrophilic property.

Figure 2:
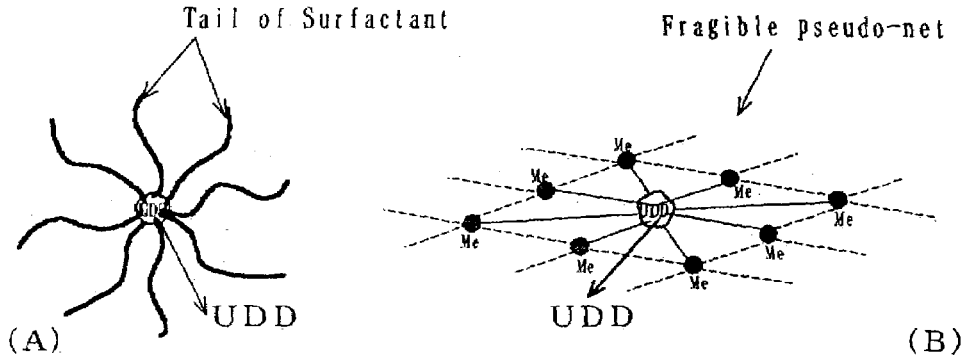
FIG. 2 shows an illustration view to explain how the UDD according to the present invention functions in a plating liquid.

On the other hand, as illustratively shown in FIG. 2B, the negatively charged UDD particle of the present invention is being bonded with cationic metal atoms in the plating liquid to form a quasi net structure which can easily be fractured and reconstructed. The quasi net structure is migrated towards the anode (a positive electrode) by the action of a voltage and deposited as a mixture metal plating.

Figure 3:
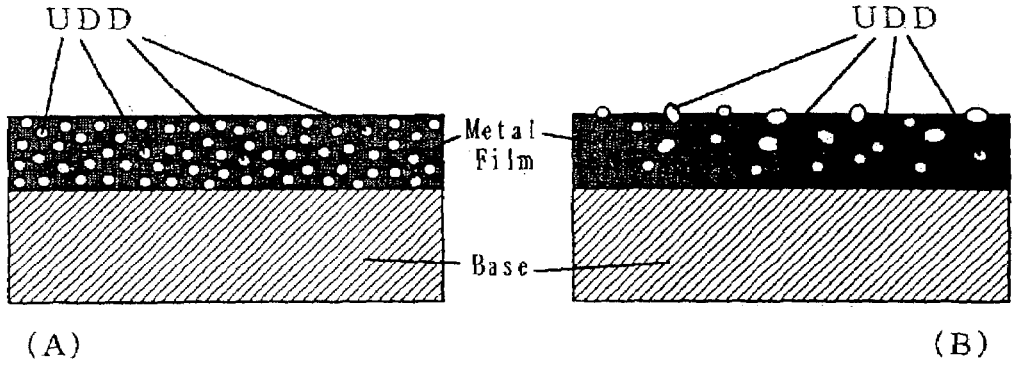
FIG. 3 shows a cross-sectional view of a metal film containing the UDD of the present invention.

Accordingly, as illustratively shown in FIG. 3A, the UDD contained metal film of the present invention can have the UDD particles dispersed uniformly at a high density therein. Conventional UDD-containing metal film is schematically illustrated in FIG. 3B where the UDD content becomes lower in proportion with depth levels from surface of plated layer to the bottom of the layer. In some cases of conventional UDD, particles thereof may not completely be embedded in the metal film but exposed at the surface to the outside. This may result from a difference of transferring ratio of the metal atoms and UDD particles in plating baths of conventional process and of process in the present invention, and it is considered that the conventional bath is modified by surface-active agent causing change of charged state and has particles of larger diameters. However the above phenomenon is not one for limiting the present invention, but one for assisting the compatibilities between UDD particles modified by surfactant and UDD particles of the present invention. Sufficient miscibility of UDD particles of the present invention which are modified by surfactant into resin solution of the hydrocarbon organic solvent, may be supported by the hypothesis.

By the way, in case where the UDD and metal composite film of the present invention is prepared in a plating bath by means of an electroplating method, the preferable conditions, being similar to the case of an alloy plating or an eutectoid plating, are summarized as follows:

(i) There is no delay in an electric charge passage and transfer reaction at an interface of a negative electrode.
(ii) Near the negative electrode, the deposited material has a less variation in its concentration. That is, the plating bath has less variations in its concentration, and there is no significant difference in diffusion rate.
(iii) There is no local variation in positive and negative ions, which control a transportation value.
(iv) There is not formed a resistance coat which prevents metal deposition at a negative electrode.
(v) There is not formed a resistance coat which generates an excess deposition.
(vi) There is not formed a resistance coat which disturbs a deposition condition.

Therefore, when a UDD and metal composite film including a UDD at a high content is intended to be prepared, it may be preferable to add a suitable surfactant at a small amount according to the present invention. Usually, a surfactant is added in a plating bath to control such a condition as described in the above-mentioned (i) to (vi), which are referred to as a gooseberry in plating. A surfactant functions to replace four $H_2O$ molecules surrounding a metal ion into a UDD particle, which has a negative electric charge similar to that of the metal ion. Also, a surfactant makes an electric bridge between a metal ion and a UDD particle due to intramolecular polarization of a self-dipole. Also, it functions to average electric charges in a cluster, which prevent deviation of a deposition potential therebetween (so as to make eutectoid difficult).

As mentioned above, the preferable conditions for plating are summarized as follows:

(i) There is no delay in an electric charge passage and transfer reaction at an interface of a negative electrode.
(ii) Near the negative electrode, the deposited material has a less variation in its concentration. That is, the plating bath has less variations in its concentration, and there is no significant difference in diffusion rate.
(iii) There is no local variation in positive and negative ions, which control a transportation value.
(iv) There is not formed a resistance coat which prevents metal deposition at a negative electrode.
(v) There is not formed a resistance coat which generates an excess deposition.
(vi) There is not formed a resistance coat which disturbs a deposition condition.

In order to obtain such conditions, it is preferable that a plating bath is agitated, in particular, by means of ultrasonic agitation.

Here, a cationic surfactant is used in an alkaline bath, and an anionic surfactant is used in an acid bath, and a nonionic surfactant is used in an acidulous or neutral bath. According to the present invention, it is preferably used an anionic surfactant and a nonionic surfactant.

Detailed Description for the Method for Producing the UDD

The method for preparing the method for producing the UDD fine particle of the present invention is described in more detail with reference to the drawings.

Figure 4:
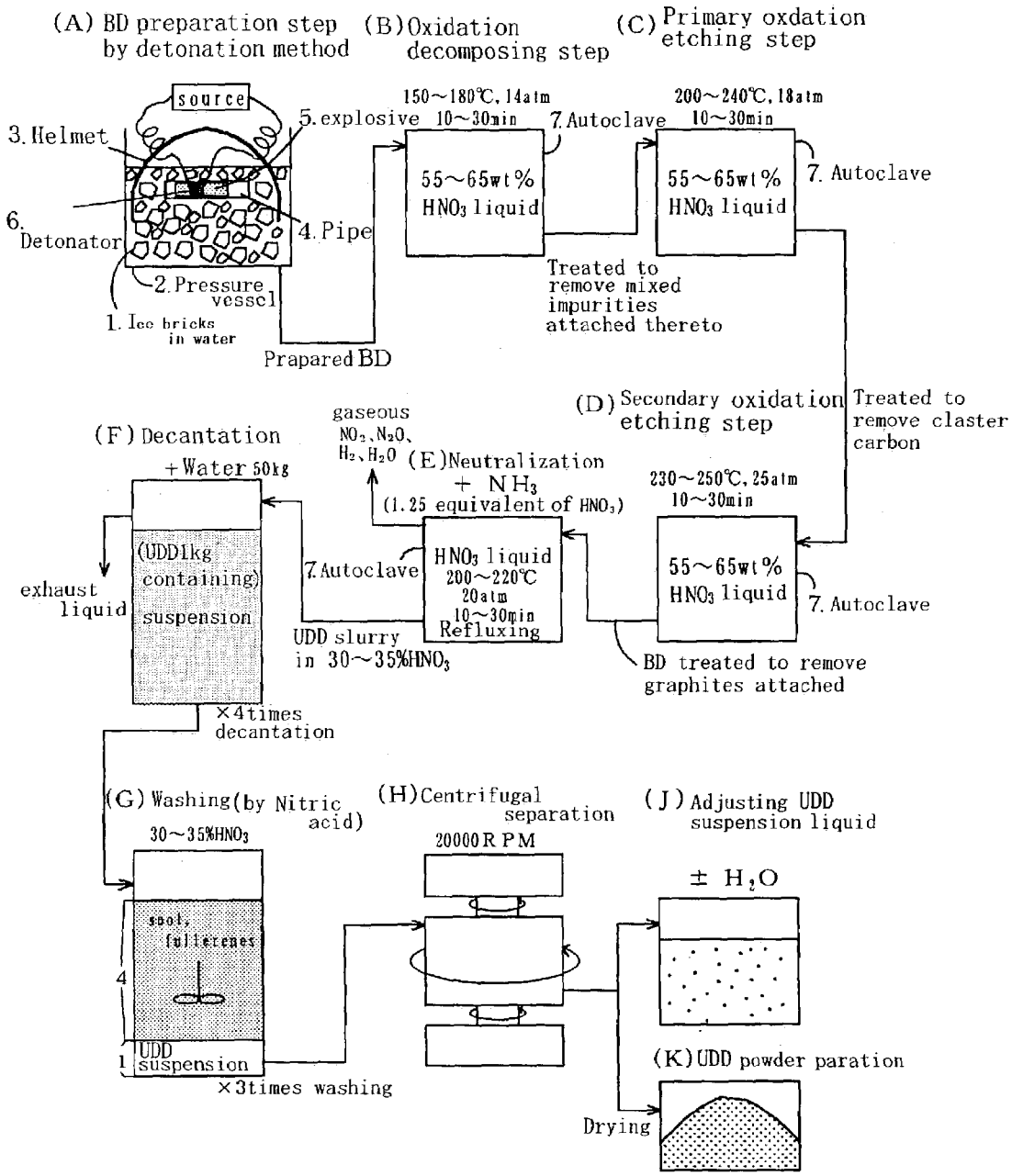
FIG. 4 shows an illustration view of a process for preparing an aqueous solution of a UDD and a powder thereof, according to the present invention.

FIG. 4 is a schematic diagram showing a procedure of producing an improved UDD fine particle of the present invention. In the method as shown as an example, the method of producing the UDD fine particle of the present invention comprises the steps of: (A) preparing an initial BD by means of explosion of a detonating agent (shock conversion process); (B) collecting thereby obtained initial BD, followed by subjecting it to an oxidative decomposition for eliminating contaminants including carbon; (C) subjecting the obtained initial BD purified by the oxidative decomposition to a primary oxidative etching treatment for removing hard carbon mainly covering the surface of the BD; (D) subjecting the BD after the primary oxidative etching treatment to a secondary oxidative etching treatment for removing hard carbon existing in ion-permeable gaps between the UDD particles composing of the BD aggregation body or at crystalline defects; (E) to a nitric acid solution including the BD subjected to the secondary oxidative etching treatment, adding a basic material for strong neutralization reaction, wherein the basic material is per se volatile or to generate a decomposed material having volatility, so as to generate a decomposition reaction involving a small explosion to divide a secondary aggregation body aggregating the UDD fine particles into a primary aggregation body separating respective UDD fine particle; (F) sufficiently decanting with water the UDD suspension liquid produced by the neutralization; (G) washing with nitric acid, and then, trapping the decanted UDD suspension liquid in a static state to deposit and separate a lower suspension layer located underside including the UDD fine particle from an upper drain layer portion; (H) subjecting the washed UDD suspension liquid to centrifugal separation; (J) preparing a purified UDD suspension aqueous solution at a specific pH and at a concentration subjected to the centrifugal separated UDD suspension; and (K) subjecting the centrifuged UDD to drying at a temperature of 250° C. or less, and preferably at a temperature of 130° C. or less, so as to obtain a powder of the UDD fine particle. The UDD aqueous suspension solution of the present invention after the step (J) has a pH value of 4 to 10, and preferably of 6 to 7.5.

In the step (A) of preparing the initial BD by explosion method (shock conversion process), a pure titanium vessel (2) of pressure resistance filled with water and a large amount of ice bricks are prepared to provide with an explosive agent (5) with an electric detonator (6) (in the example, that is TNT (tri-nitro-toluene)/HMX (cyclotetramethylene tetranitramine at 50/50), inside the body of the vessel, placing horizontally a steel pipe (4) having a plug at one side for containing an explosive agent (5), covering a steel helmet (3), followed by being detonated, and then taking out a product, namely, the initial BD, from the water containing ice bricks in the vessel (2).

Here, the temperature in the step for preparing the BD is important. As the BD prepared under a cooled condition tends to decrease the density of structure defects to be bonded with oxygen containing functional groups as active sites or absorption sources, the use of ice is preferably limited or avoided if possible.

The collected BD (initial BD) is subjected to an oxidative decomposition step (B) where it is dispersed into a $HNO_3$ solution at a concentration of 55 to 56% by weight in an autoclave at a temperature of 150 to 180° C., for subjecting an oxidative decomposition at a pressure of 14 atm for a period of 10 to 30 minutes, so as to decompose carbon and other inorganic contaminants. After the oxidative decomposition step (B), the BD is subjected to a primary oxidative etching step (C). The condition in the primary oxidative etching step (C) is crueler, setting to be at a temperature of 200 to 240° C. under a pressure of 18 atm to remove hard carbon deposited on the surface of the BD.

Next, the obtained BD is followed by a secondary oxidative etching step (D). This secondary oxidative etching step is intended to remove small amounts of hard carbon existing in an ion-permeable interface gap formed between the UDD fine particles of BD aggregation body, or at the crystalline defects of the surface of the UDD fine particle. The condition for the treatment is crueler, namely, at a temperature of 230 to 250° C. under a pressure of 25 atm. According to the present invention, the treatment is not limited to perform under a condition at a temperature of 150 to 180° C. under a pressure of 14 atm, at a temperature of 200 to 240° C. under a pressure of 18 atm, and at a temperature of 230 to 250° C. under a pressure of 25 atm, but it is preferable at least to have the condition continuously getting crueler. After the secondary oxidative etching step (D), the solution has a pH value of 2 to 6.95.

The neutralizing step (E) is a unique feature of the present invention, that is, such a step is distinct from any conventional methods. In the step of neutralizing step, the addition of a basic material to generate a volatile decomposition product may increase the pH value from a range of 2 to 6.95 to a higher range of 7.05 to 12. In the neutralizing step (E), the nitric acid solution containing the BD product after the secondary oxidative etching is mixed with a basic material, which is per se volatile or generates a decomposed material having volatility, so as to neutralize it. In the neutralizing step, nitric acid remaining in the BD in the nitric acid aqueous suspension solution, and a cation generally having an ion radius smaller than that of an anion permeates to attack, so as to generate a neutralization reaction, decomposition reaction, impurity removal solution reaction, gas generation reaction, and surface functional group generating reaction, involving a small explosion among the reaction couple, resulting in increasing the temperature and pressure of the system. As a result, the BD aggregation body is divided into respective UDD fine particle. Also, the neutralization reaction step (E) involves a small explosion to form a large specific surface area and a porous space for absorption of the UDD fine particle of the present invention.

The basic material may include: hydradine, methyl amine, dimethyl amine, trimethyl amine, ethyl amine, diethyl amine, triethyl amine, ethanol amine, propyl amine, isopropyl amine, dipropyl amine, aryl amine, aniline, N,N-dimethyl aniline, diisopropyl amine, poly-alkylene poly-amine such as diethylene triamine and tetraethylene pentamine, 2-ethylhexyl amine, cyclohexyl amine, piperydine, formamide, N,N-methyl formamide, and urea. For example, when the basic material is ammonium, the reactions are occurred with an acid as follow:

$$HNO_3+NH_3 \rightarrow NH_4NO_3 \rightarrow N_2O+2H_2O$$

$$N_2O \rightarrow N_2+(O)$$

$$3HNO_3+NH_3 \rightarrow NH_4NO_2 \rightarrow N_2O_3+H_2O+O_2+(O)$$

$$NH_4NO_2 \rightarrow N_2+2H_2O$$

$$N_2O_3+NH_3 \rightarrow 2N_2+3H_2O$$

$$N_2O_3 \rightarrow N_2+O_2+(O)$$

$$NH_4NO_2+2NH_3 \rightarrow 2N_2+H_2O+3H_2$$

$$H_2+(O) \rightarrow H_2O$$

$$HCl+NaOH \rightarrow Na^+Cl^-+H_2O$$

$$HCl+NH_3 \rightarrow NH_4^+ + Cl^-$$

$$NH_4^+ \rightarrow NH_3 + H^+$$

$$H_2SO_4 + 2NH_3 \rightarrow N_2O + SO_2 + NO_2$$

Various gases such as $N_2$, $O_2$, $N_2O$, $H_2O$, $H_2$, and $SO_2$ are generated by the above reactions, and such gases are discharged to the outside of the system. Therefore, the system is less affected by the resultant residues.

In the decanting step (F) after the neutralizing step, a step of the decanting of the UDD suspension with water is repeated for a specific times (for example, three times or more). In the washing step (G) after the decanting step, the decanted UDD suspension is stirred with nitric acid added (using a mechanical magnetic stirrer, in this example), to wash it, followed by leaving it as it is to form a lower layer of the UDD suspension solution and an upper drain layer. The lower layer of the UDD suspension solution is drawn to collect. The lower suspension solution containing the UDD fine particle is separated, from the upper drain layer. In a case, for example, where 50 kg of water is added into 1 kg of suspension solution containing the UDD fine particle, the interface between the upper drain layer and the lower suspension solution may be unclear, but the volume of the lower suspension solution containing the UDD fine particle is about one fourth of the volume of the upper drain liquid. While the upper drain liquid contains very fine particles of diamond having a particle size of 1.2 to 2.0 nm, it may be possible that such particles aggregates together with impurities, and these aggregations are impossible to be crushed by mechanical forces. Therefore, according to the present invention, such aggregations of very fine diamond particles are not necessary to be collected.

The UDD suspension liquid taken from the bottom of the vessel is subjected to a centrifugal separating step (H), which is conducted by a high-speed centrifugal separator at a rate of 20000 rpm. If necessary, the UDD suspension liquid after the step (J) of the adjusting of the UDD suspension aqueous solution may be subjected to a drying step (K) to prepare a power of the UDD fine particle. The UDD fine particle prepared by the method of the present invention has a very narrow range of particle distribution either in a suspended form or a powder form. As a result of measurement, it is found that the UDD fine particle does not include ones having a particle diameter having 1000 nm or more, (which is distinct from a conventional UDD particle including one having a particle diameter of 1000 nm or more, at a concentration of 15% or more), nor ones having a particle diameter of 30 nm or less. The UDD fine particle of the present invention has a narrow distribution of particle diameter of 150 to 650 nm, and typically of 300 to 500 nm, with respect to a volumetric average particle diameter. Such a UDD fine particle can be crushed, for example, by subjecting it to a mechanical shearing action.

The UDD fine particle of the present invention has a specific density of $3.2\times10^3$ to $3.40\times10^3$ kg/m$^3$. An amorphous carbon has a specific density of $(1.8 \text{ to } 2.1)\times10^3$ kg/m$^3$ and a graphite has a specific density of $2.26\times10^3$ kg/m$^3$, and a natural diamond has a specific density of $3.51\times10^3$ kg/m$^3$, and further, an artificial diamond synthesized by static conversion technique (not shock conversion) has a specific density of 3.47 to 3.50. Accordingly, the UDD fine particle of the present invention has a specific density smaller than those of natural diamond and a synthetic diamond prepared by static conversion method.

On the other hand, the UDD suspension liquid of the present invention is prepared by adjusting to have a pH value of 4 to 10, and preferably of 6 to 7.5. It has a volumetric average particle diameter of the UDD fine particle, suspending in a liquid, mostly having a particle diameter of 2 to 70 nm (at a concentration by number average of 80% or more, and at a concentration by weight average of 70% or more), having a narrow particle distribution. The suspension liquid may include the UDD fine particle at a concentration of 0.05 to 16%, and preferably of 0.1 to 12%, and more preferably of 1 to 10%. If the suspension liquid has a concentration less than 0.05%, a metal film is not designed to include a UDD at a sufficient content expected by using a plating bath including the suspension solution. Also, a resin film is not obtained to have a UDD in an increased content. If the suspension liquid has a concentration exceeding 16%, the storage stability of the suspension liquid may be adversely affected.

In FIG. 4, the steps (B), (C) and (D) are illustrated as if these steps are carried out in discontinuous systems using different vessels or facilities. However, these steps, of course, may be carried out continuously in the same system of the same one vessel or facility. In similar manner, the steps (F) and (G) may be carried out either in discontinuous systems or the same system. The vessel used may be a pressure vessel.

Figure 5:
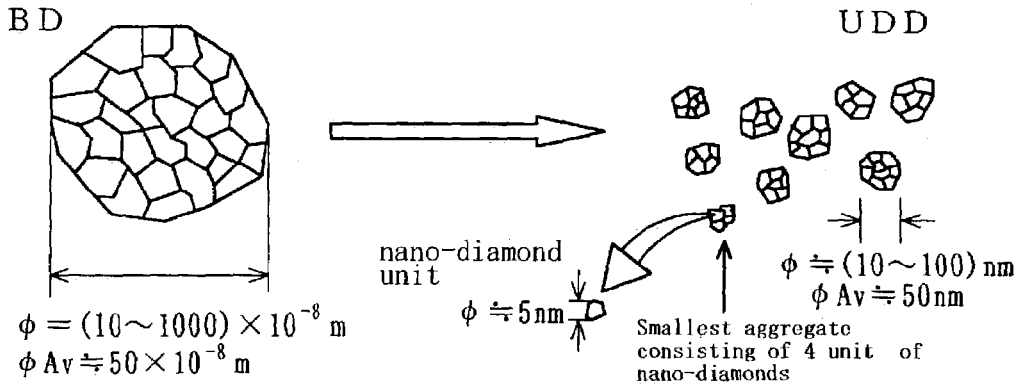
FIG. 5 shows a view to explain a formation process of a UDD powder of the present invention.

As illustrated in FIG. 5, the step is subjected to the initial BD having a particle diameter of $(10 \text{ to } 1000)\times10^{-8}$ m to obtain a purified UDD fine particle, composed of a number of solid aggregations, each comprising a diamond aggregation of at least four pieces, and generally, ten pieces to several hundred pieces, having a unit of nanometer. Thereby obtained UDD fine particle has an average particle diameter of 4.2±2 nm, mainly having a particle diameter of 2 to 70 nm, having a narrow particle distribution, having an average particle diameter of about 16 nm or less. The resultant UDD fine particle has a high content of other hetero atoms (hydrogen and oxygen) except nitrogen, having a large specific surface area. Also, since it has a large porous area in the porous portions, the UDD fine particle of the present invention has its surface of extreme high activity, resulting in a very good dispersion property. The yield of the purified UDD (based on the amount of a detonating agent used) is between 1% and 5%, usually.

EXAMPLES

A UDD, a UDD Suspension Solution, Method for Preparing the Same

Examples shown in this application are intended to explain the present invention, and should not be construed to limit the present invention.

Production Example 1

With respect to the UDD fine particle prepared by the method of the present invention as shown in FIG. 4, the results of elemental analysis are shown, which depends on the degree of oxidative decomposition treatment and oxidative etching treatment. The result is based on 100 carbon atoms by calculations.

TABLE 2

The element composition of BD

| Treatment conditions initial BD (wt. %) | Sample No. | Gross-formula | Relative quantity of heteroatoms on 100 atoms of carbon |
|---|---|---|---|
| initial, $\alpha = 0$ (Comparative Example 1) | 1 | $C_{100}H_{5.3}N_{2.8}O_{4.1}$ C:86.48%, H:0.81%, N:2.22%, O:10.49% | 12.2 |
| $\alpha = 26.3\%$ (Comparative Example 2) | 2 | $C_{100}H_{25.4}N_{2.9}O_{22.5}$ C:73.80%, H:1.56%, N:2.50%, O:22.14% | 50.8 |
| $\alpha = 31.8\%$ (Comparative Example 3) | 3 | $C_{100}H_{34.9}N_{2.9}O_{23.1}$ C:72.94%, H:2.12%, N:2.47%, O:22.47% | 60.9 |
| $\alpha = 55.0\%$ | 4 | $C_{100}H_{11.2}N_{2.2}O_{9.1}$ C:86.48%, H:0.81%, N:2.22%, O:10.49% | 22.5 |
| $\alpha = 64.9\%$ | 5 | $C_{100}H_{19.3}N_{2.1}O_{23.5}$ C:73.86%, H:1.19%, N:1.18%, O:23.14% | 44.9 |
| $\alpha = 74.4\%$ | 6 | $C_{100}H_{18.7}N_{2.0}O_{22.8}$ C:74.46%, H:1.16%, N:1.74%, O:22.64% | 43.5 |
| $\alpha = 75.5$ | 7 | $C_{100}H_{23.7}N_{2.4}O_{22.9}$ C:73.91%, H:1.46%, N:2.07%, O:22.57% | 48.8 |

In Table 2, the degree of oxidization a is identical to that described before.

The result of the analysis exhibits important and, interesting technical discoveries. Namely, oxidative decomposition materials of the BD have various contents of carbon and hetero atoms. From the results in FIG. 2, it is found that the content of hetero atoms in the BD and UDD do not have a linier proportion relationship with their treatment condition (oxidation degree $\alpha$). Also, from the results in FIG. 1 and FIG. 2, the contents of hydrogen atom as a hetero atom in the BD or UDD are ranging between 5 and 35 atoms per 100 atoms of carbon. The contents of oxygen are also ranging between 4 and 24 atoms per 100 atoms of carbon. However, the contents of nitrogen are ranging to have 2 to 3 atoms per 100 atoms of carbon, showing no significant changes depending on the treatment condition (oxidation degree $\alpha$).

As being omitted to show in Table 2, it is considered that the generation of carbon dioxide gas is closely relating to the condition of the surface of the BD. Therefore, a test was made to confirm that the variations of treatment condition, such as the raising of temperature and the raising of acid concentration, gradually increase the ratio of the changing of carbon atoms in the BD into carbon dioxide gas.

In the oxidative etching step preferably used in the present invention, amorphous carbon having a disturbance structure is first of all oxidized, and then, carbon of micro-graphite structure is oxidized. In other words, initial BD including a non-diamond form of carbon may be changed into a purified product to have a chemically less active material.

However, in the process for producing the UDD fine particle of the present invention, the condition under a specific oxidative etching for an extended period of time may decompose a part of the diamond material. Degree of the oxidative etching step according to the present invention is limited to up to 45%, approximately, of the UDD, or up to 76.5% of the initial BD.

Production Example 2

Figure 6:
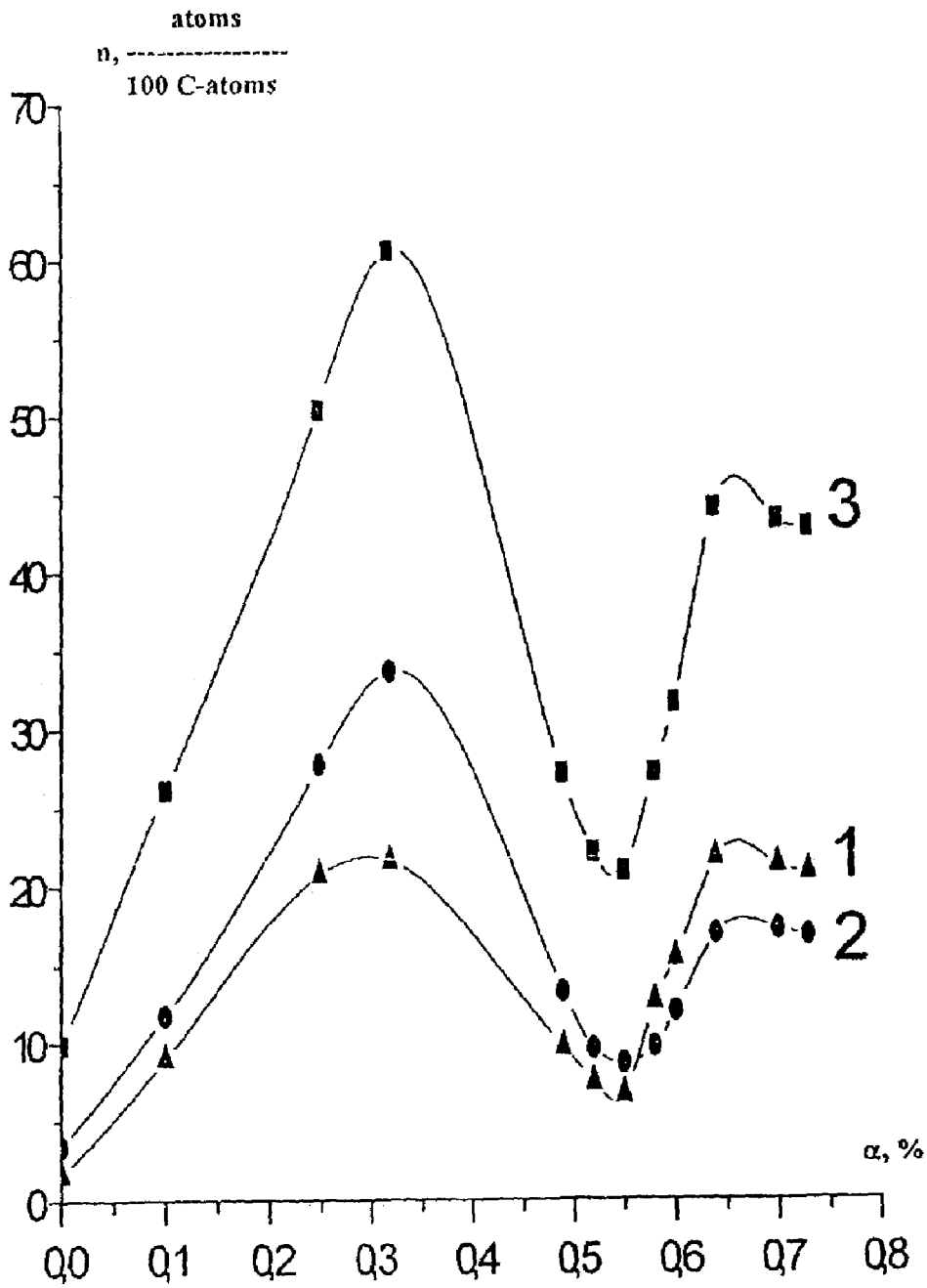
FIG. 6 shows a graph showing a relationship between an oxidation and its element composition, with respect to a UDD of the present invention.
Figure 7:
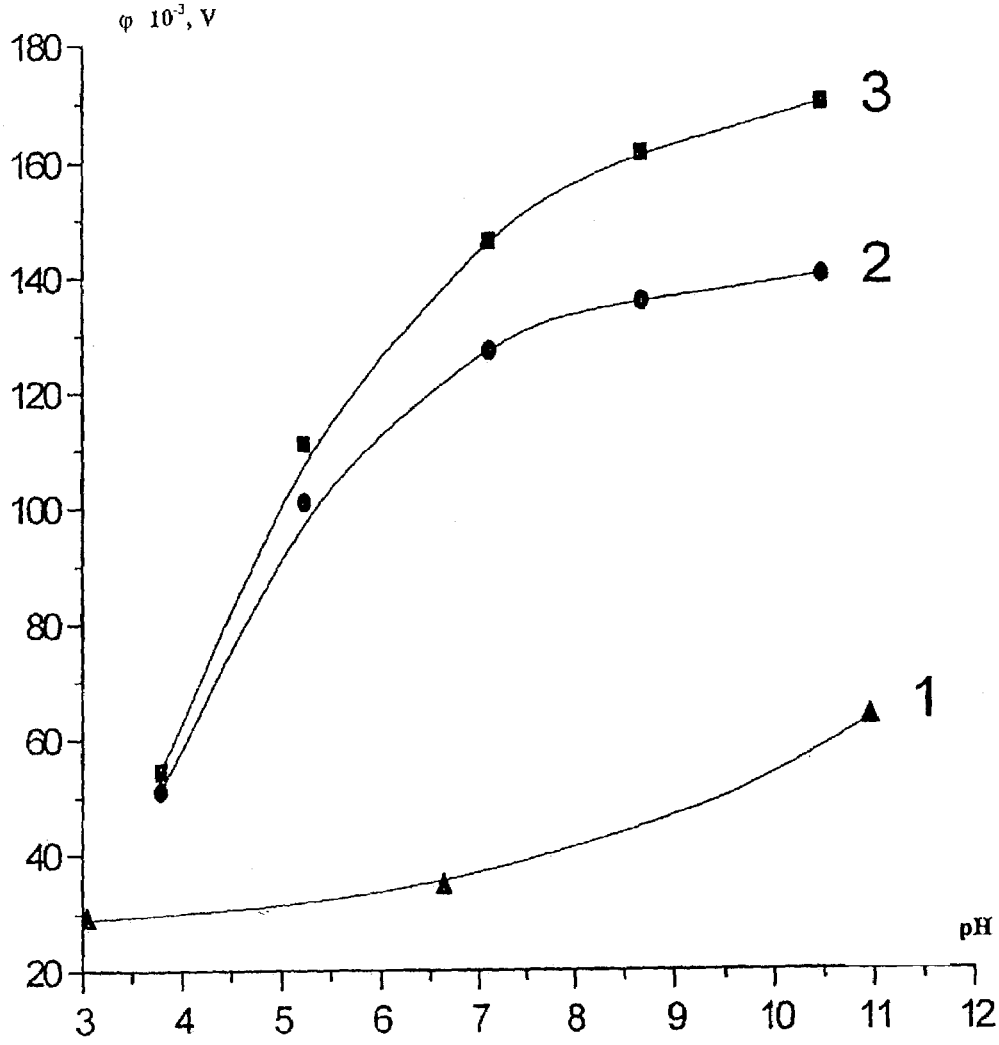
FIG. 7 shows a graph showing a relationship between a pH value and an activity, with respect to a UDD of the present invention.

Similar to Production Example 1 as described above, an oxidation treatment was subjected to an initial BD, to prepare twelve samples according to the present invention, with varying degrees of oxidization, as shown in FIG. 6.

As being apparent from a graph as shown in FIG. 6, the degree of oxidation decomposition and etching is not simply related to a composition of a BD obtained. In other words, a composition of a BD does not depend proportionally on a degree of oxidization. An initial BD has a minimum content of hetero atoms for 100 carbon atoms, and a partially oxidized BD (at $\alpha$=26 to 31%) has a content of hetero atoms for 100 carbon atoms of 55.9, and a partially etched BD (at $\alpha$=65 to 75%) has a content of hetero atoms for 100 carbon atoms of 45.7. As the degree of oxidization is proceeded with, a content of hydrogen and oxygen atoms is varied, so as to approach a certain value of a chemical composition of functional groups located on the surface thereof.

With respect to a UDD preferably used in the present invention, a metastable structure, such as a partially oxidized BD and a partially etched UDD, is relaxed to soften its hard surface by means of a reaction medium, to form a hetero bond at maximum, thereby increasing an activity thereof. A BD and UDD preferably used in the present invention has a relatively stable structure, which has hetero atoms at minimum. However, its activity is much higher than that of a conventional fine particle of diamond ($C_{100}H_{1.1}O_{2.2}$) synthesized by means of a static conversion method, or than that of a soot ($C_{100}H_{5.1}O_{4.1}$).

The results obtained above show that from a chemical point of view, an oxidative decomposition process, including continuous changes of each of the phases, is proceeded with as follows: 1) First of all, a structural defect in a carbon matrix and an etching of a bond between particles are occurred, and then, a reaction surface is increased, before a surface thereof is saturated with a semi-oxidation product; and 2) the surface is relaxed or softened to continue etching, and an oxidation product generated from the oxidation reaction on the surface is made into a gas, which is removed. Also, each of the phases has a property of circularity, since a substance unhomogeneous in structure is decomposed. An oxidant effects selectively depending on a structure.

The BD and UDD of the present invention include have hetero atoms at a high content, which may have a biased bond property of carbon therein. As a result of calculation, a diamond particle having a diameter of $4\times10^{-9}$ m, approximately, comprises $12\times10^{3}$ carbon atoms at maximum, among which $3\times10^{3}$ carbon atoms are located on the surface thereof. Accordingly, the UDD of the present invention has a chemical formula as expressed in Table 3.

TABLE 3

| Internal atoms | Surface atoms |
|---|---|
| $C_{75}$ | $C_{25}H_{11.2}N_{2.8}O_{9.1}$ |

The other examples are omitted to describe here, but they have similar compositions.

As being apparent from the aspect as mentioned above, it is concluded that substantially all of the carbon atoms located on the surface of the UDD fine particle of the present invention are bonded with hetero atoms. The UDD preferably used in the present invention has "substantially all of surface carbon atoms bonded to hetero atoms," which means such a condition as described here.

A study was carried out with respect to a concentration of an active hydrogen $H_{act}$ located at the surface of the UDD of the present invention. The results show that hydrogen atoms are active when they are bonded with any other atoms than the carbon atoms. With respect to the active hydrogen atom $H_{act}$ located at the surface thereof, the condition of the active hydrogen atom $H_{act}$ may be identified, which is located on a functional group such as hydroxy, carbonyl, amino, and sulfone groups.

An interaction between a functional group located on the surface of a BD or a UDD of the present invention, and methyl magnesium iodide was studied under the presence of anisole, in three processes as follows: (1) An interaction between impurity molecules and the outer surface thereof (which has a better accessibility to a functional group); (2) an interaction with the surface having an opening; and (3) an interaction with a free surface of a UDD aggregation due to mechanical crash.

Depending on a treatment condition for a BD and UDD, the UDD fine particle may have a protogenic functional group at a concentration of 0.34 to 2.52 micro kg equivalent weight per square meter, and an activated hydrogen at a concentration of 0.49 to 7.52 micro kg equivalent weight per square meter. Therefore, the UDD and the BD may have a hydrogen atom capable of being free, existing on the surface thereof, at an amount of 4 to 22% of the total amount of hydrogen atoms contained in the UDD particle.

The surface of the UDD particle used in the present invention has various kinds of oxygen-containing functional group, giving an electric charge to the UDD, which determine a dispersion concentration of the particle in an aqueous liquid, an affinity, and a phonon electrolyte concentration, as well as affect a pH value of the aqueous liquid. Based on pH values of all the examined suspension solutions including the powder, a specific absorption may be examined, which depends on a degree of dissociation of an acid group located on the surface thereof. The specific absorption due to decomposition and etching of a carbon material is varied discontinuously, extremely and remarkably.

The initial BD has a low specific absorption, indicating that the BD is prepared in a non-oxidative medium, thereby only small amount of the oxygen-containing groups being positioned on the surface of the BD. In the present invention, the BD is simultaneously subjected to an oxidizer in two steps, proceeding with the surface of BD being saturated with an oxygen-contained group, and thereby a carbon component are etched. As increasing an oxidative effect, the carbon surface is saturated with the oxygen-containing group, and eventually, the specific absorption is reached at maximum, and thereafter, to be constant. However, when the content of an oxidative carbon exceeds 18 to 20%, the specific absorption is decreased.

Such phenomenon is coincident with the result disclosed in Russian Patent No. 2046094 by Bjuljuten Izobretenij, (29), 189 (1995), for "A synthetic diamond contained material." The Russian patent is briefly summarized in FIG. 4 for reference.

FIG. 4 shows a remarkable curve, indicating that a change in a structural property of the BD surface is occurred during the treatment with an oxidizer, such that a graphite structure is changed into a diamond structure. (Such phenomenon is similar to the present invention.) The material has a high absorption in the middle of the conversion. According to an oxidation under an intensive oxidizing condition, only a portion having a stable structure forms, that is a diamond, is left. Under a moderate oxidation condition, an interface between a diamond carbon and a non-diamond carbon are replaced. In fact, there is 18 to 20% of a pseudodiamond of an oxidative carbon, which is similar to a diamond but is not a diamond. The pseudodiamond is finally oxidized, which is located at a vicinity of a diamond cluster.

Production Example 3

Next, as Production Example 3, the UDD as used in the present invention is described to have an excellent surface property.

Figure 8:
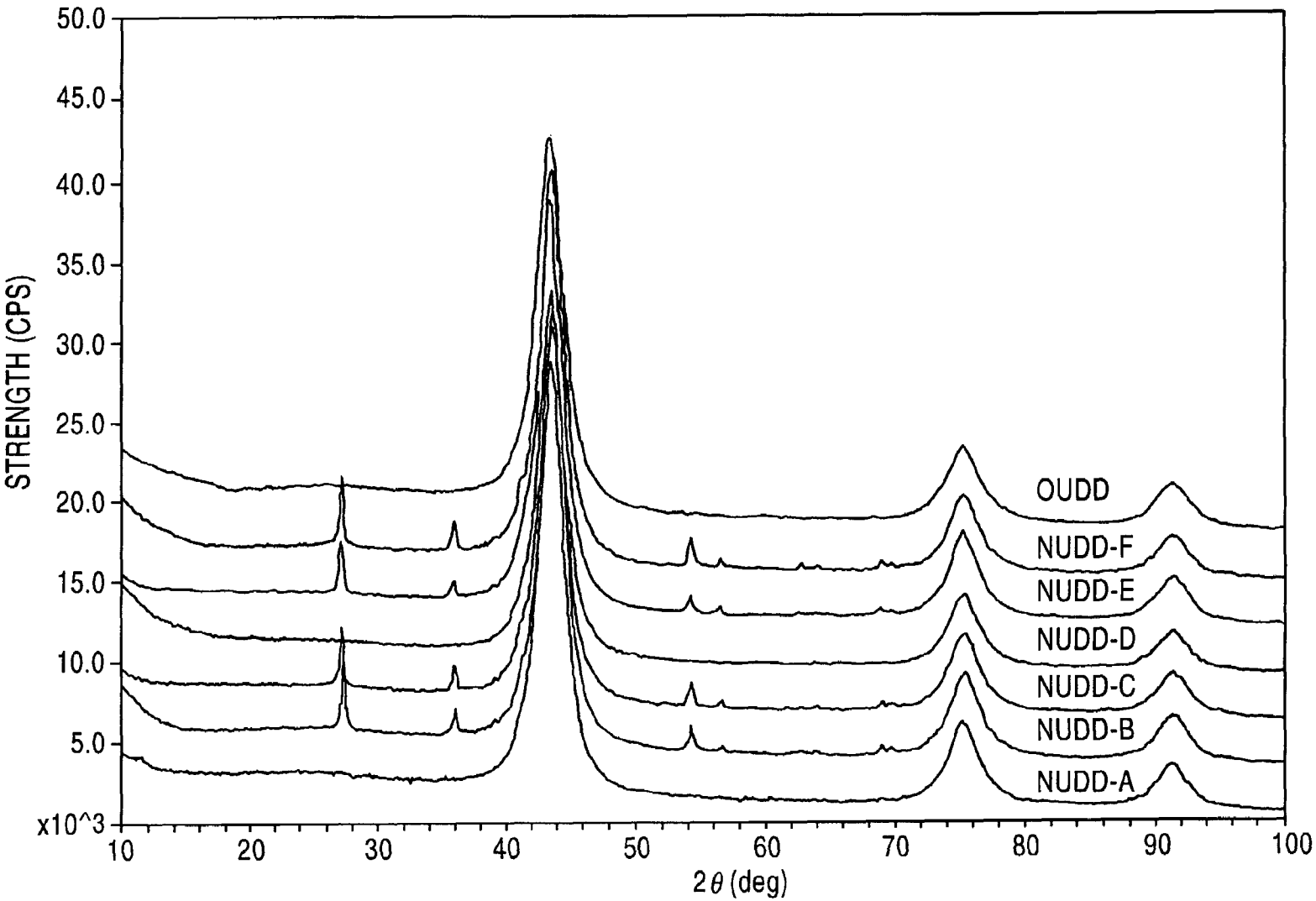
FIG. 8 shows an X ray diffraction chart of a UDD powder of the present invention.
Figure 9:
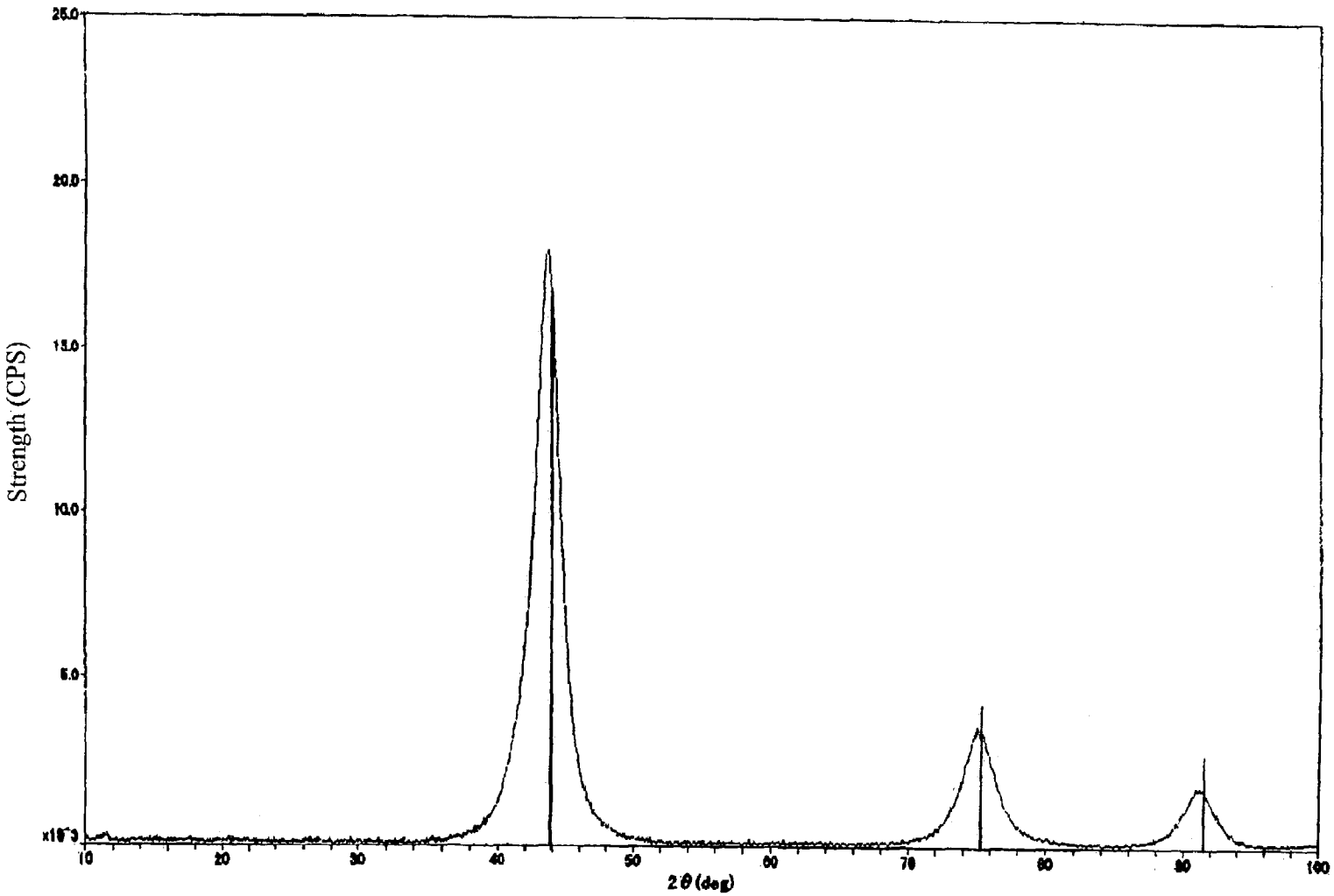
FIG. 9 shows an X ray diffraction chart, in details, of a UDD powder of a sample of the present invention.
Figure 10:
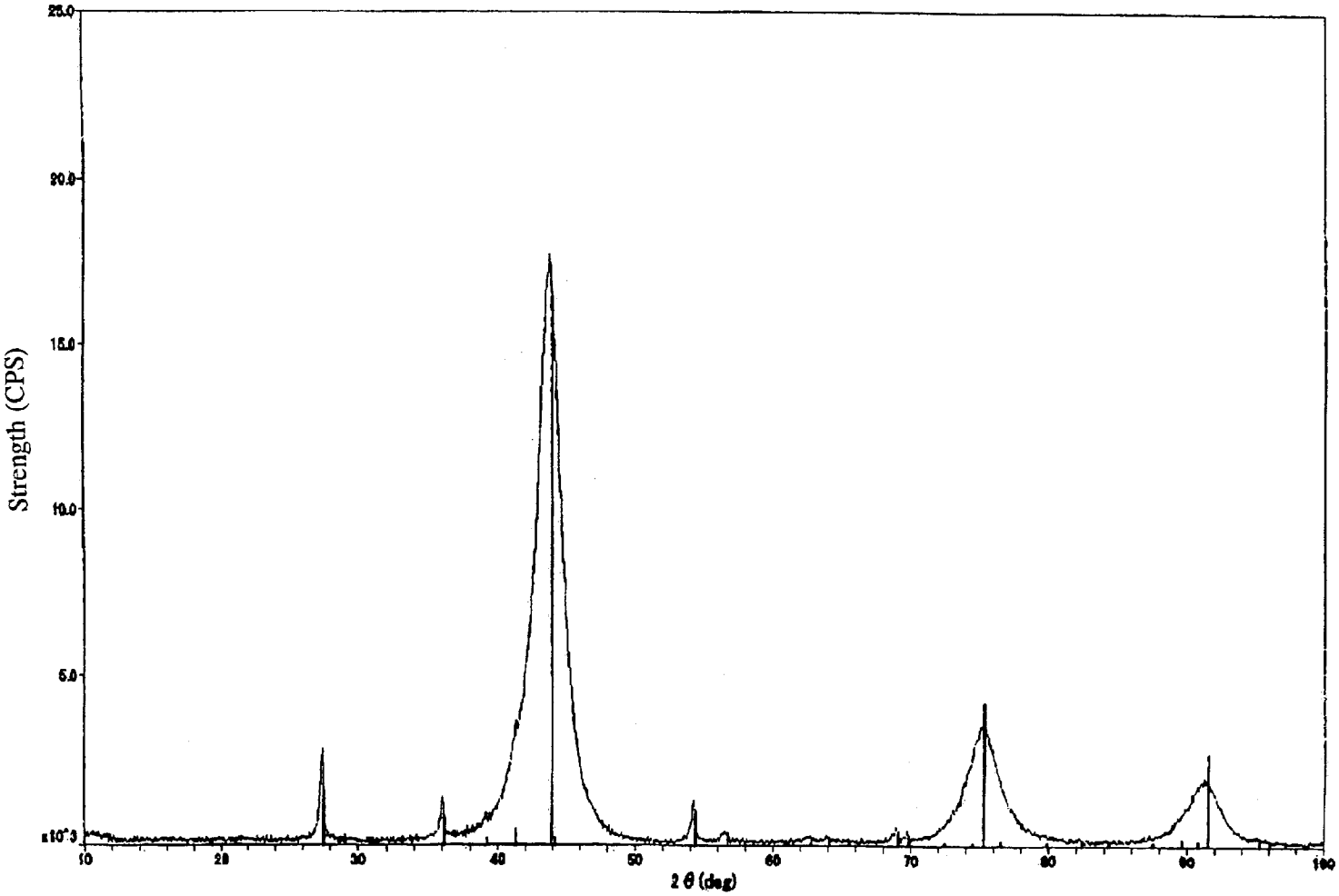
FIG. 10 shows an X ray diffraction chart, in details, of another UDD powder sample of the present invention.

No. 13 of Production Example 5 (Sample having $\alpha$=49%, NUDD-A in FIG. 8), No. 14 of Production Example 5 (Sample having $\alpha$=56%, NUDD-B in FIG. 8), No. 4 of Production Example 1 (Sample $\alpha$=55%, NUDD-C in FIG. 8), No. 5 of Production Example 1 (Sample having $\alpha$=64.9%, NUDD-D in FIG. 8), No. 6 of Production Example 1 (Sample having $\alpha$=74.4%, NUDD-E in FIG. 8), No. 1 of Production Example 1, and No. 8 of Production Example 5 (Sample having $\alpha$=0%, NUDD-F in FIG. 8), and a conventional UDD sample (a dry powder sample, OUDD in FIG. 8) were used. With respect to these seven samples, measurement of a Bragg angle ($2\theta\pm2°$) on an X-ray diffraction (XD) spectrum using Cu—K$\alpha$ radiation was made, whose results are summarized in FIG. 8. Among these samples, FIG. 9 shows the results of sample A, FIG. 10 shows the results of samples B, respectively. It is apparent from the charts as shown in FIGS. 8, 9 and 10 that the UDD samples according to the present invention exhibit a reflective intensity peak pertinent to a (111) crystal structure at a Bragg angle ($2\theta\pm2°$) of 44° at a concentration of 85.0%, a reflective intensity peak pertinent to a (220) crystal structure at a Bragg angle of 73.5° at a concentration of 14.0%, a reflective intensity peak pertinent to a (311) crystal structure at a Bragg angle of 91° at a concentration of 0.2%, a reflective intensity peak pertinent to a (400) crystal structure at a concentration of 0.2%, and a reflective intensity peak pertinent to a (002) graphite crystal at a Bragg angle of 26.5°±2° at 0%, substantially.

As a result of the measurements, it is concluded that a specific pattern showing a presence of a $Sp^3$ bonded carbon at a concentration, thereby indicating that the UDD includes a diamond phase near a graphite phase having a small particle size.

The X ray diffraction graph of the samples containing a UDD having a degree of oxidization of $\alpha$=64.9% according to the present invention shows as follows. Some Lorenz diffraction spectrum peaks have a wide and symmetrical shape, at a Bragg angle of $2\theta$=43.9° pertinent to a (111) crystal structure, at a Bragg angle of $2\theta$=73.5° pertinent to a (220) crystal structure, and at a Bragg angle of $2\theta=95.5°$ pertinent to a (311) crystal structure.

These spectra are reflected by a diamond form having a crystalline lattice parameter of $\alpha=(3.565\pm0.005)\times10^{-10}$ m. Using a Scherrer's equation, a half width value of these spectra curves is calculated into an average particle diameter of the UDD, so as to obtain an average particle diameter of $L=(42\pm2)\times10^{-10}$ m.

Also, there are a biased halo near a Brag angle of $2\theta=17°$. When drawn with a primary beam, the intensity of the scattering is high and stable. The intensive scattering of the primary beam represents a diffraction property based on an amorphous structure. Apparently, the measured halo dose not clearly indicate a diffracted light of the macro structure, however the halo is closely related to the scattering on very small structure such as a molecular size (for example, having a size of graffin or a benzene ring). Such a structure may be a regular chain of carbon atoms or a planar assembly of regular carbon layers as well as a peripheral particle (in diamond structure) smaller than $4\times10^{-9}$ m. By such a halo having a high intensity, as compared with the peak intensity of the (333) crystal structure, there exists a structure having a size of a molecule. It was then assumed from a half width value of the halo according to the Scherrer's equation, that the size of the structure was substantially $1.5\times10^{-9}$ m. Since there are detected smaller particles of the order of $4\times10^{-9}$ m, the amorphous form of diamond and graphite specified in a Raman scattering spectrum may be present.

From the analysis of an X-ray diffraction (XRD) spectrum chart using a source of Cu—Kα ray, it is found that the diamond fine article may have the largest peak at a Bragg angle ($2\theta\pm2°$) of 43.9°, the total intensities of the peaks at other Bragg angles than that of the largest peak being amounted to be 11/89 and 19/81. In other words, the diamond fine particle may have an (111) plane diffraction as high as 81 to 89.

Production Example 4

Figure 11:
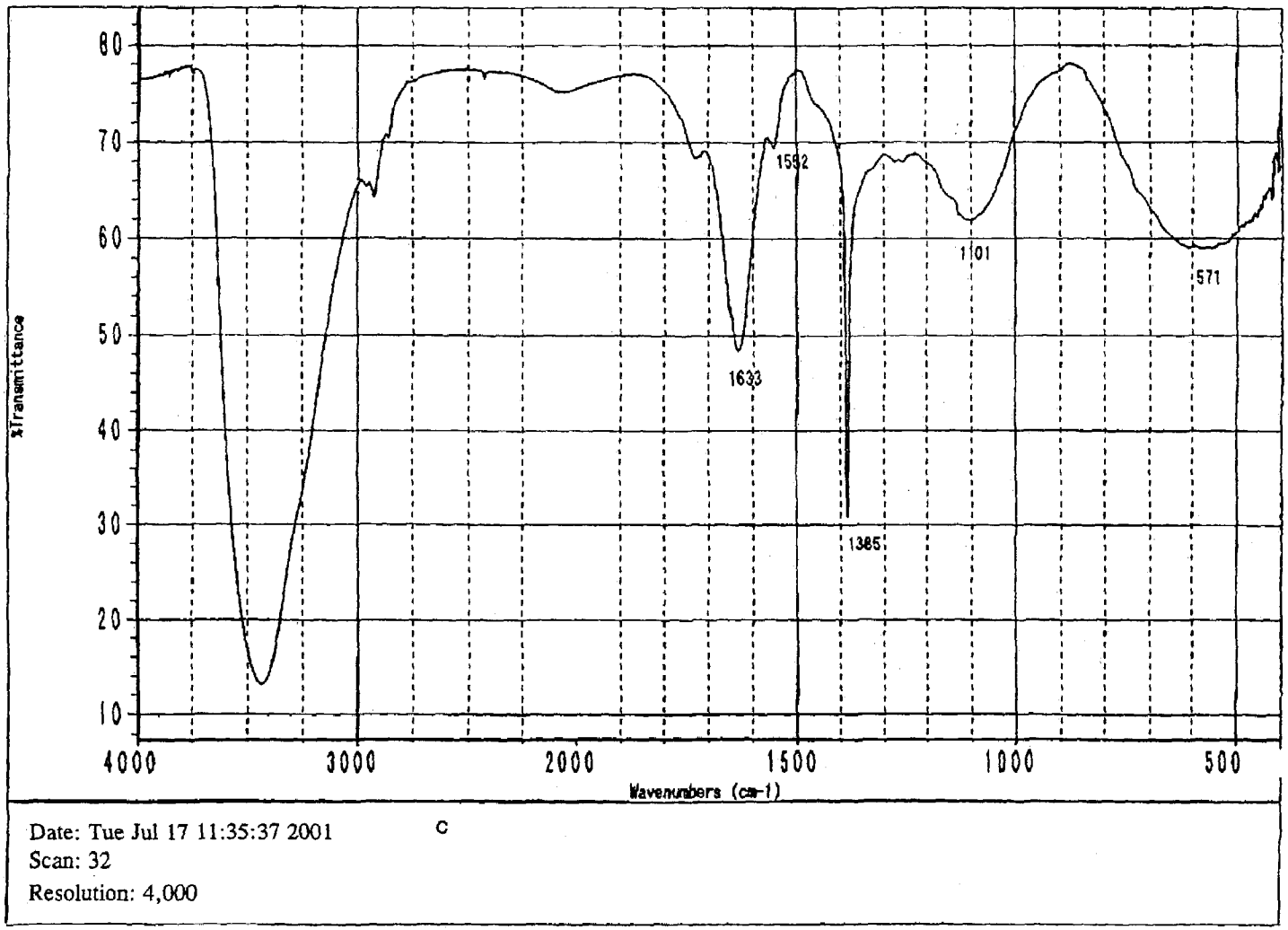
FIG. 11 shows an IR measurement chart of a UDD powder sample of the present invention.
Figure 12:
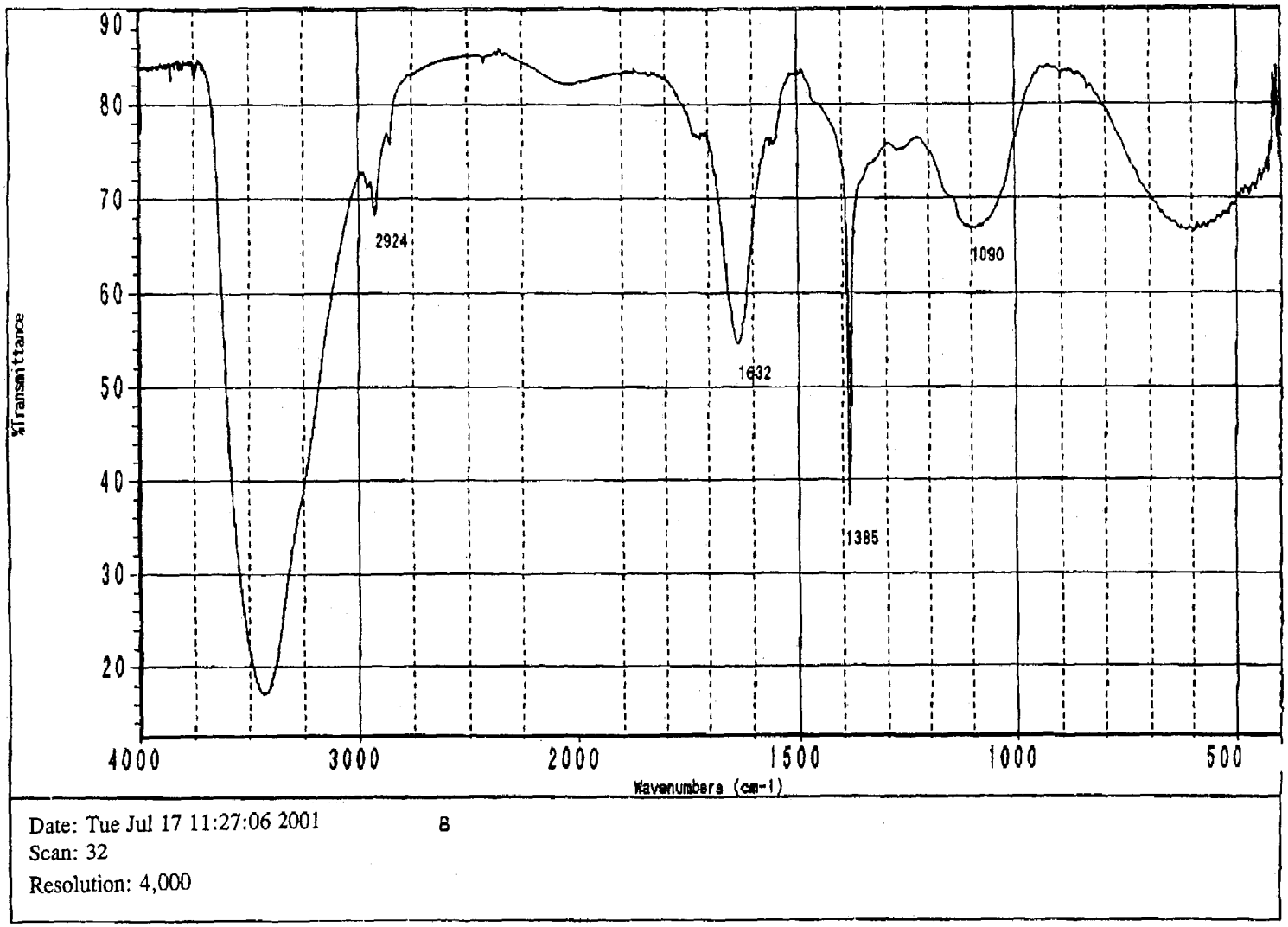
FIG. 12 shows an IR measurement chart of a UDD powder sample of the present invention.
Figure 13:
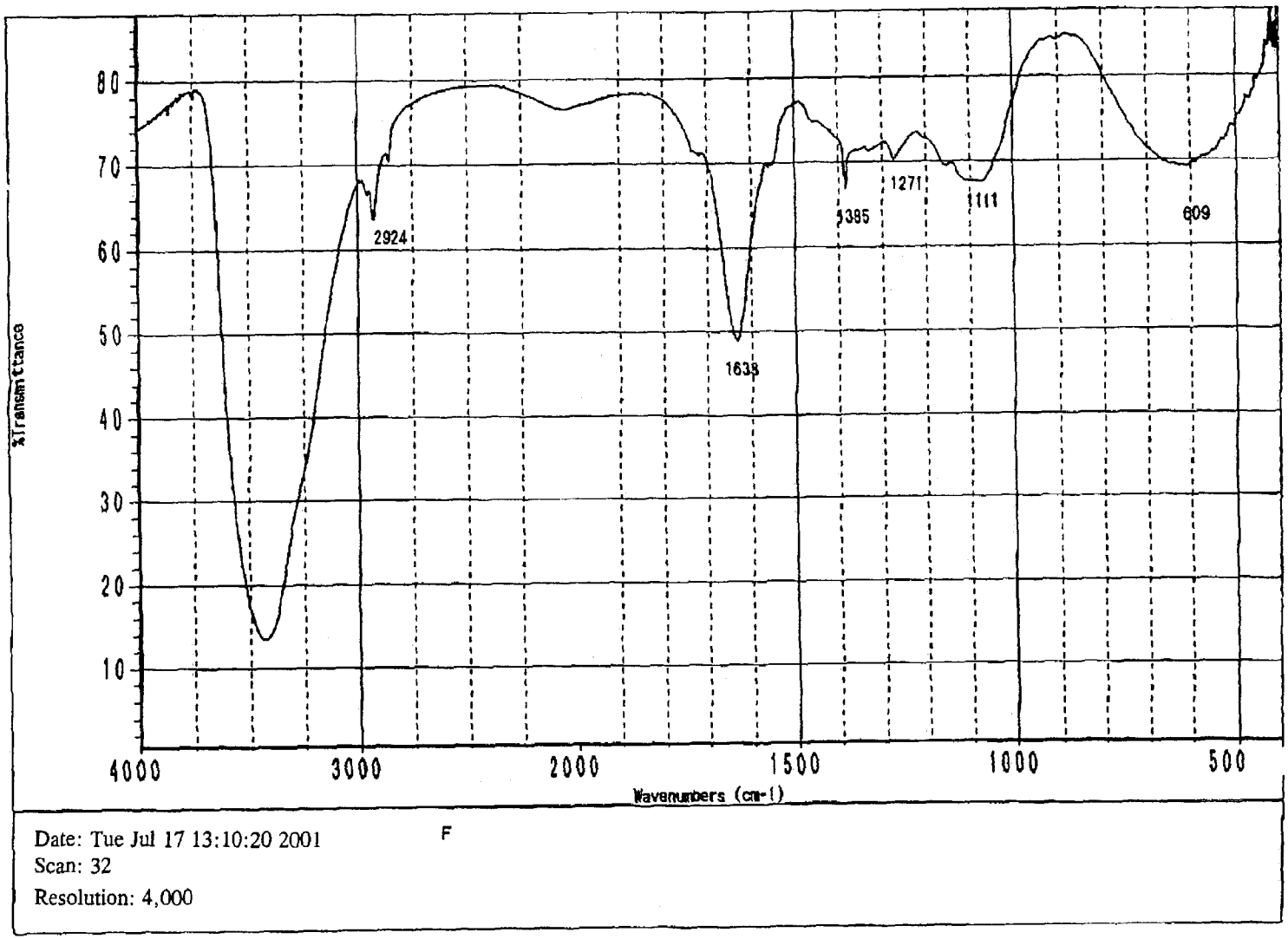
FIG. 13 shows an IR measurement chart of another UDD powder sample of the present invention.
Figure 14:
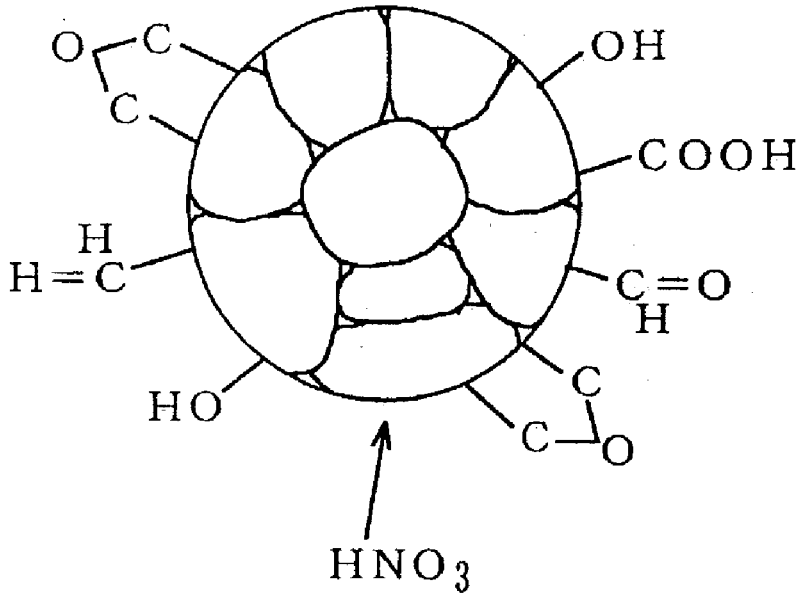
FIG. 14 shows an enlarged illustration of a UDD particle of the present invention.

Similarly, FIGS. 11, 12, and 13 show the results of measurement on the FTIR spectrum based on a KBr crystal,. with respect to three UDD samples, that are, BD samples having $\alpha=64.9\%$, $\alpha=74.4\%$, and $\alpha=75.6\%$, as Production Example 1 as shown in Table 2. (Dolmatov report p. 30, 1 23, Ref. [27]) The charts in FIGS. 11, 12, and 13 show that in case of a UDD sample not sufficiently purified, there detects an absorption pertinent to a carbonyl group which is widely biased in a range of 1730 to 1790 $cm^{-1}$ with being influenced by many other groups existing on the surface of the sample. Also, an absorptions at 1640 $cm^{-1}$ and 3400 $cm^{-1}$ pertinent to hydroxy group which are shifted forward or backward with being influenced by many other groups existing on the surface thereof, as shown in FIGS. 11, 12, and 13. An absorption at a wavelength of 1640 $cm^{-1}$ is affected by a bonded water and a free water. An absorption at a wavelength of 1750 $cm^{-1}$ is related to a vibration of an OH group. A broad absorption at a wavelength in a range of 1100 to 1140 $cm^{-1}$ is considered to be an combination of an impurity nitro group, and a vibration pertinent to a ≡C—O—C≡ group. From the view of its intensity of absorption, it is appropriately understood that there exists not only a nitro group (which originally has an absorption at a wavelength of 1540 $cm^{-1}$ and 1330 $cm^{-1}$), but also a ≡C—O—C≡ group. Originally, an absorption band pertinent to a carbonyl group at a wavelength of 1730 to 1790 $cm^{-1}$ includes an absorption at a wavelength of 1750 $cm^{-1}$ pertinent to a R—COOΦ group, an absorption at a wavelength of 1740 $cm^{-1}$ pertinent to a —RCOOR' (ester or lactone) group, or a —RCOOH group (carboxyl group), an absorption at a wavelength of 1710 $cm^{-1}$, originally, pertinent to a ═C═O group. Also, an absorption at a wavelength of 680 $cm^{-1}$, originally, pertinent to a —CO.N group may be possibly included therein.

As apparent from the results as mentioned above, the UDD preferably used in the present invention has a carbonyl group having an intensity and location of its absorption, which is remarkably affected by a denaturing treatment condition of the UDD. When it is heated at a temperature of 700° C. under an atmosphere of nitrogen gas, both the carbonyl group and the carboxyl group are decomposed so as to decrease an intensity of the corresponding absorption band. Also, after the UDD is heated at a temperature of 673° K, an absorption at a wavelength of 1730 $cm^{-1}$ is shifted to an absorption at a wavelength of 1780 to 1790 $cm^{-1}$, thus finding that a O═C—O—C═O structure is formed.

As being apparent from the results, the UDD of the present invention is subjected to a nitric acid treatment, thereby shifting its original absorption to a biased absorption with a specific pattern, as shown in Table 4.

TABLE 4

| IR - spectrum of UDD | |
|---|---|
| 3500 $cm^{-1}$ | An intensive wide band |
| 1740 $cm^{-1}$ | A band of mean intensity |
| 1640 $cm^{-1}$ | A band of mean intensity |
| 1260 $cm^{-1}$ | An intensive wide band |
| 1170 $cm^{-1}$ | An intensive wide band |
| 610 $cm^{-1}$ | A wide band of mean intensity |

Among these absorptions, the UDD fine particle has the largest absorption band at a wavelength of around 3500 $cm^{-1}$. The UDD fine particle also has an absorption band at a wavelength of around 1740 $cm^{-1}$ smaller than an absorption band at a wavelength of around 1640 $cm^{-1}$ comprising a plural of absorption bands being complex and flat at top. The absorption band at a wavelength of around 1640 $cm^{-1}$ is the second largest. The absorption band at a wavelength of around 1170 $cm^{-1}$ is the third largest, and its profile has at least two small peaks at a longer wavelength side and at least two shoulders moderately sloping down. The UDD fine particle also has an absorption band at a wavelength of around 610 $cm^{-1}$, which has a complex and broad profile with a medium intensity.

Further, the UDD fine particle of the present invention has small peaks or at least shoulders at a wavelength of 2940 $cm^{-1}$ (which is pertinent to a C—H saturation), 1505 $cm^{-1}$, 1390 $cm^{-1}$, and 650 $cm^{-1}$.

As being apparent from the result, the UDD fine particle of the present invention, as shown in FIG. 11, is covered with many active functional groups such as —COOH, —C—O—C—, —CHO, and —OH groups and the like.

Production Example 5

Similar samples were prepared to Production Example 1 except the degree of oxidation as shown in table5. The following samples were prepared: Sample No. 8 having $\alpha=0.0\%$, Sample No. 9 having $\alpha=17\%$, Sample No. 10 having $\alpha=28\%$, Sample No. 11 having $\alpha=32\%$, Sample No. 12 having $\alpha=48\%$, Sample No. 13 having $\alpha=49\%$, Sample No. 14 having $\alpha=56\%$, Sample No. 15 having $\alpha=63\%$, Sample No. 16 having $\alpha=81\%$ as a comparative example No. 1, Sample No. 17 having $\alpha=85\%$ as a comparative example No. 2, Sample No. 18 having α=94% as a comparative example No. 3, and Sample No. 19 having α=98% as a comparative example No. 4. With respect to these samples, their surface characteristics in connection with the degrees of oxidative decomposition and oxidative etching were examined, Results are shown in Table 5.

TABLE 5

| No. of sample | Fraction of total mass of oxidizable carbon (%) | Degree of oxidative decomposition (α) | Specific surface ($10^3 \times m^2/kg$) | Limit volume of sorption space ($m^3/kg$) | Size of space ($10^{-9}$ m) | Size of critical pores ($10^{-9}$ m) |
|---|---|---|---|---|---|---|
| No. 8 | 53.4 (DB) | 0 | 404 | 1.2451 | 9.1 | 8.8 |
| No. 9 | 44.4 | 0.17 | 409 | 1.0746 | 8.1 | 8.0 |
| No. 10 | 38.4 | 0.28 | 399 | 0.9931 | 7.7 | 7.9 |
| No. 11 | 36.3 | 0.32 | 314 | 0.7488 | 7.5 | 7.6 |
| No. 12 | 27.8 | 0.48 | 244 | 0.6621 | 8.6 | 6.8 |
| No. 13 | 27.6 | 0.49 | 209 | 0.5406 | 8.7 | 8.8 |
| No. 14 | 23.7 | 0.56 | 198 | 0.5236 | 9.1 | 9.1 |
| No. 15 | 19.5 | 0.63 | 195 | 0.5089 | 9.5 | 9.3 |
| No. 16 (Comparative 1) | 9.9 | 0.81 | 240 | — | — | — |
| No. 17 (Comparative 2) | 7.9 | 0.86 | 252 | — | — | — |
| No. 18 (Comparative 3) | 3.4 | 0.94 | 276 | 0.8241 | 9.8 | 9.6 |
| No. 19 (Comparative 4) | 1.2 | 0.98 | 290 | 0.8396 | 9.2 | 9.2 |

1) Limit volume of sorption space ($m^3/kg$) is presented by $(p/p_3) = 0.995$ (Where p is degree of filled up surface of inner pores by $N_2$. $P_3$ is limit pressure of $N_2$ gas to create mono layer of Nitrogen.)
2) Size of critical pores is the maximum size of pores by which atoms of adsorbing gas are able to pass into adsorbent (UDD).

This table shows that an absorption property of a UDD does not always depend on a size of a pore, and a limited pore size. Also, this table shows that the absorption property of a UDD depends on an activity ratio and a highly activated area of all of the UDD surface.

Conventionally, a surface activity of a UDD has been studies and reported in G P. Bogatiryonva, M. N. Voloshin, M. A. Mirinich, V. G. Malogolovets, V. L. Gvyazdovskaya, V. S. Gavrilova, Sverhtvjordii Materiali, No. 6, page 42 (1999), "Surface and electro-physical properties of dynamic synthesis nano-diamond." For just purposes of comparison and reference, the disclosure is summarized in Table 6.

TABLE 6

| Sample Unburnt residuum (%) | Specific magnetic susceptibility (X) ($m^3/kg$) | Specific surface (S sp) ($10^2 \times m^2/kg$) | Adsorption potential (A) ($10^3$ J/kg) | Specific adsorption potential (A') ($J/m^2$) |
|---|---|---|---|---|
| UDD a 0.75 (Comparative Example 5) | $\sim 0.35 \cdot 10^{-8}$ | 167 | 400 | 2.4 |
| UDD b 1.16 (Comparative Example 6) | 0 | 162 | 550 | 3.4 |

1) Susceptibility (X) were determined by the technique of V. N. Bakul Institute of superhard materials.
2) Specific surface (S sp), adsorption potential (A) and specific adsorption potential (A') were isotherms of low temperature adsorption of nitrogen gas by mean of the instrument "Akusorb-2100" and calculated therefrom.

From the results in Tables 5 and 6, an amount of adsorption and desorption of a nitrogen gas measured by means of a BET method shows the UDD Samples of the present invention having an oxidation degree lower than 81% are sufficiently developed in an activity and has a specific surface area of $4.5 \times 10^5$ $m^2/kg$ at maximum, compared with conventional samples (Comparison Examples). Also, it is found that the UDD Samples of the present invention have a large content of a surface carbon ($C_{surface}/C_{total}$), and, the surface carbon $C_{surface}$ has functional groups at a concentration of almost 100%. In general, a conventional synthetic diamond has a rate of carbon atoms bonded to hetero atoms to the total carbon atoms of as much as 15%.

Production Example 6

Also, the samples of the UDD fine particle or the present invention were subjected to thermal differential analysis under an atmosphere of an air and inert gas. Results are shown as follow.

Namely, in case of heating it at a heating rate of 10° K per minute in an air, every sample started oxidization at a temperature of 703° K. On the other hand, an article discloses that, in case of three different samples synthesized by a conventional static conversion, they start oxidation at a temperatures of 863° K, 843° K, and 823° K, respectively. Accordingly, the UDD of the present invention has a higher oxidation activity compared with the conventional ones.

When being heated to 1273° K under a neutral atmosphere, one of the samples of the present invention exhibited a weight loss of 3 to 4%. The same sample, when being heated between 443° K and 753° K under a carbon dioxide gas, increased its weight by 5%, and when being heated to a higher temperature than that, its weight was decreased. This sample, when being heated under an atmosphere of hydrogen gas, generated to separate a HCN gas. The same UDD sample was then subjected to a composite thermal differential analysis.

As a result, a thermograph curve having the three features (a) to (c) below is obtained.

(a) The weight loss was 5 to 7% when being heated at a temperature of 373 to 383° K (Two samples having α=63% and α=27%). This reaction is reversible. As the resultant gas product was measured at the same temperature, it included nitrogen gas at a content of 97 to 98%. It may be considered that a gas absorbed from an air is now desorbed.

(b) The UDD sample lost its weight at a temperature of 523° K, which accompanied with heat absorption.

(c) The weight loss at a range from 753° K to 1023° K, with heat generation. Particularly, the weight loss was remarkable (up to 95%) at a temperature of 753 to 773° K, with large amount of heat generation, which lasted until a temperature of 1023 to 1053° K, and at a higher temperature than that, no change was observed. Non-combustible residue was then measured by a known manner and its amount was corresponding to 10% of the initial weight of the Sample. It is considered that in a temperature of 773° K to 1023° K, a strong oxidization of carbon was made, to finally leave a non-combustible residue. During the oxidization, an intensive grows were observed.

Production Example 7

Then, Samples Nos. 9, 10, 11 and 12 were raising at a heating rate of 10° K per a minute under a carbon dioxide atmosphere, and heated at a temperature of 1273° K. Then, their weight and specific surface area were examined, similar to Production Example 5. The weight measurement exhibited no particular increase or decrease. (In details, Sample No. 9 decreased its weight by 0.25%, Sample 10 increased its weight by 0.22%, Sample 11 decreased its weight by 0.15%, and Sample 12 increased its weight by 0.22%). Also, the specific surface area of the samples are substantially unchanged. It is considered that these results show that a condensed body of carbon atoms in a pore is in a stable non-graphite form, and a hydrophilic group as an electron donor, such as a hydroxy, carboxy, carbonyl, and aldehyde groups were remained, nor lost by the heating.

Production Example 8

Seven samples were examined for determining a profile of a particle size. The sample used are as follows: Sample 13 of Production Example 5 (a sample having α=49%, shown as Sample AS), Sample 14 of Production Example 5 (a sample having α=56%, shown as Sample BS), Sample 4 of Production Example 1 (a sample having α=55%, shown as Sample CS), Sample 5 of Production Example 1 (a sample having α=64.9%, shown as Sample DS in FIG. 18), Sample 6 of Production Example 1 (a sample having α=74.4%, shown as Sample ES), Sample No. 1 of Production Example 1 and Sample 8 of Production Example 5 (a sample having α=0%, shown as Sample FS), and a conventional UDD sample (a dry powder sample, shown as Sample GS).

Figure 15:
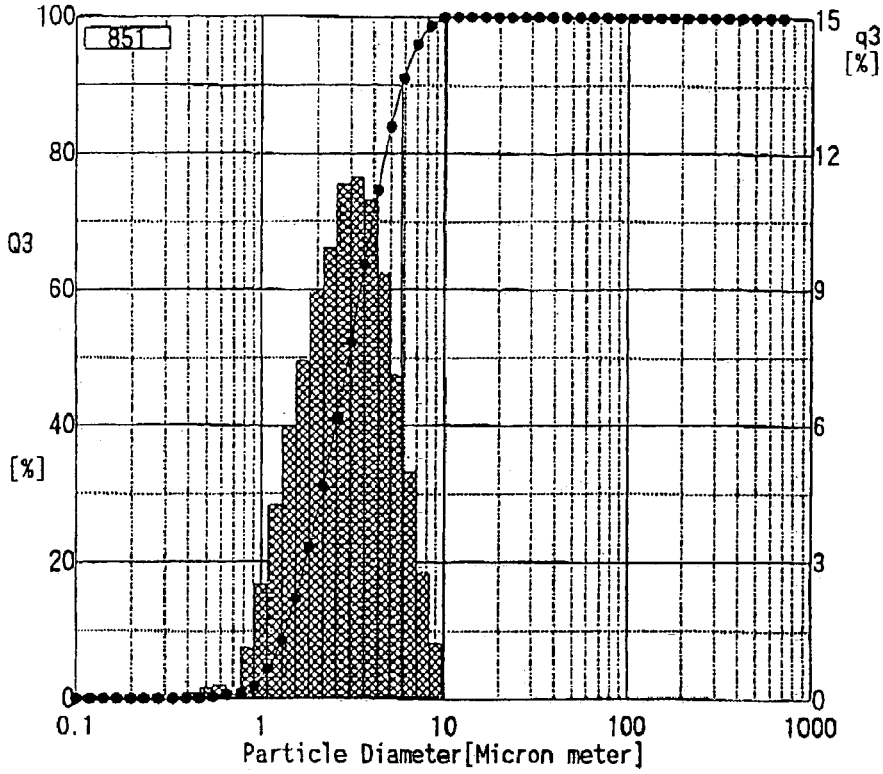
FIG. 15 shows a graph showing a measurement result of a particle size distribution, with respect to a UDD powder sample of the present invention.
Figure 16:
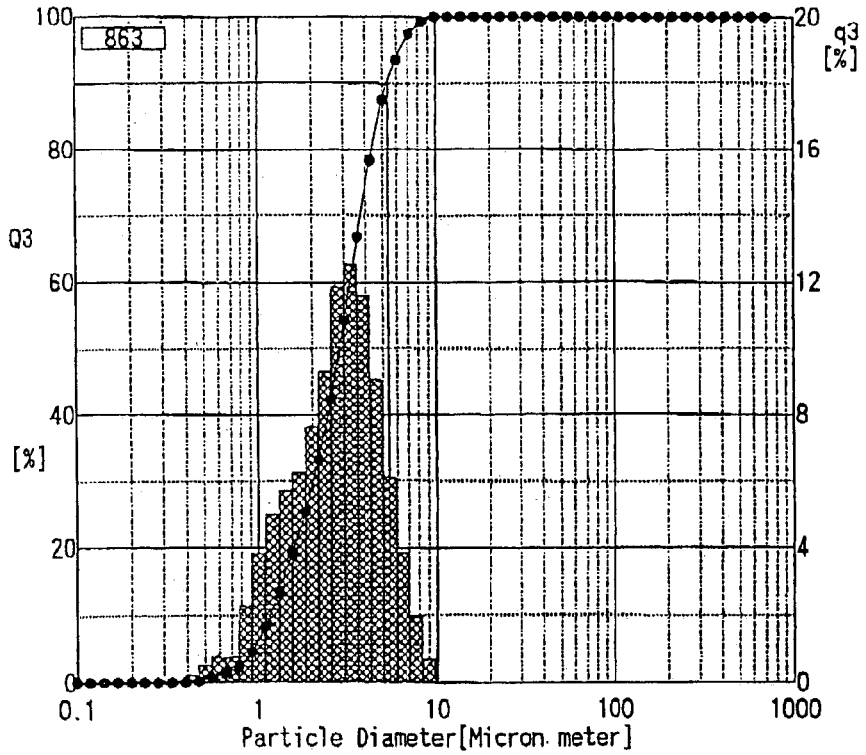
FIG. 16 shows a graph showing a measurement result of a particle size distribution, with respect to another UDD powder sample of the present invention.
Figure 17:
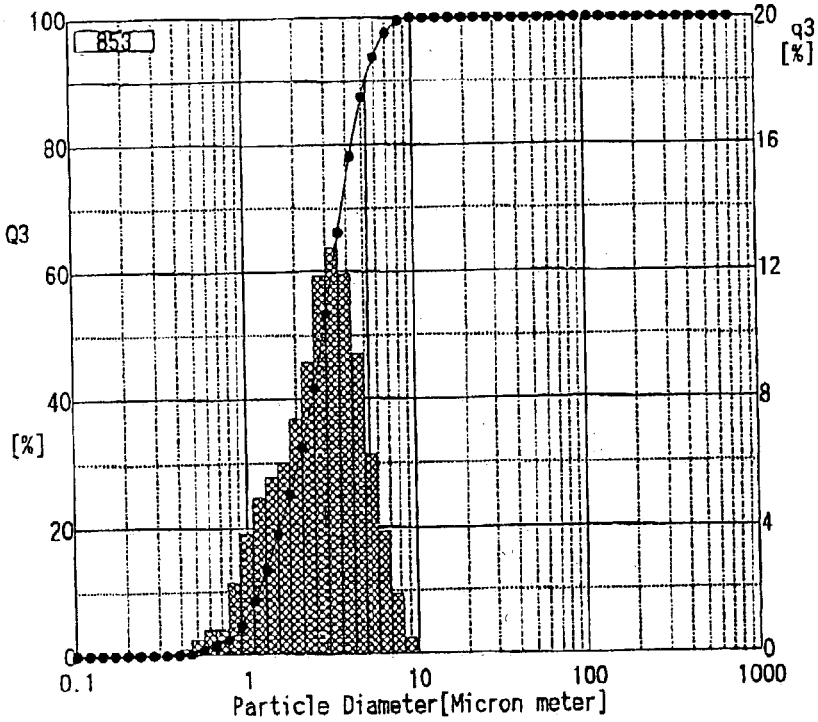
FIG. 17 shows a graph showing a measurement result of a particle size distribution, with respect to another UDD powder sample of the present invention.
Figure 18:
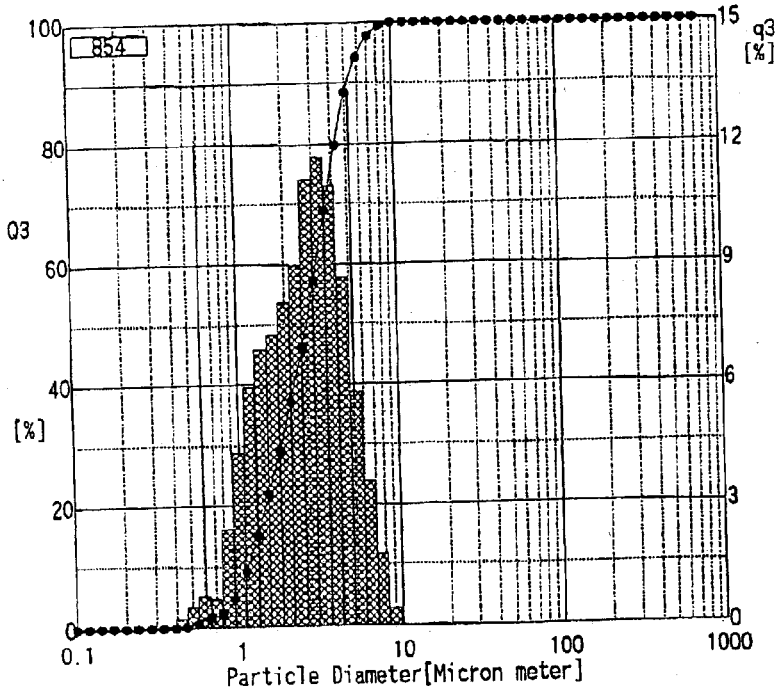
FIG. 18 shows a graph showing a measurement result of a particle size distribution, with respect to another UDD powder sample of the present invention.
Figure 19:
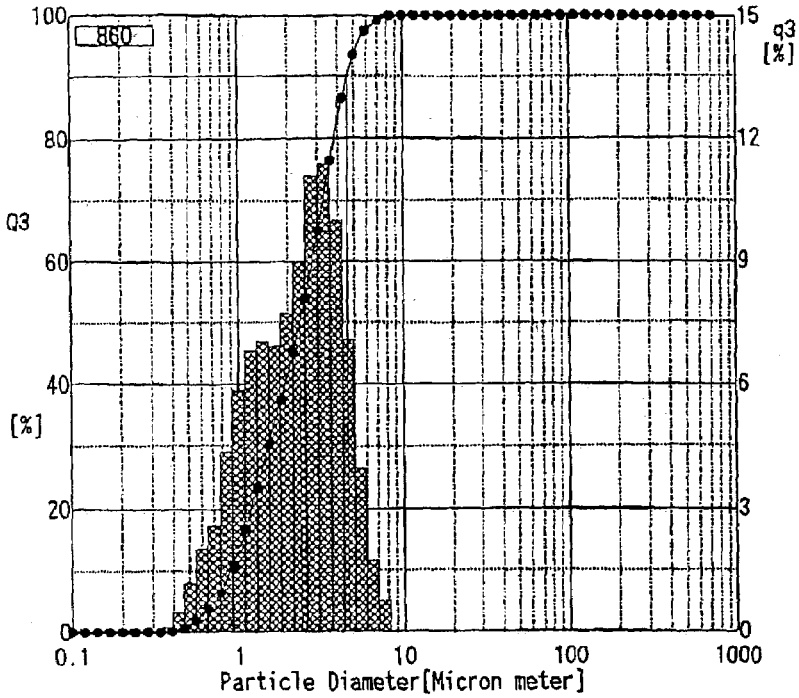
FIG. 19 shows a graph showing a measurement result of a particle size distribution, with respect to another UDD powder sample of the present invention.
Figure 20:
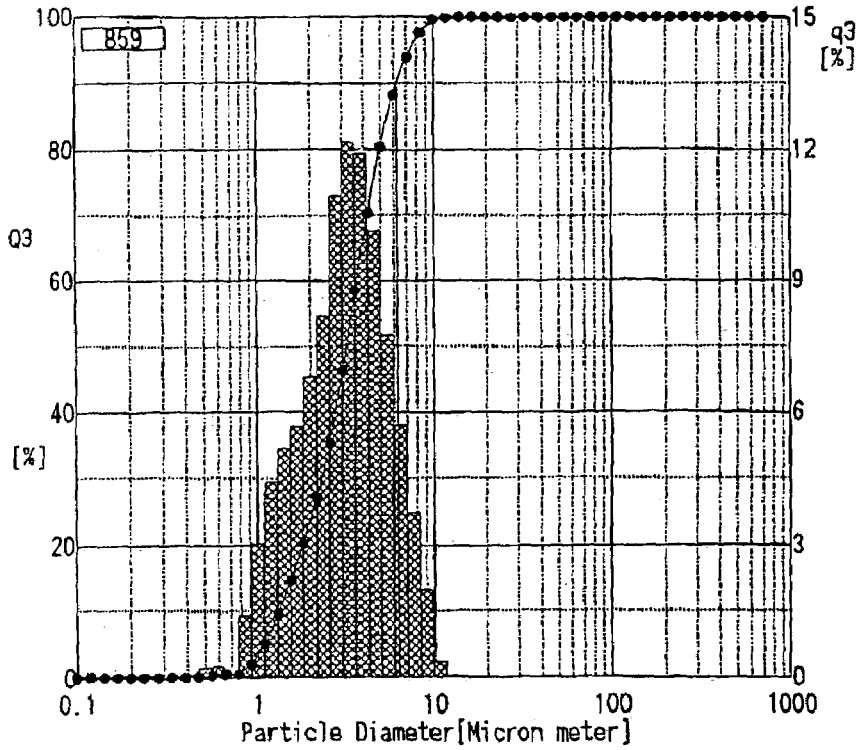
FIG. 20 shows a graph showing a measurement result regarding a particle size distribution of a crude diamond, which is in a condition of incomplete oxidation, prepared by means of an explosion method.
Figure 21:
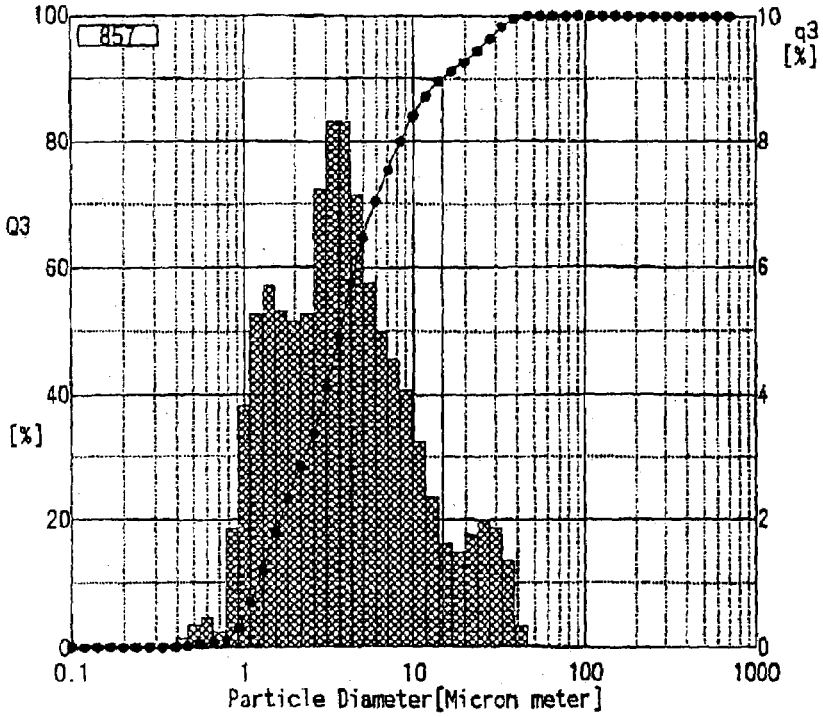
FIG. 21 shows a graph showing a measurement result regarding a particle size distribution, with respect to of a conventional UDD powder sample.

The resultant profiles of Samples AS to GS are shown in FIG. 15 (as to Sample AS), FIG. 16 (as to Sample BS), FIG. 17 (as to Sample CS), FIG. 18 (as to Sample DS), FIG. 19 (as to Sample ES), FIG. 20 (as to Sample FS), and FIG. 21 (as to Sample GS).

The result shows that a conventional UDD sample (Sample GS) and a non-oxidized UDD powder (Sample FS) have included large particles having a particle size of 10000 nm or more, having a broad particle distribution. On the other hand, samples of the present invention (Samples AS, BS, CS, DS, and ES) have included no large particles having a particle size of 10000 nm, having a narrow particle size distribution.

Production Example 9

On the other hand, a wet UDD of the present invention may lose water substantially, when it is heated at a temperature of 403 to 433° K. At a higher temperature than that, the parameter's changes are similar to those of the dried samples. In case of being heated at a temperature of 383 to 393° K under an inert gas (He) atmosphere, the wet UDD started desorbing nitrogen which was absorbed from the air. At a range of 673° K to 1173° K, a weight loss was found by about 10%, with heat generation. Thereafter, carbon dioxide and nitrogen were desorbed (at a mole ratio of 4:1), accompanying with a morphology change of the UDD. At a temperature of 1153° K to 1163° K, no change was observed, with very slight heat absorption. This process was proceeded with, without any change in the structure and color of the UDD. On the other hand, an article discloses data that functional groups are completely eliminated from the surface thereof when it is subjected to an annealing treatment under an inert gas atmosphere.

Production Example 10

Consideration as to Volumetric Ratio of Structure Defects

A volumetric examination as to structural defects in a UDD of the present invention was made.

With regard to all crystal states considered as a diamond structure in a wide meaning based on the aforementioned IR analysis shown in Production Example 4, a volumetric ratio as to structural defects was examined by mean of a positron-electron annihilation method.

The UDD samples were prepared by a shock conversion process in water from TNT/RDT alloys containing 5 to 70% by weight of a highly dispersible RDX.

For the purpose of determining a concentration, volume, and dispersion state of the structural defects of the UDD samples generated in a sintering process, a carbon/hydrogen ratio in the explosive, a diameter of an imposed shock wave (condition at a high pressure and at a high temperature), and a cured extent were varied. After chemical purification, the crystal structure of obtained UDD was measured by means of a positron-electron annihilation method, so as to determine a volumetric ratio of the structural defects. Also, a specific area of the UDD was measured by means of nitrogen absorption at a low temperature.

Also, for the purpose of studying the sintering process of the UDD having a volume ((3.05 to 3.10)×$10^3$ kg/$m^3$) showing a maximum density of the structural defects, an average diameter ((1.5 to 2.0)×$10^{-9}$ m) and a maximum dispersibility (specific surface area of 4.2×$10^5$ $m^2$/kg) of the UDD, based on the UDD by means of a coherent dispersion method, were selected. The UDD powder was sintered at a pressure of 4 to 12 GPa, to obtain a polycrystalline powder condensate, whose macro hardness and compression fracture strength were measured.

In the detonation of a carbon-contained explosive, the densities of vacancy defects of cluster and pores were increased in proportion with the increase of carbon content and the increase of the detonating temperature. There were peak points in curve lines showing a maximum density of vacancy defects of cluster and maximum pores, after passing through the peak points, the density of vacancy defects of cluster and density of pores were began to decrease. The peak was at substantially 3900° K, and concentration of sub-micro pores having a diameter of (1 to 2)×$10^{-9}$ m was increased to the maximum. A trap center which traps an electron to disappear was total of the defects. Each defect was eventually core of a sub-micro pore. Such a site of positronium in the UDD was not located in the inside of diamond but formed in the inner surface of a sub-micro pore and thus it was constituted by the defect.

When the volume of the sub-micro pores in the UDD prepared from TNT was decreased and the structural defects were decreased (to the density $3.3\times10^3$ kg/m$^3$), the quality of the UDD approached to that of a diamond prepared by a static conversion method. A result of an IR spectra with respect to a conventional UDD power is consistent with this phenomenon.

The generation of structural defects in the UDD of the present invention may be explained by the following hypothesis (which is shown for only the purpose of description and not intended to limit the scope of the present invention).

Namely, the formation process by detonation of a carbon-containing explosive can be represented as the results of unbalanced phase transitions, involving: (1) by a carbon-containing explosive, occurring of a primary plasma-like dense state which is characterized by a high density of ions, free electrons, excited particles, the simplest radicals et al.; (2) occurring a plasma-like dense state, a state of primary small carbon clusters containing hydrogen; (3) occurring a state of primary cluster, a ultradispersed diamonds phase. All of the transitions produced within $10^{-8}$ to $10^{-9}$ second, just when an electronic subsystem of particles is excited, that creates additional conditions for ultra high-speed formation of diamond phase according to new mechanisms. Then, both in the zone of chemical transformation of explosives and outside it, in the zone of high pressure and temperature, there are slower diffusion processes of coalescence, recrystallization and growing of cores of diamond phase, splitting out and diffusion of hydrogen, formation of vacancies, their accumulation to vacancy clusters and submicropores. This is a slow-speed stage closing formation of crystalline structure of UDD, it proceeds for $10^{-6}$ second and more being interrupted by hardening of the powder.

Production Example 11

The magnetic properties of UDD samples of the present invention were compared with those of a conventional diamond synthesized by means of a static conversion method.

In general, a diamond is a diamagnetic material having a constant value of magnetic susceptibility of $\chi=-0.62\times10^{-8}$ m$^3$/kg. However, the UDD of the present invention has a different magnetic susceptibility value from the value as mentioned here. A powder material has a specific magnetic susceptibility, which is a quantitative property of all the volume of the powder, and which is an additivity strength of a specific magnetic susceptibilities ($\chi$) of all the components composed of the powder. Table 7 shows a magnetic susceptibility of an impurity in a UDD as a sample of the present invention.

TABLE 7

Magnetic susceptibility of impurities in UDD

| Component name | UDD Samples | Static synthesis Diamond | Approximate value of magnetic susceptibility ($x_1$) ($x_1 = \times 10^{-8}$ m$^3$/kg) |
|---|---|---|---|
| Diamond | + | + | −(0.1~0.5) |
| Metal | Traces | + | $10^3$~$10^4$ |
| Graphite | + | + | −(8.2~0.1) |
| Carbon materials | + | | −(2.0~0.1) |
| Gelatine | | + | −(0.5~0.9) |
| Silicon | + | + | |

According to the present invention, a UDD sample subjected to heating at a temperature of 573° K has a conductivity as low as about $10^{12}$ Ω•m, which is decreased into a range of $6.0\times10^{10}$ to $2.0\times10^{11}$ Ω•m when it is continued to be heated. The UDD has a decreased conductivity of $2.3\times10^4$ Ω•m when it is heated up to 1173° K in a carbon dioxide. The temperature is considered to a critical point to start changing it into a graphite form.

The dielectric constant or permeability of the UDD sample was 2.4 to 2.7 at $E^{0.1}$, 1.7 to 2.0 at $E_{1.0}$, and 1.7 to 2.0 at $E_{1.5}$, while the high-frequency dielectric loss (tan δ) was ranged of $0.5\times10^{-3}$ to $1.0\times10^{-2}$, approximately.

As described above, the UDD of the present invention is distinct from a well known synthesized diamond in view of various properties. Also, compared with a conventional diamond prepared by means of an explosion method, the UDD of the present invention has a carbon diamond-like phase stable in physical and chemical properties in a neutral or a reducing atmosphere, in spite of a higher reactivity.

According to the present invention, the UDD formed in a compact tablet has a specific resistance of $10^6$ Ω•m to $10^7$ Ω•m at a room temperature. When a UDD gets wet, it has a remarkably decreased specific resistance. When a UDD has a water content of 5%, the UDD has a specific resistance less than $10^3$ Ω•m. However, if it has an increased water content, the specific resistance of the UDD is not changed, so that the UDD has a limited or saturated point of 5% of water content in view of a specific resistance. Also, the water content of 5% will be a fundamental level for developing a method of measuring a remaining water content in a UDD.

One of important properties as to a diamond surface is an electrokinetic potential or an interface potential (ζ potential or zeta potential) value. Taking it into consideration that ζ potential value considerably depends on a condition of a nanometer diamond surface, if there is a difference in ζ potential values of two UDDs which has a same quality, both of the UDDs are considered to be prepared by means of different purification processes or different denaturing processes, each other.

Determination of ζ potential values of UDD can be carried out by an electrophoretic method based on a directed movement of a particle in a dispersed medium relative to a liquid phase under a current effect, as disclosed in S. I. Chuhaeva et al. (S. I. Chuhaeva, P. Ya. Detkov, A. P. Tkachenko, A. D. Toropov, [Physical chemistry properties of fractions isolated from ultra-dispersed diamonds (nanometer diamonds)], and Sverhtvjordii Materiali, Vol. 42, pp. 29 (1998). They disclose ζ potential is measured from three separated layers, that is, a precipitated layer, an intermediate layer, and a suspension layer, of a concentrated UDD suspension synthesized by Russian Federal Nuclear Center. They also disclose ζ potential was $+16\times10^{-3}$ V at the precipitation, $+32\times10^3$ V at the intermediate layer, and $+39\times10^{-3}$ V at the suspension layer. Also, a study of IR-spectra of isolated fractions shows that in specimens there are practically ones and the same functional groups, however, the fractions are differed in their content.

Chuheaeva et al. disclose and report a measured ζ potential with respect to a UDD sample, UDD-TAH (TU 05121441-275-95, a concentrated UDD aqueous suspension solution) prepared by JSC Diamond Center in Sankt-Peterburg.

Table 8 shows details of the respective portions into the three layers.

TABLE 8

Basic physical-chemical characteristics of isolated UDD-fractions

| Characteristic | Values for fractions 1 (precipitated) | 2 (intermediate) | 3 (suspended) |
|---|---|---|---|
| 1. Appearance | Light-grey scattering powder | Grey powder | Black filiform crystal-like formations |
| 2. Pycnometric density ($10^3$ kg/m$^3$) | 3.3 | 3.2 | 3.1 |
| 3. Unburnt residuum (wt. %) | 1.6 | 1.3 | 0.9 |
| 4. Oxidizable carbon (wt. %) | 1.0 | 1.5 | 1.9 |
| 5. Viscosity of aqueous suspension with concentration of UDD of 10 kg/m$^3$ at 293° K. (mPa sec) | 1.04 | 1.07 | 1.12 |
| 6. Viscosity of aqueous suspension with concentration of UDD of 60 kg/m$^3$ at 293° K. (mPa sec) | 1.32 | 1.63 | 5.15 |
| 7. Electrokinetic potential ($10^{-3}$ V) | +16 | +32 | +39 |

There is a report as shown in Table 8 by V. L. Kuznetsov, A. L. Chuvilin, Yu. V. Butenkov, I. Yu. Malkov, A. K. Gutakovskii, S. V. Stankus, and R. Kharulin (*Mat. Res. Soc. Symp. Proc.* 396, page 105, 1995). Conventionally, it is known that three fractions of UDD suspensions, which are layer-separated, have different properties each other. This is considered due to a difference of a sinking rate based on a composition of the UDD and a particle diameter of the UDD particle. However, it has been unknown how a functional group located on a surface of a UDD affects its property.

Production Example 12

In the present invention, a sample of a UDD suspension solution preferably used in the present invention was purified by means of an ion exchange resin, and then, measurement of ζ potential value was made triplicate at a temperature of 297 to 298° K. A measurement result of ζ potential value was (32 to 34)×$10^{-3}$ V. For comparison, measurement of ζ potential value was made with respect to a conventional UDD suspension solution prepared by means of a conventional explosion method. (This UDD suspension solution is not divided into three fractions.) The result was (25 to 26)×$10^{-3}$ V.

A conventional procedure for separating layers comprises a simply stirring a suspension solution, so as to divide it into fractions of a specific liquid and a precipitation. This separation is based on a composition and a particle size of the suspension solution. In case of a UDD preferably used in the present invention, it is not an appropriate procedure to separate it into fractions, since it is highly dispersed in a colloid, especially based on gravity of the UDD suspension solution. The minimum particle size of aggregation obtained from a UDD suspension solution of the present invention was 3×$10^{-7}$ m. A very fine particle was separated by an appropriate decantation. This fine fraction may be easily aggregated when it is dried, and this aggregation may be difficult to divide it.

Also, a nanometer diamond may highly absorb organic solvent, and therefore, the use of an organic solvent is not preferable. On the other hand, a UDD of the present invention, when it is dried into a powder, may be again made into a suspension solution by using a ultrasonic dispersing technique. The obtained suspension solution remains its dispersibility for one month or more during self storage.

A UDD of the present invention has a typical set of functional groups, regardless of difference in quality of a UDD. Such a typical set of functional groups remains constant until the diamond structure itself is broken up. The set comprises polar functional groups such as groups of —OH, —NH, —C═O, —C—H, and —C═N. In particular, —C═O and —OH groups may function as a fundamental parameter for determining the extent of aggregation of the UDD particle in a suspension solution. According to an IR analysis of fraction samples in a UDD sample, each of the fraction samples has a number of common functional groups, but their contents are found to be different from each other.

The use of a surfactant is not appropriate for stabilization of a UDD suspension solution of the present invention, except using a specific surfactant such as a short-chain surfactant having ω, ω' type di-cationic groups provided on the both ends. In practice, the UDD particle in the suspension is surrounded by molecules of the surfactant. This results in that the tail portion becomes to have a hydrophobic portion (a long-chain alicyclic group) of the surfactant, which faces an aqueous medium. As a result, the UDD particles becomes water-shedding, thereby decreasing its dispersion stability.

Production Example 13

The UDD particles of the present invention were examined with respect to a compatibility with a dispersing medium. An affinity with the UDD particle, that is, a dispersion stability, is continuously increased in such a order of acetone, benzene, isopropanol and water. For improving a dispersibility of the UDD particle, it is apparently essential to determine a polarity of the dispersing medium. In addition, formation of a π-composite between a dispersing medium and a UDD particle may promote compatibility improvement and dispersion stability at a surface activity of the UDD cluster. The UDD suspension solution using a non-polar organic solvent is important in view of the practical use. Providing that such a nanometer diamond suspension solution can be prepared, development of an elastomer based cluster may be possible. This can be implemented by a technique of changing a surface of the UDD particle from a hydrophilic property to a hydrophobic property. For the purpose, a dry powder of a nanometer diamond is added to a benzene solution including an elastomer of poly-dimethyl silane and poly-isoprene. More specifically, a polymer hydrophobic chain is absorbed on a surface of a diamond cluster, so as to stabilize a suspension solution of the present invention. In fact, it was proved that dispersibility of the UDD in an organic solvent is improved. It is found that a modifier optimum to a UDD surface is a polymer of a diene material such as poly-isoprene. Hence, a method of modifying a UDD surface and a method of optimizing a suspension solution can successfully be developed. As the UDD cluster surface is modified by poly-isoprene and the like, the UDD suspension solution may be prepared, comprising a large particle having a maximum particle diameter of about 300 nm. The stability of a suspension solution, that is, precipitation resistance, lasts for ten days or more.

Production Example 14

The UDD of the present invention is then examined in view of the change from a diamond phase to a graphite phase. This phase change is generated when a UDD is heated in an inert medium at a temperature of 720 to 1400° K. For identifying the phase change, a Raman scattering (RS) method and an X-ray diffraction method are used in combination. From the result of the RS scattering and the X-ray diffraction, it is concluded that the UDD is a clustered substance having a diamond crystal structure pertinent to a nanometer diamond having a particle size of about $4.3\times10^{-9}$ m.

In most cases, a UDD nanometer cluster having a particle size having a small range from $4\times10^{-9}$ m $5\times10^{-9}$ m was observed. It is accordingly understood that the crystal having a unit of nanometer is more thermally stable in a diamond form than in a graphite form. This is supported by a report of M. Gamamik, *Phys. Rev.* Vol. 54, page 2150 (1996).

There is a profile in an RS spectrum corresponding to a maximum function of a lattice oscillator density of a diamond and a graphite, which indicates presence of a small amount of an amorphous diamond and graphite in a sample.

As disclosed in G. V. Sakovich, V. D. Gubarevich, F. Z. Badaev, P. M. Brilyakov, O. A. Besedina, *Proceeding of Science of USSR,* Vol. 310, No. 402 (1990), "Aggregation of diamonds obtained from explosives," a UDD cluster and any other ultra-dispersed substance are a single aggregation, and the amorphous phase may be an aggregate located on the surface of its diamond core.

From the X-ray diffraction data of the present invention, it is confirmed that the amorphous phase with a particle size of about $1.5\times10^{-9}$ m is present. From the fact that the peak at 1322 $cm^{-1}$ is constant on the RS spectrum indicating an annealing temperature $T_{ann}$ up to 1000° K, it is true that the structure of diamond is not changed in its structure by the annealing up to the annealing temperature. This is also confirmed by the result of the X-ray diffraction analysis, presenting a graphite phase in a range of $T_{ann}$>1200° K. The phase change from a diamond phase to a graphite phase is commenced from a cluster surface during the annealing under the inert atmosphere. From the result of the X-ray diffraction, it is also confirmed that the graphite phase is a set of graphite nanometer plates, spaced equally having a size of $4\times10^{-9}$ m or less, finding that the graphite is substantially created by consumption of a diamond core at a temperature of $T_{ann}$>1200° K.

As disclosed in L. Kuznetsov, A. L. Chuvilin, Yu. V. Butenkov, L. Yu. Malkov, A. K. Gutakovskii, S. V. Stankus, R. Kharulin, *Mat. Res. Soc. Symp. Proc.,* 396, page 105 (1995), a measured initial phase change temperature $T_{pt}$ corresponds to data of an electron microscope. According to the present invention, the nanometer crystalline diamond core having a bulb-like shape of carbon is declined in the size at a temperature of T>1300° K. The RS spectrum exhibits a particular shape at 1575 $cm^{-1}$ which clearly shows at a temperature of T=1400° K. The report by V. L. Kuznetsov et al. that the bulb-like shape of carbon is developed at a temperature of 1400° K is found to be correct.

According to the present invention, the shift or change from a diamond phase to a graphite phase is started at a temperature of $T_{ann}$>1900° K, which is lower than a temperature for starting a volumetric mono-crystallization of a diamond. It is reported in E. L. agaev, Ussspehi fizicheskoi nauki, No. 162, page 49 (1992) that a reduction of a temperature for starting a phase change, for example, a melting point, is observed in a metal cluster.

At a temperature of $T_{ann}$>720° K, regularization of an $sp^2$ portion of a UDD is commenced while a graphite phase is developed on a diamond cluster core. The $sp^2$ regularized crystallization is created outside of the diamond crystal core, converting it into an $sp^2$ bonded amorphous carbon. This is expressed by increase in an intensity at 1350 to 1600 $cm^{-1}$ of the RS spectrum, and by development of a micro structure with a diffusion pattern in a range of small angle to medium angle of the X-ray diffraction at a temperature of $T_{ann}$>1300° K.

A UDD particle forming a cluster comprises a crystalline core having a relatively high-density and regularity and a shell having a softness, which is chemically breakable. The diamond core gives a UDD a fundamental property, such as thermal stability, chemical stability, high thermal conductivity, high thermal diffusivity, low electrical conductivity, low X-ray diffraction, quasi-wear resistance, and quasi-hardness. The shell of the cluster contributes to a negative sign of a charge at a surface of a UDD particle, absorption, absorptivity, chemisorptivity, a chemical composition of a functional group at a surface thereof, and colloidal stability of a UDD particle in a liquid or medium. Unlike a conventional metal cluster which consists of a chemically different element at a core and a ligand shell, or in other words, unlike a metal cluster of a metal atom and a complex forming ion, the UDD cluster fundamentally comprises a core and a shell, both being of carbon, and the shell being stabilized. This allows a diamond lattice structure to be converted through a polyhedron frame, a polycyclic structure, and a net structure, into a non-diamond structure of a shell form. The cluster boundary can be stabilized by a composite product between carbon atoms of the shell and a gas product from the detonation of an explosive, an air, an oxidizer mixture, and an atmospheric substance such as a modifier. For the aggregation of a diamond cluster, the shell functions as a primary role to react with a matrix component of the explosive and a coating material. In addition to the results in the present invention, there are reported two carbon components in a UDD particle, as disclosed in T. M. Gubarevich, Yu. V. Kulagina, L. I. Poleva, Sverhtvjordii materali, No. 2, pp. 34

(1993), "Oxidation of ultra-dispersed diamonds in liquid media." The results in this article correspond to those of the present invention.

As disclosed in A. I. Lyamkin, E. A. Petrov, A. P. Ershov, G. V. Sakovich, A. M. Staver, V. M. Titov, *Proceeding of Academy of Science of USSR,* No. 302, page 611 (1988); A. M. Staver, N. V. Gubareva, A. I. Lyamkin, E. A. Petrov, Phisika Gorenniya Ivzriva, Vol. 20, No. 5, page 100 (1984), "Ultra-dispersed diamond powders obtained with the use of explosive;" and N. V. Kozirev, P. M. Brilyakov, Sen Chel Su, M. A. Stein, *Proceeding of Academy of Science of USSR,* Vol. 314, No. 4, page 889 (1990), "Investigation of synthesis of ultra-dispersed diamonds by mean of tracer method," a structure of an aggregate product fabricated by means of a shock conversion is developed by a primary step of generating a chemical reaction by the detonation of an explosive, followed by a two-period step of releasing of the reactive phase or the explosion product and permitting the reflection of shock waves to pass across the explosion product. In the N. V. Kozirev's report, the possibility is discussed of the secondary step for shifting a diamond to a graphite, or for changing a crystal phase to an amorphous phase. Other than the structural conversion and the phase change, which affect a carbon frame in a particle, a reaction between a condensed substance and a gaseous substance is made in a detonation chamber. Such a chemical reaction may be varied depending on a temperature and a period of impressing a shock wave determined by various lives of a carbon condensate substance in a reactor.

Assuming that an aggregation of a diamond substance from a detonation product is carried out within a moment of some microseconds, the present invention may be bound to (1) that a primary detonation product of an explosive is hardly made uniform in a chemically reactive range and (2) that separation between a condensation component and a molecular component in the detonation product is hardly completed in a desired length of time. This implies that a chemical marking for the diamond synthesizing process, which incorporates a molecular compound and a fragment of the aggregation structure for identifying the aggregating mechanism of free carbons in the explosive and the reconstructing mechanism of carbon atoms, is possibly stored in the aggregate of the detonation product.

The chemical marking is classified into the following four categories: (i) a frame, bridge, alicyclic carbon compound as a fragment of a diamond or diamond-like structure consisting of a $sp^3$ carbon; (ii) a derivative of a homocyclic or polycyclic aromatic compound as a fragment of a graphite structure (an $sp^2$ hybrid orbital); (iii) a straight-chain or branched alicyclic compound as a fragment of an amorphous compound up to a boundary of a carbon cluster or a fragment of indication of a carbyne (R—$CH_2$—) structure; and (iv) a —C—N or —C—O bond contained compound as a fragment of a carbon particle at a surface.

Production Example 15

For clarifying and analyzing the chemical marking, a thermally decomposed product and a decomposed product (so-called an organolytic decomposed product) in a super-critical organic solvent of a non-diamond phase of a UDD or BD of the present invention are examined.

More specifically, a cool extracting process is conducted by a Soxhlet apparatus at a range of solid:liquid=1:10 for an extracting duration of (3.6 to 4.32)×$10^5$ seconds. When extracting of a liquid is maximum, the organolytic decomposing process is carried out at a super-critical state. A pressure of not smaller than 5 MPa is applied at a temperature of 573 to 673° K in an autoclave of 4×$10^{-4}$ $m^3$ in volume. Resultant extracts are subjected to a low-temperature fluorescent spectrum analysis, gas-liquid chromatography analysis, chromatography mass spectrum analysis, IR spectrum analysis, and paramagnetic resonance spectrum analysis. For obtaining different extracts, different types of an explosive mixture are provided including a no-diamond contained reference sample. Depending on a synthesis condition, each explosive mixture produces a different extract which is bicyclic aromatic hydrocarbon and polycyclic aromatic hydrocarbon having one or more substituents. Also, various compounds including an $sp^2$ hybrid orbital or $sp^3$ hybrid orbital are obtained from a molecular product extracted at a low temperature from the mixture. It is however understood that an ultra-dispersed graphite or turbostrate (such as smectite or coal in a meso-phase where a bonded atom layer is in parallel to each other, oriented to a different direction, and/or placed one over another at a random interval) is more similar to any natural substance having such a compound than a diamond. During the cool extracting process, a solid carbon matrix is not fractured but allows desorption and adsorption, and washing out (extraction) of a compound molecule dissoluble in an organic solvent. It is hence concluded that the identified compound is a carbon compound in an intermediate state between a detonation product and a carbon aggregation. Then, the relationship between the poly-aromatic compound discharged into an extract in the mixture, the diamond phase completed structure, and their proportion is examined. As a result, 5% at maximum of a soluble substance is discharged from the detonation product containing no diamonds.

Production Example 16

An extracting process accompanying with a partial decomposition of a solid substance is carried out at a temperature of 200 to 400° C. under a boosting condition or a super-critical condition of an organic solvent. A maximum super-critical liquefaction of carbon is conducted in pyridine which is one of the most active solvents. Table 9 illustrates a composition thermally extracted using a relatively moderate solvent (hydrocarbon).

TABLE 9

| Aromatic Polyheterocycles in high-temperature extracts from UDD and BD | | | | |
|---|---|---|---|---|
| | BD | | UDD | |
| | Solvents-extragents | | | |
| Structural formula of a compound | Toluene | Benzene | Cyclohexane | Hydronaphtalene |
| 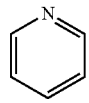 | + | | | |
| 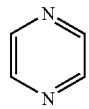 | + | | | + |

TABLE 9-continued

| Aromatic Polyheterocycles in high-temperature extracts from UDD and BD | | | | |
|---|---|---|---|---|
| | BD | | UDD | |
| | Solvents-extragents | | | |
| Structural formula of a compound | Toluene | Ben-zene | Cyclo-hexane | Hydro-naphtalene |
| 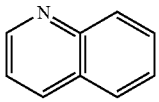 | | | + | + |
| 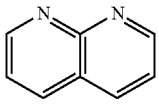 | + | + | + | + |
| 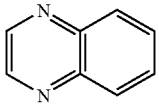 | | | | |
| 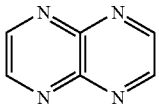 | + | + | | + |
| 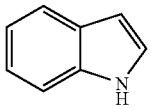 | | | + | + |
| 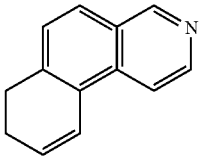 | | | + | |
| 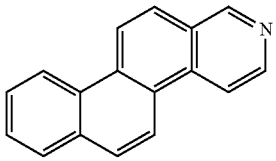 | + | | | |

Note. "+" is the presence of a substance in extract
normal structure heptane, decane
aromatic structure benzene, toluene
alicyclic structure cyclohexane
hydronaphtalene tetralin, decalin
These compounds are characterized by relative stability in the experiment conditions, an increase of solution power is pointed by the arrow.

In fact, the extracts obtained are tinted in a range from thin yellow (n-hydrocarbon) to dark brown (hydro-naphthalene). The ratio of carbon between a diamond phase and a graphite phase is changed after the extracting process and also, the properties on the surface are changed. Through 30 minutes of the super-critical liquefaction process, 10% or more of the carbon contained diamond phase is turned to a soluble state. As the decomposition to active chemical bonds of carbon is relatively slow, the surface of each cluster becomes nonuniformity. A stable structure unit, such as a microscopic unit of solid carbon discharged into a solution, and a micro unit of individual molecules, remain unaffected. Among the units, a nitrogen containing poly-hetero-cyclic molecule having up to four rings, each of the rings having one or two nitrogen atoms, is identified.

The formation of such a compound in accordance with an organic chemistry principles may be explained by nitrogen consumed during poly-condensation of a nitrogen containing monomer having a carbon-nitrogen bond and contained in an aggregation which has primary dressed diamonds in the UDD synthesizing. In this point, the present invention is differentiated from the conventional report, A. L. Vereshagin, V. F. Komarov, V. M. Mastinhin, V. V. Novosyolov, L. A. Patrova, I. I. Zolotuhina, N. V. Vichin, K. S. Baraboshikin, A. E. Petrov, Published Documents for the Conference Entitled name of In Proceeding of 5th All-Union Meeting on detonation, held in Krasnoyarsk, January 1991, page 99, "Investigation of properties of detonation synthesis diamond phase." This article describes that there is no characteristic triplet signals present in the EPR spectrum of a UDD having carbon atoms in a diamond lattice replaced by impurity nitrogen atoms. However, this results from a fact of difference between "poly-condensation for synthesizing a UDD during detonation" in the present invention and "dispersing growth of a diamond crystal," as a conventional manner. After the dispersing growth of a diamond crystal, it is found that nitrogen impurities are trapped and dispersed in a diamond crystal. The synthesizing of a UDD of the present invention allows nitrogen impurities (more precisely, a nitrogen-carbon bond) to be taken into an aromatic ring (having a cyclic aromatic structure with a high bonding energy), and then, trapped in a preliminarily condensed packing. In this case, the paramagnetic properties of nitrogen are different from those of nitrogen impurities.

From the data of thermal absorption, it is also assumed that both are equal in their structure of the outer side of the shell of diamond clusters. The thermal absorption is measured in the present invention using a chromatography mass spectrum meter LKB-209 (made in Sweden). After thermal adsorption and desorption at a temperature of 573° K in a helium flow, a resultant product is continuously trapped in a capillary tube cooled down with liquid nitrogen. Then, the thermal adsorption and desorption product is evaporated by a program to heat it at a rate of 4° per minute at a temperature from 293° K to 543° K under a flow of helium gas carrier ($V_{He}=2.5\times10^{-6}$ m•m$^3$) in a capillary column of a low polar phase (SPB-5,$1_k$=60 m, $d_c=3.2\times10^{-4}$ m).

Production Example 17

The product is identified by mean of a mass spectrum processing with a computer using a mass spectrum library. Table 10 shows a composition of a product generated by adsorption and desorption at a surface of a UDD, and a diamond contained mixture.

TABLE 10

| Thermal desorption (T = 573° K.) from surface of UDD and BD (in 3 samples) | | | | |
|---|---|---|---|---|
| Compound | | BD | UDD | UDD after treatment with hydrogen |
| Acetonitrile | | | ++ | |
| Nitromethane | | | + | |
| Butanone | | | + | |
| Teterahydrofuran | | | + | |
| Ethanol | | | | + |
| Acetone | | | | + |
| Ethyl acetate | | | ++ | +++ |
| Benzene and homologs | | ++ | +++ | ++ |
| Alkylbenzenes | $C_9$ | + | +++ | |
| | $C_{10}$ | +++ | + | |

TABLE 10-continued

Thermal desorption (T = 573° K.) from surface of UDD and BD (in 3 samples)

| Compound | | BD | UDD | UDD after treatment with hydrogen |
|---|---|---|---|---|
| Alkanes | $C_7$ | | + | +++ |
| | $C_8$ | | + | + |
| | $C_9$ | | + | |
| | $C_{10}$ | +++ | +++ | |
| | $C_{11}$ | + | + | |
| Alkenes | $C_7$ | | + | |
| | $C_8$ | + | + | |
| | $C_9$ | | + | |
| | $C_{10}$ | | ++ | |
| Terpadienes | $C_{10}$ | + | ++ | |
| Alcyclopentanes | | + | | |
| Naphthalene | $C_{10}$ | + | + | |

"+" is the presence of a substance in thermal desorption products.

On the BD surface, only hydrocarbons, that are, saturated $C_8$–$C_{11}$ hydrocarbon, unsaturated $C_8$–$C_9$ hydrocarbon, alicyclic hydrocarbon, and aromatic hydrocarbon, are adsorbed and desorbed. As a content of alkane having $C_{10}$ is redundant, the adsorption and desorption product contains mainly n-decane $C_{10}H_{22}$. This is explained by the data of a carbyne structure (R—$CH_2$) as a thermodynamically efficient structure when a hydrocarbon chain of $C_{10}$–$C_{12}$ is packed by consumption of a cumulene bond ($C_3H_7$—$C_6H_4$—CH) as the detonation product. While presence of poly-cyclic aromatic net in the BD is confirmed by the present invention, an aromatic hydrocarbon including an alkylbenzene of $C_{10}$ is a small portion of the total mass generated by adsorption and desorption from the BD. It is hence apparent that the condensation of a $sp^2$ carbon is high enough. However, the poly-cyclic aromatic net is highly mismatched and thus has fatty peripheral groups or so-called hydrocarbon fringes. Hydrogen in the adsorption and desorption product from the BD surface is inert having a C—H bond. This result is not differentiated from the teaching of an ultra-dispersed carbon surface active hydrogen disclosed in Russian Patent No. 2046094 (A synthetic carbon diamond material), Bjuljuten Izoberetnji (29), page 189 (1995).

The composition of an adsorption and desorption product from a UDD surface is highly complex and significantly varied. Other than hydrocarbons, a nitrogen containing compound and an oxygen contain. compound are the products from oxidization at the carbon surface. As benzene and $C_7$–$C_{10}$ congeners have been developed, alkane of $C_{10}$ is generated from them. In particular, n-decane is redundant. The bridge alicyclic is developed as a camphene and terpadiene $C_{10}H_{16}$. The composition of the adsorption and desorption product indicates that the interface in the diamond structure is exposed at a minimum possibility.

A UDD cluster structure can be stabilized with transient carbon structures. When a UDD is processed at a temperature of 400° C. in a hydrogen flow (as a hydrogen processed UDD as shown in Table 11), the adsorption and desorption of a large amount of hydrocarbon $C_8$–$C_{11}$ is reversible. However, when the surface carbon structure is decomposed, a continuous or metastable surface structure is reconstructed while a $C_2$–$C_7$ of hydrocarbon is formed.

It is known that a diamond particle synthesized by means of a shock conversion is defined by ahe fractal rule (an infinite geometric series rule of having the shape of a set arranged similar to the shape of each member of the set and repeating this regularity to develop greater sets) and consists mainly of a cluster of a non-continuously aggregated small particles where at least a particle or clusters are joined together, as depicted in G. V. Sakovich, V. D. Gubarevich, F. Z. Badaev, P. M. Brilyakov, O. A. Besedina, Proceeding of Science of USSR, Vol. 310, No. 2, pp. 402 (1990), "Aggregation of diamonds obtained from explosives;" Luciano Pietronero, Erio Tosatti, Fractals in physics, Proceeding of the Sixth Trieste International Symposium of Fractals in Physics (1985), ICTP, Trieste, Italy, "Investigation of synthesis of ultra-dispersed diamonds"; and A. V. Igonatchenko, A. B. Solohina, published domcument for the Conference entitled name of In proceeding of 5th All-Union Meeting on detonation, held in Krasnoyarsk, January 1991, pate 164, "Fractal structure of ultra-dispersed diamonds."

An ion intensity in a UDD suspension solution preferably used in the present invention is varied in a range from pH 4 to pH 10, but its pH increase with a higher temperature may initiate a flocculation of a suspended particle. It is considered that the aggregation of the UDD of the present invention takes place in two steps: At the first step, a non-diamond component in the BD is clustered by oxidization during a chemical dressing process to develop a first aggregation which has a relatively compact size. At the second step, an aggregation is occurred between respective clusters, to develop a second cluster structure which may be more easily broken. The second step lasts until the first aggregation starts a flocculation. In some cases, there may be developed undesired aggregation between a cluster and a particle, or between respective second cluster structures.

Production Example 18

Next, properties of UDDs are compared with respect to a structure synthesized by means of a static conversion method (Method I, not shock conversion), a structure by mean of a conventional shock conversion method (Method II, as disclosed in G. A. Adadurov, A. V. Baluev, O. N. Breusov, V. N. Drobishev, A, I, Rogechyov, A. M. Sapegin, B. F. Tatsji, Proceeding of Academy of Science of USSR, Inorganic Materials, Vol. 13, No. 4, page 649 (1977), "Some properties of diamonds obtained by explosion method"), and a structure by means of the present invention (Method III). The results are shown in Tables 11-1, and 11-2.

TABLE 11-1

Characteristics of UDD powders of different nature.

| Name of Characteristic | Method of diamond production and its brand: Method I, static synthesis, ACM 1/0 | Method II, conventional detonation | Method III, detonation of the present invention |
|---|---|---|---|
| 1. Phase composition | Diamond of cubic syngony ($a = 3.57 \times 10^{-10}$ m) | Diamond of cubic ($a = 3.57 \times 10^{-10}$ m) and hexagonal syngony ($a = 2.52 \times 10^{-10}$ m) or cubic syngony | Diamond of cubic syngony ($a = 3.57 \times 10^{-10}$ m) |

TABLE 11-1-continued

Characteristics of UDD powders of different nature.

| Name of Characteristic | Method of diamond production and its brand: Method I, static synthesis, ACM 1/0 | Method II, conventional detonation | Method III, detonation of the present invention |
|---|---|---|---|
| 2. Substructure dimensions of coherent dispersion bands, ($\times 10^{-10}$ m): | Not found | 100~120 | 40 |
| microstresses of the II type ($\Delta\alpha/\alpha$): | — | $(1.0\sim1.9) \times 10^{-3}$ | Absent |
| density of dislocation, $m^{-2}$ | — | — | $1.8 \times 10^{17}$ |
| 3. Pycnometric density, ($\times 10^{-3}$ kg/m$^3$) | 3.49 | 3.20–3.40 | 3.30 |
| 4. The particle size, ($\times 10^{-9}$ m) | 0~2000 | 41~82<br>10~50<br>(from graphite)<br>20~800<br>(carbon black) | 48.1<br>(2~50)<br>19.6<br>2~20<br>(from graphite))<br>4<br>(carbon black) |
| 5. Specific surface ($\times 10^3$ m$^2$/kg) | 13.5 | 20.42 | 217 |
| 6. Chemical composition, mass; % | C = 99.0<br>Ni, Mn, Cr,<br>Fe = 0.5<br>Si = 0.2<br>B = 0.2<br>H = 0.1<br>O = 0.1 | N = 2.00 | C = 80.75<br>H = 1.35<br>O = 15.90<br>O = 15.90<br>Si = traces |

TABLE 11-2

Characteristics of UDD powders of different nature.

| Name of Characteristic | Method of diamond production and its brand: Method I, static synthesis, ACM 1/0 | Method II, conventional detonation | Method III, detonation of the present invention |
|---|---|---|---|
| 7. Incombustible (unburnt) residue, mass, % | <0.1 | 0.1 | <2.0 |
| 8. Temperature of the beginning of oxidation in air, ° K. | 723 | — | 673 |
| 9. Temperature of the beginning of graphitisation in vacuum, ° K. | 1373 | >1073 | 1423<br>(1273~1473) |
| 10. Electrical resistance, (Ω) | $1 \times 10^{11}$ | — | $7.7 \times 10^9$<br>$((7.7\sim8.1) \times 10^9)$ |
| 11. The loss tangent of a dielectric at frequency $\theta = 10^3$ Hz | 0.0100 | — | 0.0145<br>(0.0143~0.0363) |
| 12. Specific magnetic susceptibility ($\times 10^3$/kg) | $0.5 \times 10^{-8}$ | — | $<1.0 \times 10^{-8}$ |
| 13. Degree of water receptivity, (Joule/mol · kg) | −1480 | — | >−3100 |
| 14. Electrophoretic charge of the surface ($\times 10^3$ V) | −6.53 | — | >−78.44 |

TABLE 11-2-continued

Characteristics of UDD powders of different nature.

| Name of Characteristic | Method of diamond production and its brand: Method I, static synthesis, ACM 1/0 | Method II, conventional detonation | Method III, detonation of the present invention |
|---|---|---|---|
| 15. Adsorption potential A ($\times 10^3$ J/kg) | 14.2 | — | >384 |
| Specific adsorption potential A, (Joule/m$^2$) | 1.005 | — | >2.16 |

As being apparent from Tables above, the UDD synthesized by the method III of the present invention has as a low carbon content as smaller than 90%, as a high hydrogen content as not smaller than 0.8%, and as a high oxygen content as not smaller than 6.8%. This is also differentiated from other diamonds by the fact that the specific surface area is substantially 10 times greater, the adsorptivity is $384\times10^3$ J/kg or more as almost 10 times greater, and the surface potential is not smaller than $-77.44\times10^3$ V as almost 10 times greater. Also, the UDD of the present invention has a level of the surface conductivity and is slightly greater in the water absorptivity. However, the UDD of the present invention is relatively lower in the intra-air oxidization start temperature and the intra-vacuum graphitization start temperature while not different in the electrical and magnetic physical properties from other diamonds. The UDD synthesized by the conventional method II has two phases, a cubic crystal with a crystalline constant of $a=3.57\times10^{-10}$ m and a hexagonal crystal with a crystalline constant of $a=2.52\times10^{-10}$ m. The UDD synthesized by the method III of the present invention has only a cubic crystal phase at a crystalline constant of $a=3.57\times10^{-10}$ m.

Plating, Metal Film

The plating bath according to the present invention will now be described in more detail.

The plating bath is added with the UDD of the present invention so that the UDD concentration is 0.05 to 160 g, preferably 0.05 to 120 g, more preferably 0.1 to 32 g, or most preferably 1 to 16 g for one liter of the plating solution. Practically, the UDD concentration in the plating solution is preferably not smaller than 2 g or more preferably 3 to 14 g for one liter of the plating solution.

Examples 1 to 8

A UDD and Nickel Composite Film Membrane 25 ml of a suspension Liquid, Sample No. 6 prepared by Production Example 1 ($\alpha$=74.4%, Sample E) was added into 475 ml of a watt bath, as a nickel plate bath for ornamentation, so as to obtain 500 ml of a nickel and UDD plating solution. This gloss nickel plate is prepared by using LIONOL 935 as a dispersion agent. The watt bath had the following composition and condition:

| Composition | Content (g/L) |
|---|---|
| Nickel sulfate | 300 |
| Nickel chloride | 60 |
| Boric acid | 50 |

Then, a nonionic surfactant (LIONOL), as a dispersant, was added at an amount less than one drop (0.1 ml/1L), to adjust the nickel and UDD plating solution.

After the plating solution as adjusted above was raised at a temperature of 55° C., the resultant coating (plating processing material) was subjected to the following treatments: A pretreatment (comprising degreasing, water washing, acid washing, and water washing); a plating process (nickel and UDD); and post-treatment (comprising water washing and drying). During these treatments, plating period was defined to be 5 min, using a magnetic stirrer for stirring the plating solution, to mildly agitate it. After washing it with pure water, drying, at the treatment of the plating, was made to blow an air. In the examples, the conditions as described above were used, but it is possible to use a plating bath having, for example, the following prescription:

| | |
|---|---|
| Nickel sulfate ($NiCl_3.6H_2O$) | 300 g/l |
| Nickel chloride ($NiCl_3.6H_2O$) | 30 g/l |
| Boric acid ($H_3BO_3$) | 25 g/l |
| Subsidiary conditions are as follows. | |
| A UDD suspension solution | As shown in Table 12 |
| Surfactant | As shown in Table 12 |
| Gloss agent quantity (two kinds) | Appropriate quantity |
| Pit inhibitor | Appropriate quantity |
| pH | 3.5–4.0 |
| Temperature | 55° C. |
| Voltage (V) | As shown in Table 12 |
| Cathode current density (A/dm2) | As shown in Table 12 |
| Agitation | Mild agitation with a stirrer |
| Period for the plating | 5 min |

In a plating bath containing the above-mentioned UDD suspension solution, using a HULL-CELL (registered trademark) tester, a brass plate for HULL-CELL (registered trademark) testing, which was well washed by a general plating pretreatment, was plated. Just in case, the plating bath was gently agitated, in addition to a natural agitation due to a cathode gas, by a magnetic stirrer. After the plating, it was washed with pure water followed by blowing an air to dry.

TABLE 12-1

| Ex. | 1 | 2 | 3 | 4 |
|---|---|---|---|---|
| Plating | Ni (Watt Liquid) | Ni (Watt Liquid) | Ni (Watt Liquid) | Ni (Watt Liquid) |
| UDD | Sample E | Sample E | Sample E | Sample E |
| UDD content | 10 ml/500 ml | 25 ml/500 ml | 10 ml/500 ml | 25 ml/500 ml |
| Material | CuZn (Brass) | CuZn (Brass) | CuZn (Brass) | CuZn (Brass) |
| Set Temp. | 55° C. | 55° C. | 55° C. | 55° C. |
| Period | 5 min | 5 min | 5 min | 5 min |
| Voltage | 3.5 V | 3.4 V | 3.3 V | 3.5 V |
| Current | 1.0 A | 1.0 A | 1.0 A | 1.0 A |
| Agitation | Magnetic Stirrer | Magnetic Stirrer | Magnetic Stirrer | Magnetic Stirrer |
| Dispersant | — | LIONOL (by Lion Corporation) | polyoxyethylene lauryl ether by Toshin Oil and Fat Co., Ltd.) | NOIGEN EA-120 by Dai-ichi Kogyo Seiyaku Co., Ltd |
| Dispersant Composition | — | $RO[(EO)_m/(PO)_n]H$ | $C_{12}H_{25}O(CH_2CH_2O)_{15}H$ | $C_9H_{19}O(CH_2CH_2O)_nH$ |
| Dispersant Amount | 0.1 ml | 0.1 ml | 0.1 ml | 0.1 ml |

TABLE 12-2

| Ex. | 5 | 6 | 7 | 8 |
|---|---|---|---|---|
| Plating | Ni (Watt Liquid) | Ni (Watt Liquid) | Ni (Watt Liquid) | Ni (Watt Liquid) |
| UDD | Sample E | Sample E | Sample E | Sample E |
| DUU content | 10 ml/500 ml | 25 ml/500 ml | 25 ml/500 ml | 25 ml/500 ml |
| Material | CuZn (Brass) | CuZn (Brass) | CuZn (Brass) | CuZn (Brass) |
| Set Temp. | 55° C. | 55° C. | 55° C. | 55° C. |
| Period | 5 min | 5 min | 5 min | 5 min |
| Voltage | 3.4 V | 3.5 V | 3.4 V | 3.5 V |
| Current | 1.0 A | 1.0 A | 1.0 A | 1.0 A |
| Agitation | Magnetic Stirrer | Magnetic Stirrer | Non | Magnetic Stirrer |
| Dispersant | NOIGEN EA-120 by Dai-ichi Kogyo Seiyaku Co., Ltd | ESOCARD by Lion Corporation | ESOCARD by Lion Corporation | POISE 530 by Kao Corporation |
| Dispersant Composition | $C_{12}H_{25}O(CH_2CH_2O)_nH$ | cationic | cationic | anionic |
| Dispersant Amount | 0.5 g | 0.1 ml | 0.1 ml | 6.0 ml |

With respect to the obtained plating films of Examples 1–8, a thickness of the plating film as a sample was measured by means of a general method (measurement of film thickness by means of fluorescence X-rays). In accordance with a HULL-CELL (registered trademark) current density quick reference matrix, totally, six portions of the film thickness, that are, two of high current density portions (5.0 A/dm$^2$), two of moderate current density portions (2.0 A/dm$^2$), and two of low current density portions (1.0 A/dm$^2$), were measured to calculate an average. Results are shown in table 13.

TABLE 13

| Msmt. | Current Density: 1.0 A/dm$^3$ | | | Current Density: 2.0 A/dm$^3$ | | | Current Density: 5.0 A/dm$^3$ | | |
|---|---|---|---|---|---|---|---|---|---|
| Portion | I | II | (I + II)/2 | III | IV | (III + IV)/2 | V | VI | (V + VI)/2 |
| Ex. 1 | 0.1132 | 0.1797 | 0.1465 | 1.3074 | 1.2555 | 1.2815 | 4.9123 | 4.5283 | 4.7203 |
| Ex. 2 | 0.2610 | 0.1428 | 0.2019 | 1.4399 | 1.3311 | 1.3855 | 4.9850 | 4.9561 | 4.9706 |
| Ex. 3 | 0.1521 | 0.1642 | 0.1582 | 1.2057 | 1.2553 | 1.2305 | 4.8971 | 4.5395 | 4.7183 |
| Ex. 4 | 0.1944 | 0.1733 | 0.1839 | 1.3144 | 1.3206 | 1.3175 | 4.9158 | 4.8977 | 4.9068 |
| Ex. 5 | 0.2013 | 0.1506 | 0.1760 | 1.1025 | 1.2408 | 1.1717 | 4.5230 | 3.9202 | 4.2216 |
| Ex. 6 | 1.1934 | 0.9561 | 1.0748 | 2.0479 | 1.8117 | 1.9298 | 4.3351 | 3.8552 | 4.0952 |
| Ex. 7 | 1.3669 | 1.3205 | 1.3437 | 2.0276 | 1.9170 | 1.9723 | 4.4692 | 4.6473 | 4.5583 |
| Ex. 8 | 0.8744 | 0.8476 | 0.8610 | 1.7818 | 1.7391 | 1.7605 | 3.7295 | 3.6282 | 3.6789 |

In addition, although not shown in Table 13, with respect to the three samples of Examples 6, 7, and 8, a film thickness (μm) was measured also at the portion of current density being 0.1 A/dm$^2$. The results are as follows: An averaged film thickness of 0.2230 μm (Example 6); an averaged film thickness of 0.3393 μm (Example 7); and average film thickness of 0.2582 μm (Example 8) were obtained.

These results show that the film thickness gets larger almost in proportion to a current density, and that film thickness obtained is thin at a current density of 0.1 A/dm$^2$.

Next, a particle size distribution of the UDD particle in a plating film obtained in Examples 1-8 and a distribution size of the UDD particle were examined as follows: A platinum thin film was provided in order to take a SEM photography of the high current density portion, the moderate current density portion, and the low current density portion of the brass plate for a HULL-CELL (registered trademark) tester, so as to take a SEM photography of the surface thereof. Also, a Metra cutter was used to cut off at the portions, that is, the high current density portion, the moderate current density position, and the low current density position of the brass plate for a HULL-CELL (registered trademark) tester, so as to take a photograph of 10,000 magnification at the cross-section of the plating film by means of a SEM (scanning electron microscope). On the brass plate for the HULL-CELL (registered trademark) tester, a mask of copper sulfate plating was provided on the UDD-nickel composite plating film, and then, it was cut off, followed by embedding it into a resin. After curing the resin, the surface to be taken photography (the cut surface) was ground, and etched. Thereafter, a platinum thin film was coated by a spatter for taking a SEM photography, and finally to take a SEM photography.

Figure 22:
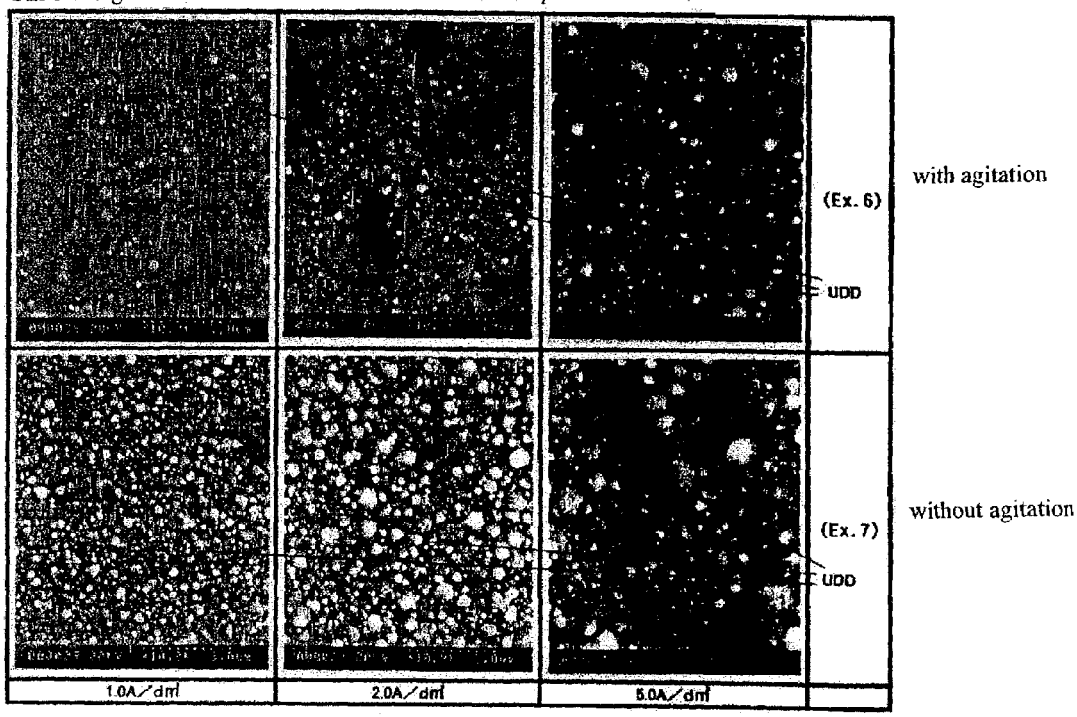
FIG. 22 shows a view of a surface of a UDD containing metal (nickel) thin film according to the present invention, taken by a SEM.
Figure 23:
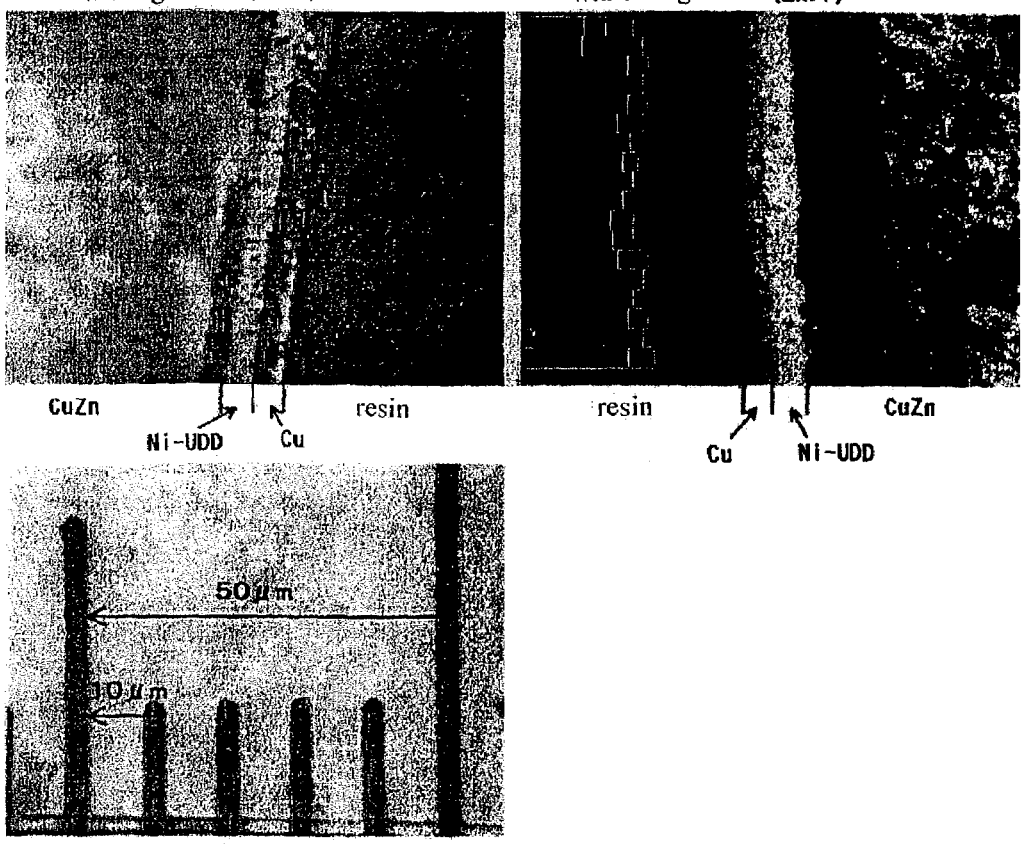
FIG. 23 shows a view of a cross-section surface of a UDD containing metal (nickel) thin film according to the present invention, taken by a SEM.
Figure 24:
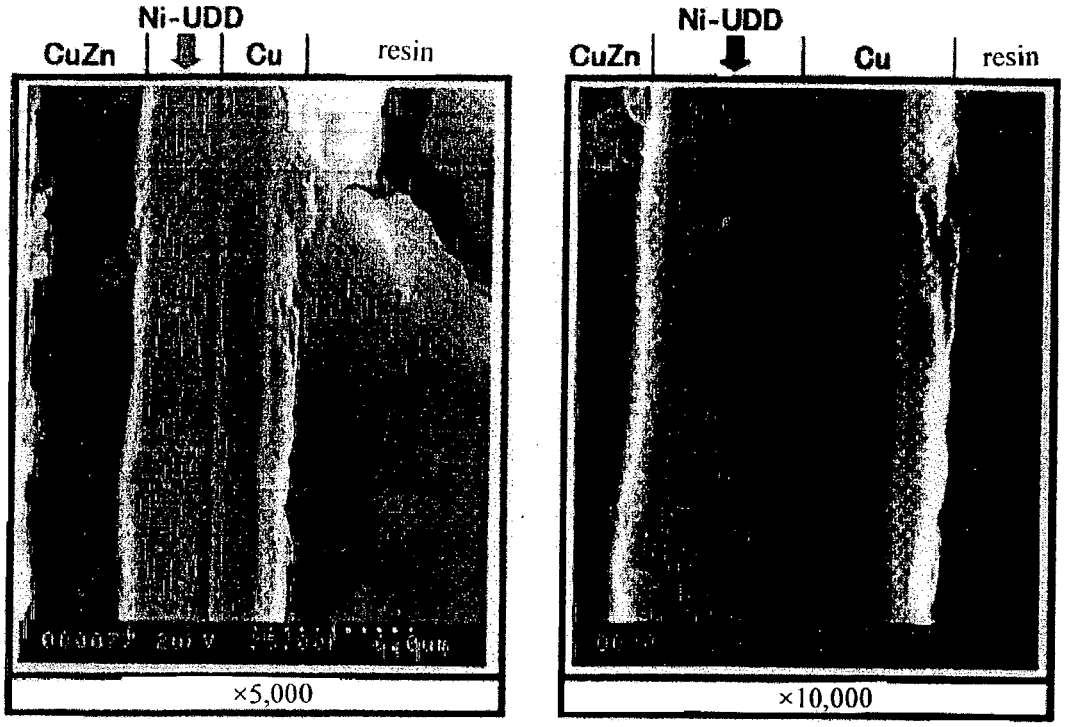
FIG. 24 shows a view of a cross-section surface of another UDD containing metal (nickel) thin film according to the present invention, taken by a SEM.
Figure 24:
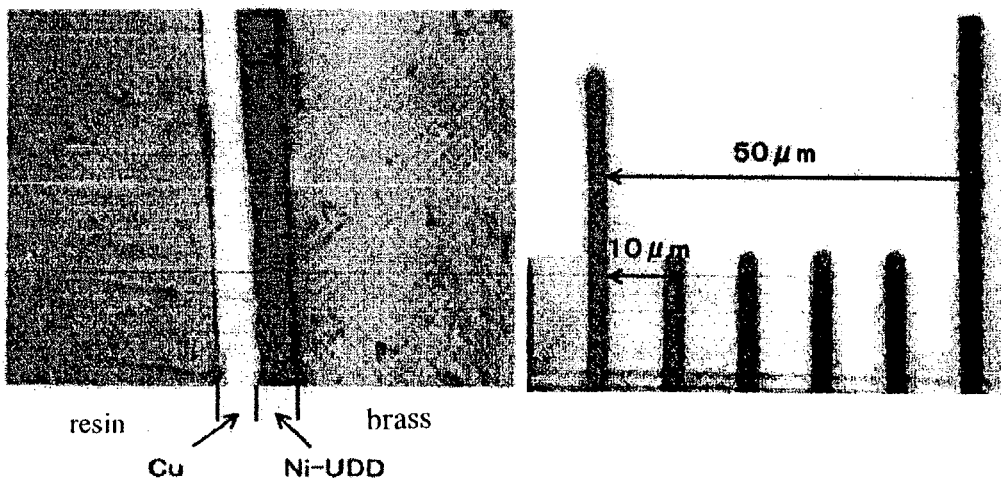
Figure 25:
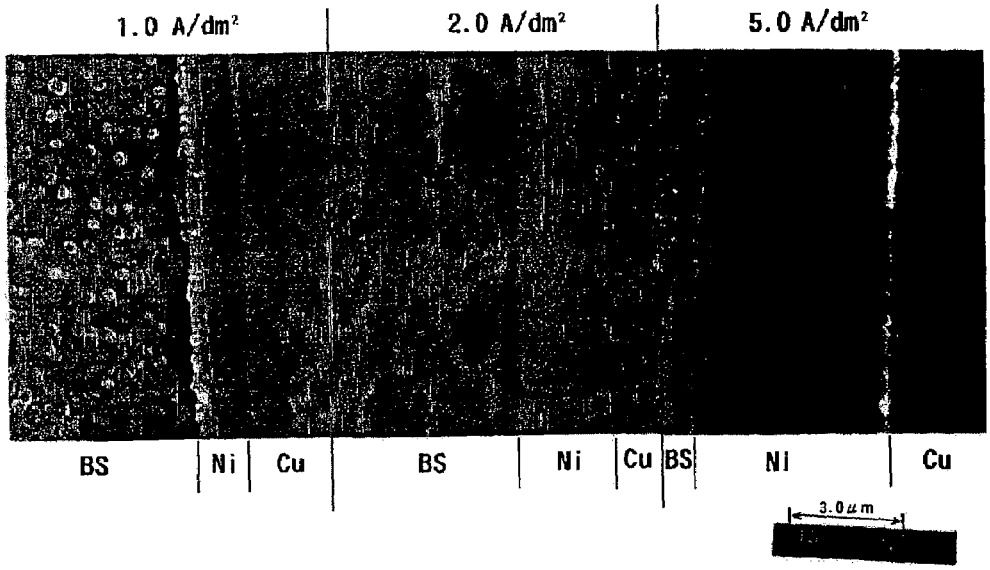
FIG. 25 shows a view of a cross-section surface of another UDD containing metal (nickel) thin film according to the present invention, taken by a SEM.
Figure 26:
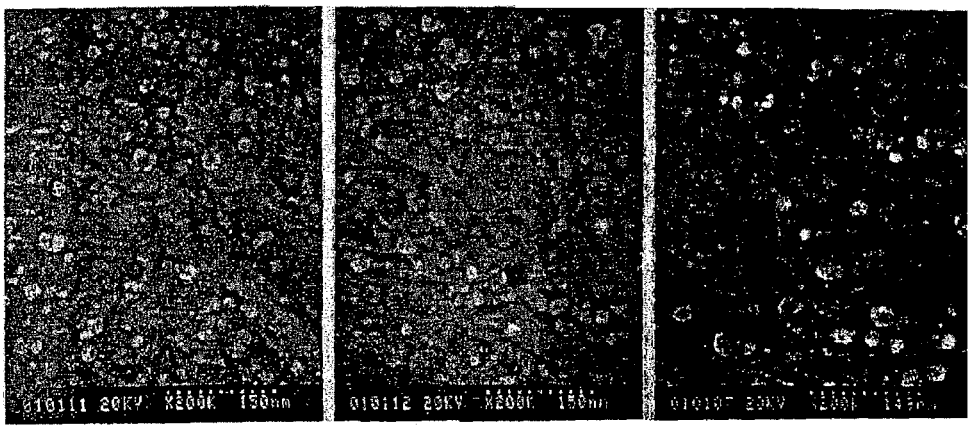
FIG. 26 shows a view of a cross-section surface of another UDD containing metal (nickel) thin film according to the present invention, taken by a SEM.

The photographs taken by SEM are shown in FIG. 22 (SEM photographs of 10,000-power magnification of the surface of the samples of Examples 6 and 7), FIG. 23 (SEM photographs of 10,000-power magnification at the cross-section of the samples of Examples 6 and 7), FIG. 24 (SEM photographs of 10,000-power magnification at the cross-section of the sample of Example 8), FIG. 25 (SEM photographs of 10,000-power magnification at the current density portions of 1 A/dm$^2$, 2 A/dm$^2$, and 5 A/dm$^2$, with respect to the sample of Example 2), and FIG. 26 (SEM photographs of 10,000 magnification at the cross-section with respect to the sample of Example 2).

These photographs show the following results: The composite thin film of a UDD and metal according to the present invention has a narrow distribution (ranging 2 nm to 60 nm) of the UDD particle, dispersing homogenously with a high density not only on the surface of the metal thin film, but also in the direction of the film thickness. In particular, it is found to be homogenously dispersed at a high current density portion. Furthermore, the results of Examples 6 and 7 show that the agitation (Example 6) is more effective than the absence of the agitation (Example 7).

Then, the plating samples obtained in Examples 1–8 were examined with respect to a particle size distribution of the UDD particle in the plating film and a distribution size of the UDD particle, by means of the following image-analysis method based on the taken SEM photograph.

A plating film of the HULL-CELL (registered trademark) strip having a specific area (4 cm×10 cm) was dissolved by an acid by means of a general method, and then, the resultant solution was filtered. The particles remaining on the filter was weighted to obtain an amount of the UDD in the UDD and metal composite thin film according to the present invention. Using this result, a deposition rate of the UDD deposited in a nickel film was calculated by means of the following formula (I) and (II).

(Weight of a Ni Film)=(Averaged Film Thickness)×(Surface Area)×(Density of Ni) Formula (I)

(UDD Deposition Rate)=(UDD Deposition Weight)/(Weight of the Ni Film) Formula (II)

Next, the enlarged photograph of SEM as shown in FIG. 22 was cut into pieces having a unit size of 1.0×1.0 $\mu m^2$. Among them, several pieces were randomly selected to measure their UDD content to calculate an average, so as to convert in into an eutectoid amount of the UDD per an area of 1.0×1.0 $\mu m^2$. Based on the results, an UDD deposition rate in a nickel film was calculated. The followings are the equations (III)–(VI) used. In the equations, "r"=15 [nm] and "the UDD density"=$3.20\times10^3$ [$kg/m^3$]. Also, the results are shown in Table 14.

(Weight of one piece of UDD)=$(4\pi r^3/3)$×(Density of a UDD) (III)

(Total number of the UDD contained in a film)=(Volume)×(Number of the UDD per a unit volume) (IV)

(Deposition weight of the UDD)=(Total number of the UDD contained in a film)×(Weight of the UDD per one particle) (V)

(Deposition rate of the UDD)=(Deposition weight of the UDD)/(Weight of the nickel film)×100 (VI)

TABLE 14

Deposition Rate in a Nickel Film

| Ex. No. | Weight of a Filter (Before filtration) (g) | Weight of a Filter (After filtration) (g) | Weight of a UDD (g) | Deposition rate of a UDD: Converted Value by a Filter (%) | Deposition rate of a UDD: Converted Value by a SEM Photograph (%) |
|---|---|---|---|---|---|
| 1 | 0.0904 | 0.0912 | 0.0008 | 1.10 | |
| 2 | 0.0905 | 0.0908 | 0.0003 | 0.39 | 1.71 |
| 3 | 0.0898 | 0.0906 | 0.0008 | 1.10 | |
| 4 | 0.0906 | 0.0917 | 0.0011 | 1.45 | |
| 5 | 0.0904 | 0.0910 | 0.0006 | 0.91 | |

Table 14 shows that the UDD and nickel metal composite thin film according to the present invention has a UDD deposition percentage or content of 1% or more. However, since a nonionic surfactant is more effective in inhibiting aggregation of the UDD in a plating solution, it is considered that there are some particles passing through the filter of 0.2 μm. Especially, it is considered to be remarkable in the case of Example 2.

Use Example of a Cation Surfactant 25 ml of the UDD as a sample and 25 ml of pure water were charged into a beaker, followed by being mixed, into which 0.1 ml of a cation surfactant, Esocard, was added and mixed. Then, the solution of the UDD was added to 450 ml of a nickel plate. Following further stirring and adjustment produce a UDD and nickel plating solution. Then, by means of a HULL-CELL tester, electroplating was made on a brass plate for a HULL-CELL (registered trademark) tester, which was previously washed in a well known plating pretreatment. A preliminary plating was made to determine a plating conditions as follows: Temperature for plating was: 55° C.; plating time was: 5 min; and current value was: 1.0A. Using a magnetic stirrer, the plating liquid was mildly agitated at the time of plating. Also, in case of plating without agitating, agitation was stopped just before beginning electrolysis. When the electrolysis was begun, agitation was simultaneously stopped. After the plating, the plate was washed with pure water and an air was blown to dry it.

With respect to the surface of the plating film obtained in a manner as described above, a SEM (scanning electron microscope) photograph was taken with enlargement of 10,000 magnification. This enlargement corresponds to positions of 1.0, 2.0, and 5.0 $A/dm^2$ in a HULL-CELL current density quick reference matrix. FIG. 23 shows the enlarged photographs.

Next, the enlarged photograph was cut into a piece having an area of 1.0×1.0 $\mu m^2$. Among the pieces, several pieces were randomly selected to count a UDD content, which were calculated to obtain an average, followed by converting it into an eutectoid amount per an area of 1.0×1.0 $\mu m^2$. Based on this data, a UDD deposition rate in a nickel film was calculated. The formula used in this calculation is in accordance with the equations (III)–(VI). In these equations, "r" represents 15 [nm] and a "UDD density" represents $3.20\times10^3$ [$kg/m^3$]. The results are shown in Table 15.

TABLE 15

Deposition Rate of a UDD in a Ni Film

| | 1.0 $A/dm^2$ | 2.0 $A/dm^2$ | 5.0 $A/dm^2$ |
|---|---|---|---|
| With Agitation | 1.26% | 2.26% | 1.62% |
| Without Agitation | 1.76% | 2.45% | 3.21% |

The SEM photographs with enlargement of 1000 magnification, as shown in FIG. 23, show that comparing agitated sample with non-agitated sample, the agitated sample makes more homogenous dispersion than the non-agitated sample. It is considered that the stirring (that is, the direction of the flow of the plating liquid) affects on the dispersion. Also, the larger the current density was, the more the UDD aggregated, and the more variations the deposition particle size had. At the portion having a current density of 1.0 $A/dm^2$, a UDD aggregation having a particle size of 100 nm, approximately, was homogenously dispersed, having a narrow variation range of a deposition particle size. Therefore, it was found that a current density affects on a deposition particle size, thereby finding that the lower the current density is, the denser the resultant UDD and nickel plating composite film becomes. However, when a stress was applied at a high current density portion, a crack was generated on the plating. It is considered that it results from a change of a physical property, so that hardness of the plating film is increased by increasing deposition of UDD.

Image Analysis of the SEM Photographs of a UDD Particle

FIG. 25 shows a SEM photograph with enlargement of $2\times10^5$ magnification at three portions of the sample of Example 2: At a portion having a current density of 1 A/dm$^2$, at a position having a current density of 2 A/dm$^2$, and at a portions having a current density of 5 A/dm$^2$. A calibration value (or resolution power) of 100 line/inch was used. With respect to a pixel cutoff size of 0.68492 nm/pixel and 1.46 pixel/nm, a scanner reading was made on the area of 800×950 pixel. Then, the read pixel information was supplied to a computer to proceed with a graphics processing in an ordinary use. Namely, the read picture information was digitalized in a computer, and then, the obtained data was statistically calculated to obtain a histogram. Based on the histogram, a threshold value, for distinguishing a bright region in the pixel groups from a dark region therein, was statistically calculated by the computer. Based on the threshold value, the bright region, as a variety of pixel groups, was cutoff by the computer to memorize it in a memory. Then, the data of the bright region cutoff as a pixel group was read out from the memory, followed by subjecting it to an equivalent area processing on a horizontal axis and a vertical axes thereof, so as to calculate a diameter thereof. Also, a statistically specific point on the data of the bright region was calculated to obtain a basic statistical value. Also, a particle size distribution of each of the diameters was classified by the size thereof.

Results are shown in the following Tables. Table 16 shows results with respect to a basic statistical amount of a diameter of an equivalent area circle of the UDD (a total of the three views). Table 17 shows the result with respect to a particle size and a number distribution. Table 18 shows the results with respect to a basic statistical amount with respect to a ratio of a long axis to a short axis. Table 19 shows the results with respect to a number distribution of a long axis to a short axis. Table 20 shows the result of a basic statistical amount regarding a diameter of an equivalent area circle.

Figure 27:
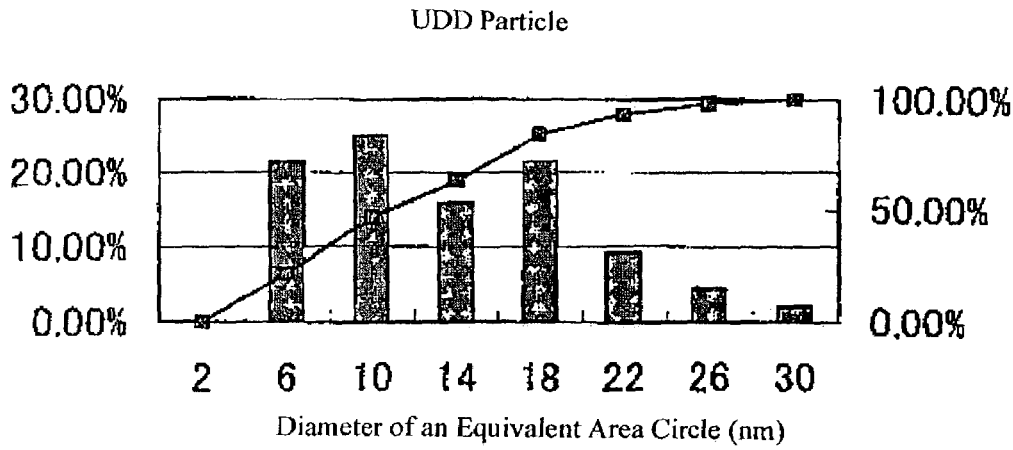
FIG. 27 shows a graph showing the result of a particle size and number distribution.
Figure 28:
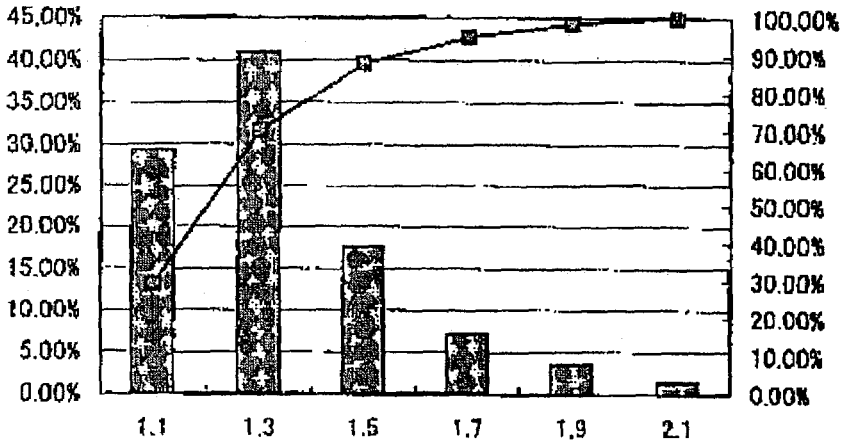
FIG. 28 shows a graph showing the result of a ratio of a long axis to a short axis ratio, and a number distribution.
Figure 29:
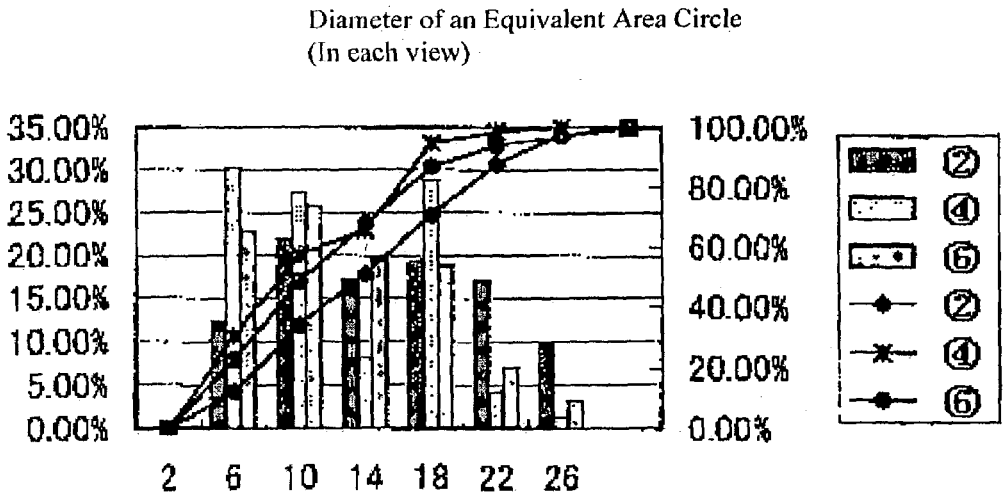
FIG. 29 shows a graph showing the result of a diameter of an equivalent area circle in the total of three views, and a number distribution.

Table 21 shows results with respect to a diameter of an equivalent area circle and a number distribution. FIG. 27 shows a graph showing the result of a particle size and number distribution. FIG. 28 shows a graph showing the result of a ratio of a long axis to a short axis ratio, and a number distribution. FIG. 29 shows a graph showing the result of a diameter of an equivalent area circle in the total of three views, and a number distribution.

TABLE 16

Results with respect to a Basic Statistical Amount of a Diameter of an Equivalent Area Circle of a UDD (a Total of the Three Views).

| | |
|---|---|
| Average | 13.78766161 |
| Standard Variation | 0.369499346 |
| Median (median) | 12.88945997 |
| Mode | 5.41140892 |
| Standard Deviation | 6.215941116 |
| Dispersion | 38.63792396 |
| Kurtosis | −0.285320992 |
| Degree of Distortion | 0.631501211 |
| Range | 27.17843547 |

TABLE 16-continued

Results with respect to a Basic Statistical Amount of a Diameter of an Equivalent Area Circle of a UDD (a Total of the Three Views).

| | |
|---|---|
| Minimum | 4.573475452 |
| Maximum | 31.75191092 |
| Total | 3901.908234 |
| Number of Samples | 283 |
| Maximum (1) | 31.75191092 |
| Minimum (1) | 4.573475452 |
| Reliable Range (95.0%) | 0.727326314 |

TABLE 17

A Particle Size and a Number Distribution.

| Data Region (nm) | Frequency | Rate (%) | Median (nm) | Accumulation Rate (%) |
|---|---|---|---|---|
| 4 | 0 | 0.00 | 2 | 0.00 |
| 8 | 61 | 21.55 | 6 | 21.55 |
| 12 | 71 | 25.09 | 10 | 46.64 |
| 16 | 45 | 15.90 | 14 | 62.54 |
| 20 | 61 | 21.55 | 18 | 84.10 |
| 24 | 26 | 9.19 | 22 | 93.29 |
| 28 | 13 | 4.59 | 26 | 97.88 |
| 32 | 6 | 2.12 | 30 | 100.00 |
| Total | 283 | | | |

TABLE 18

A Basic Statistical Amount with respect to a Ratio of a Long Axis to a Short Axis (Total of three views)

| | |
|---|---|
| Average | 1.334365638 |
| Standard variation | 0.012904759 |
| Median | 1.287877495 |
| Mode | #N/A |
| Standard Deviation | 0.217091657 |
| Dispersion | 0.047128787 |
| Kurtosis | 1.16127963 |
| Degree of Distortion | 1.121937478 |
| Range | 1.099549277 |
| Minimum | 1.000007268 |
| Maximum | 2.099556544 |
| Total | 377.6254756 |
| Number of Samples | 283 |
| Maximum (1) | 2.099556544 |
| Minimum (1) | 1.000007268 |
| Reliable Range (95.0%) | 0.025401861 |

TABLE 19

A Number Distribution of a Long Axis to a Short Axis

| Data Region (nm) | Frequency | Rate (%) | Median (nm) | Accumulation Rate (%) |
|---|---|---|---|---|
| 1 | 0 | 0.00 | | 0.00 |
| 1.2 | 83 | 29.33 | 1.1 | 29.33 |
| 1.4 | 116 | 40.99 | 1.3 | 70.32 |
| 1.6 | 50 | 17.67 | 1.5 | 87.99 |
| 1.8 | 20 | 7.07 | 1.7 | 95.05 |
| 2 | 10 | 3.53 | 1.9 | 98.59 |
| 2.2 | 4 | 1.41 | 2.1 | 100.00 |
| Total | 283 | | | |

TABLE 20

| Basic Statistical Amount | A Basic Statistical Amount regarding a Diameter of an Equivalent Area Circle | | |
|---|---|---|---|
| | II | IV | VI |
| Average | 16.10147802 | 12.19225246 | 13.21525474 |
| Standard Variation | 0.728536703 | 0.633005477 | 0.531820576 |
| Median | 15.97445175 | 10.79517325 | 12.28408446 |
| Mode | 10.7674577 | 6.327755694 | 9.01533287 |
| Standard Deviation | 6.597180435 | 5.40840117 | 6.016862974 |
| Dispersion | 43.52278969 | 29.25080321 | 36.20264005 |
| Kurtosis | −0.805698821 | −1.050274618 | 0.552640513 |
| Degree of Distortion | 0.205344687 | 0.452326475 | 0.940335815 |
| Range | 26.340502 | 21.27489795 | 27.13134566 |
| Minimum | 5.41140892 | 4.573475452 | 4.573475452 |
| Maximum | 31.75191092 | 25.8483734 | 31.70482111 |
| Total | 1320.321198 | 890.0344292 | 1691.552607 |
| Number of Samples | 82 | 73 | 128 |
| Maximum (1) | 31.75191092 | 25.8483734 | 31.70482111 |
| Minimum (1) | 5.41140892 | 4.573475452 | 4.573475452 |
| Reliable Range (95.0%) | 1.449560675 | 1.261872567 | 1.052376903 |

TABLE 21-1

| Data Range (nm) | Diameter of an Equivalent Area Circle and a Number Distribution (Each View) | | | | | | |
|---|---|---|---|---|---|---|---|
| | II | IV | VI | Data Median (nm) | II (%) | IV (%) | VI (%) |
| 4 | 0 | 0 | 0 | 2 | 0.00 | 0.00 | 0.00 |
| 8 | 10 | 22 | 29 | 6 | 12.20 | 30.14 | 22.66 |
| 12 | 18 | 20 | 33 | 10 | 21.95 | 27.40 | 25.78 |
| 16 | 14 | 6 | 25 | 14 | 17.07 | 8.22 | 19.53 |
| 20 | 16 | 21 | 24 | 18 | 19.51 | 28.77 | 18.75 |
| 24 | 14 | 3 | 9 | 22 | 17.07 | 4.11 | 7.03 |
| 28 | 8 | 1 | 4 | 26 | 9.76 | 1.37 | 3.13 |
| 32 | 2 | 0 | 4 | 30 | 2.44 | 0.00 | 3.13 |
| Total | 82 | 73 | 128 | | | | |

TABLE 21-2

| Data Range (nm) | Accumulation Rate Thereof | | | | | |
|---|---|---|---|---|---|---|
| | II (%) | IV (%) | VI (%) | II (%) | IV (%) | VI (%) |
| 2 | 0.00 | 0.00 | 0.00 | 0.00 | 0.00 | 0.00 |
| 6 | 12.20 | 30.14 | 22.66 | 12.20 | 30.14 | 22.66 |
| 10 | 21.95 | 27.40 | 25.78 | 34.15 | 57.53 | 48.44 |
| 14 | 17.07 | 8.22 | 19.53 | 51.22 | 65.75 | 67.97 |
| 18 | 19.51 | 28.77 | 18.75 | 70.73 | 94.52 | 86.72 |
| 22 | 17.07 | 4.11 | 7.03 | 87.80 | 98.63 | 93.75 |
| 26 | 9.76 | 1.37 | 3.13 | 97.56 | 100.00 | 96.88 |
| 30 | 2.44 | 0.00 | 3.13 | 100.00 | 100.00 | 100.00 |

In FIG. 27, a bar graph shows a number distribution frequency of each of the channels (or data regions), and a line graph shows a total of the number distribution frequency, respectively. In FIG. 28, a bar graph shows a number distribution frequency of each of the channels (or data regions), and a line graph shows a total of the number distribution frequency, respectively. In FIG. 29, a bar graph shows a number distribution frequency of each of the channels (or data regions), and a line graph shows a total of the number distribution frequency, respectively.

These results show that the UDD and nickel composite thin film according to the present invention has a UDD almost homogenously dispersed in the direction of the film thickness of the metal thin film layer (FIGS. 22 to 26). Based on a conversion into a circle having an equivalent area, the UDD has a particle size distribution as follows: The UDD comprises a small particle having a particle size of 16 nm or less at a number average rate of 50% or more, and for example, at a number average rate of 62.54% (as shown in Table 17). The UDD has a narrow distribution, comprising a particle having a particle size more than 50 nm, or a particle having a particle size less than 2 mn, at a number average rate of substantially 0% (as shown in Table 17)

In addition, a metal thin film layer, according to analysis of SEM photographs, has a film thickness of 32 nm (0.032 μm) to 30000 nm (30.0 μm), and for example, of 0.10 μm (0.1132 μm) to 5.00 μm (4.9850 μm) (Table 13). The UDD contained therein may comprises, based on a conversion into a circle having an equivalent area, a particle having a particle size of 16 nm or less at a number average rate of 70% or more (Tables 16 and 17). A SEM analysis shows that the UDD includes a particle having a ratio of 2.2, the ratio being a long axis to a short axis, at a concentration of substantially 100%, and that the UDD includes a particle having a ratio of 1.4, the ratio being a long axis to a short axis, at a concentration of 70% or more (Tables 18 and 19), which means that the particle included has an almost round sphere, resulting in having a good lubricity.

Measurement of Hardness of a UDD and Nickel Composite Thin Film 25 ml of the UDD as a sample obtained in Production Example 1 was added in a nickel plating while applying it to a supersonic wave, so as to obtain 500 ml of nickel and UDD plating solution having a concentration of 5%. Table 22 shows a composition of the gloss nickel plate solution used. Furthermore, as a dispersant, 0.1 ml of polyoxyethylene laurylether (made by Toshin Oil and Fat Co., Ltd.) was added for adjustment.

TABLE 22

| Liquid Composition of a Goss Nickel Plate | |
|---|---|
| Component | Composition Ratio [g/L] |
| Nickel Sulfate | 300 |
| Nickel Chloride | 60 |
| Boric Acid | 50 |

The plating solution prepared as described above was raised at a temperature of 55° C., and a brass plate test piece was processed in the order as follows: Pretreatment (comprising degreasing; water washing; acid washing; and water washing); plating treatment (nickel and UDD); and post-treatment (comprising water washing; and drying). The test piece had a size of 20 mm×100 mm, among which the portion having a size of 20 mm×70 mm was actually plated. In order to carry out measurement of hardness, it is necessary to have a plating film thickness of 20 μm, approximately, below which the measurement is affected by a substrate (mother material). Therefore, the plating conditions was determined as follows: According to a previous tests, plating was carried out at a temperature of 55° C., at a current of 0.56A (current density=2.0 A/dm$^2$). In addition, a supersonic wave (ultrasonic cleaner: SU-6TH, manufactured by Shibata Scientific Technology Ltd.) was used for agitating the plating solution (Example 3, improved), and also a magnetic stirrer was used (Example 3). In the case of using the supersonic wave (Example 3, improved), a plating period was determined to be 50 min, and in case of using the magnetic stirrer (Example 3), a plating period was determined to be 70 min, for adjusting a film thickness formed. After the plating, the plate was washed with pure water and an air was blown thereto.

Next, hardness was evaluated by means of a Vickers hardness, based on a test method for precise hardness measurement. The Vickers hardness is as follow: A press point of a quadrangular pyramid of diamond, having a facing angle of 136° is used. The press point is pressed into a surface of a sample at a constant load, to form a depressed area thereon. The depressed area has a diagonal line, which is measured to calculate a surface area thereof, by which the value of the load is divided. A Vickers hardness is calculated by the following formula. Also, the details of the hardness measurement are shown as follows:

Details of the Conditions for Measurement of Hardness

Method: Measurement of Vickers hardness in accordance with precise hardness measurement (JIS Z 2251-1980)

Measuring Instrument: Super-low weight load microhardness meter, MVK-1, manufactured by AKASHI Co., Ltd.

Conditions: Load was 20.0 [gf]; Load Retention Time was 15 sec; and Load Velocity was 0.01 [0.01 mm/sec].

$$Hv=F/S=2F\sin(\theta/2)/d^2=1854.4\,F/d^2 \quad \text{(VII)}$$

wherein "Hv" is a Vickers hardness, "F" is a load [gf], "S" is a surface area of a depressed area [μm], and "d" is an averaged length of a diagonal line [μm].

As a result, Example 3 had large variations in the size of the depressed area, and therefore, an evaluation was made on a portion where the depressed area is most concentrated. Table 23 shows the results.

TABLE 23

The Results of Measurement of Hardness with Respect to a UDD and Nickel Composite Film

| No. | Direction | Measurement [μ] 1 | 2 | 3 | 4 | Average | Vickers Hardness |
|---|---|---|---|---|---|---|---|
| Example 3, Improved (Supersonic Wave) | Longitudinal | 8.3 | 8.5 | 7.7 | 8.3 | 8.2 | 538.4 |
| | Transversal | 7.8 | 9.1 | 7.6 | 9.1 | 8.4 | |
| | Average | 8.1 | 8.8 | 7.7 | 8.7 | 8.3 | |
| Example 3 (Stirrer) | Longitudinal | 10.1 | 9.4 | 10.6 | 9.9 | 10.0 | 371.8 |
| | Transversal | 9.8 | 10.0 | 9.7 | 10.4 | 10.0 | |
| | Average | 10.0 | 9.7 | 10.2 | 10.2 | 10.0 | |

The film of Example 3, improved, that is plated by using a supersonic wave, shows an increased hardness due to an influence of the UDD. On the other hand, the film of Example 3, that is formed by using a stirrer, has no difference from a conventional nickel plate. However, it is considered that although the UDD may exist in the film, it is not dispersed homogenously since the formed depressed area was not uniform, as mentioned above. Just for reference, nickel has a hardness Hv of 200 to 400.

Generally, a nickel plating has a hardness of 100 to 250 (HV) in case of forming it without an additive in a Watt bath, and it has a hardness of 200–400 (HV) in case of forming it with a gloss additive in a Watt bath. The results of the measurement of hardness of the UDD and nickel composite thin film show a change in hardness of nickel. Namely, the UDD film obtained in the example has an increased hardness of 538 (HV), which is about two times as much as the conventional films.

Examples 9 to 10

Composite Film of UDD and Gold

Example 9

LIONOL 935 Was Used as a Dispersant 10 ml of a suspension solution of the sample (Sample E having α=74.4%) prepared by Production Example 1 was added in 490 ml of a pure gold plating for a gloss and thick film having the following composition to prepare 500 ml of a gold and UDD plating liquid:

<Composition of a pure gold plating solution for a gloss and thick film>

| Component | Composition ratio [g/L] |
|---|---|
| Potassium gold (I) cyanide | 30 |
| Citric acid | 90 |

Thereafter, a cation surfactant (ESOCARD), as a dispersant, was added at a rate of less than 10 drops (1.0 ml/1L) to adjust a gold and UDD plating solution.

The plating solution as prepared above was raised at a temperature of 60° C., followed by the following processes: Pretreatment of a plated material (or a material to be plated) (comprising degreasing; water washing; acid washing; and water washing); plating process (gold and UDD); and post-treatment (comprising water washing; and drying). Another conditions for plating were as follows: Plating period was determined to be 5 min. A magnetic stirrer was used for agitating the plating liquid, at a rate to the extent not to generate any precipitation during plating. After the plating, the plate was washed with pure water and an air was blown to dry it.

Example 10; LEOCON Was Used as a Dispersant 10 ml of a suspension solution of the sample (Sample E having α=74.4%) prepared by Production Example 1 was added in 490 ml of a pure gold plating for a gloss and thick film having the following composition to prepare 5 ml of a gold and UDD plating liquid:

<Composition of a pure gold plating solution for a gloss and thick film>

| Component | Composition ratio [g/L] |
|---|---|
| Potassium gold (I) cyanide | 30 |
| Citric acid | 90 |

Thereafter, a nonionic surfactant (LEOCON), as a dispersant, was added at a rate of less than 1 drop (0.1 ml/1L) to adjust a gold and UDD plating solution.

The plating solution as prepared above was raised at a temperature of 60° C., followed by the following processes: Pretreatment of the plated material (a material to be plated) (comprising degreasing; water washing; acid washing; and water washing); plating process (gold and UDD); and post-treatment (comprising water washing; and drying). Another conditions for plating were as follows: Plating period was determined to be 5 min. A magnetic stirrer was used for agitating the plating liquid, at a rate to the extent not to generate any precipitation during the plating. After the plating, the plate was washed with pure water and an air was blown to dry it.

| | Example 9 | Example 10 |
|---|---|---|
| Plating | Au (gloss plating) | Au (gloss plating) |
| UDD | Sample E | Sample E |
| UDD Content | 2 volume % | 5 volume % |
| Material | Cu | Cu |
| Set Temp. | 60° C. | 60° C. |
| Period | 5 min | 5 min |
| Voltage | 2.3 V | 2.2 V |
| Current | 0.1 A | 0.1 A |
| Agitation | Magnetic Stirrer | Magnetic Stirrer |
| Dispersant | ESOCARD (Lion Corporation) | LEOCON (Lion Corporation) |
| Ion Property | Cationic | Nonionic |
| Dispersant Amount | 0.5 ml | 0.1 ml |

With respect to the resultant sample of a UDD and gold composite thin film layer, its film thickness was measured in a similar manner of the UDD and nickel composite thin film layer. The result are shown in Table 25. The trend of the results is completely consistent with that of the UDD and nickel composite thin film layer.

TABLE 25

| Msmt. | Current Density: 1.0 A/dm$^3$ | | | Current Density: 2.0 A/dm$^3$ | | | Current Density: 5.0 A/dm$^3$ | | |
|---|---|---|---|---|---|---|---|---|---|
| Portion | I | II | (I + II)/2 | III | IV | (III + IV)/2 | V | VI | (V + VI)/2 |
| Ex. 9 | 0.140 | 0.0907 | 0.0974 | 0.3257 | 0.2572 | 0.2915 | 0.8073 | 0.7181 | 0.7627 |
| Ex. 10 | 0.1469 | 0.1333 | 0.1401 | 0.3070 | 0.2082 | 0.2576 | 0.9160 | 0.5878 | 0.7519 |

Image Analysis of SEM Photographs of a UDD and Gold Composite Thin Film Layer

Figure 30:
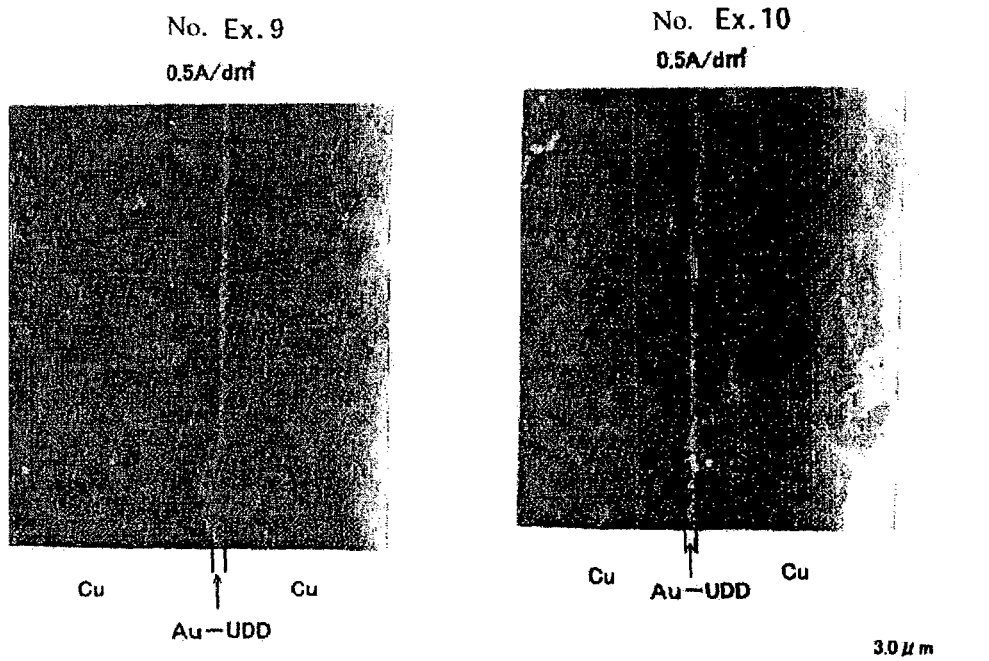
FIG. 30 shows a view of a UDD containing metal (gold) thin film according to the present invention, taken by a SEM.

Similar to the case of the UDD and nickel composite thin film layer, a SEM photograph of the sample of the obtained UDD gold composite thin film layer was taken. Results are shown in FIG. 30. Both of the gold plated samples were examined with respect to a particle size distribution of a UDD particle in a plating film, and a distribution size of a UDD particle, thereby finding that a UDD and gold composite thin film layer has a surface of gloss and brightness, having a slightly red color specific to gold. Similar to the case of the UDD and nickel composite thin film layer, good results were obtained.

Example 11

Furthermore, instead of using a magnetic stirrer in Example 10, an ultrasonic dispersion was made, and a process similar to Example 10 was proceeded to obtain a sample of a UDD and gold composite thin film layer as Example 11.

Image Analysis of a TEM Photography of a UDD and Gold Composite Thin Film Layer

Figure 31:
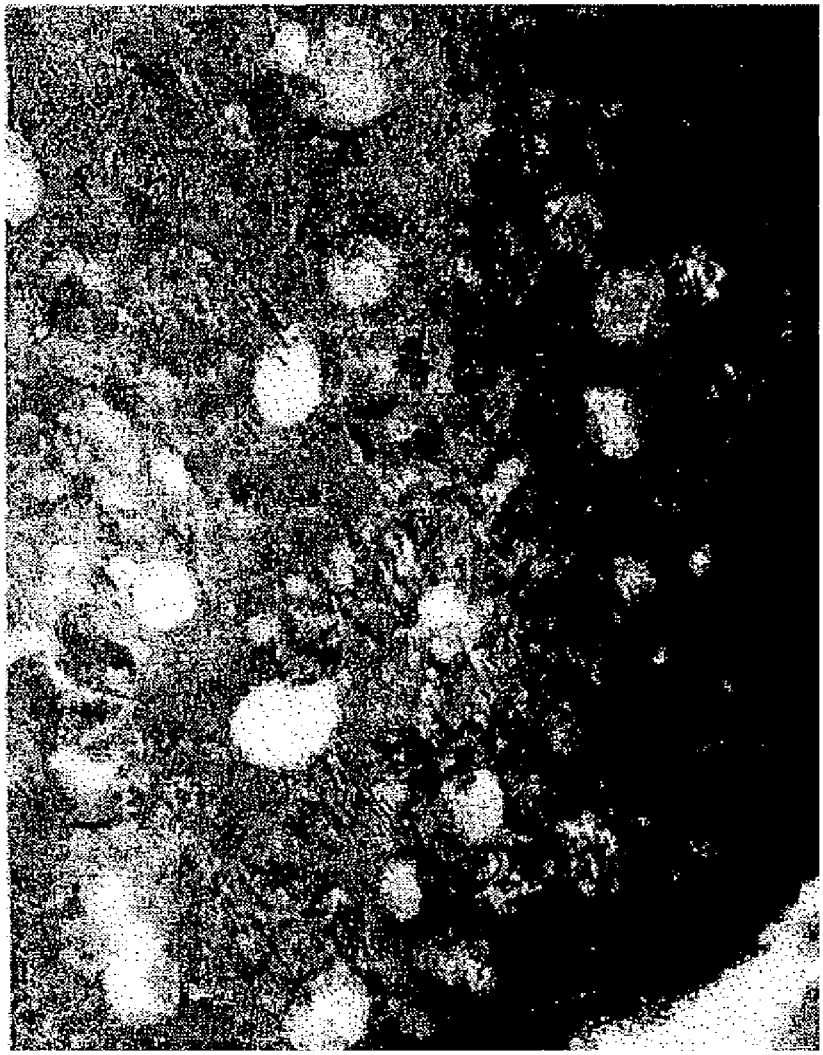
FIG. 31 shows a view of another UDD containing metal (gold) thin film according to the present invention, taken by a TEM.
Figure 32:
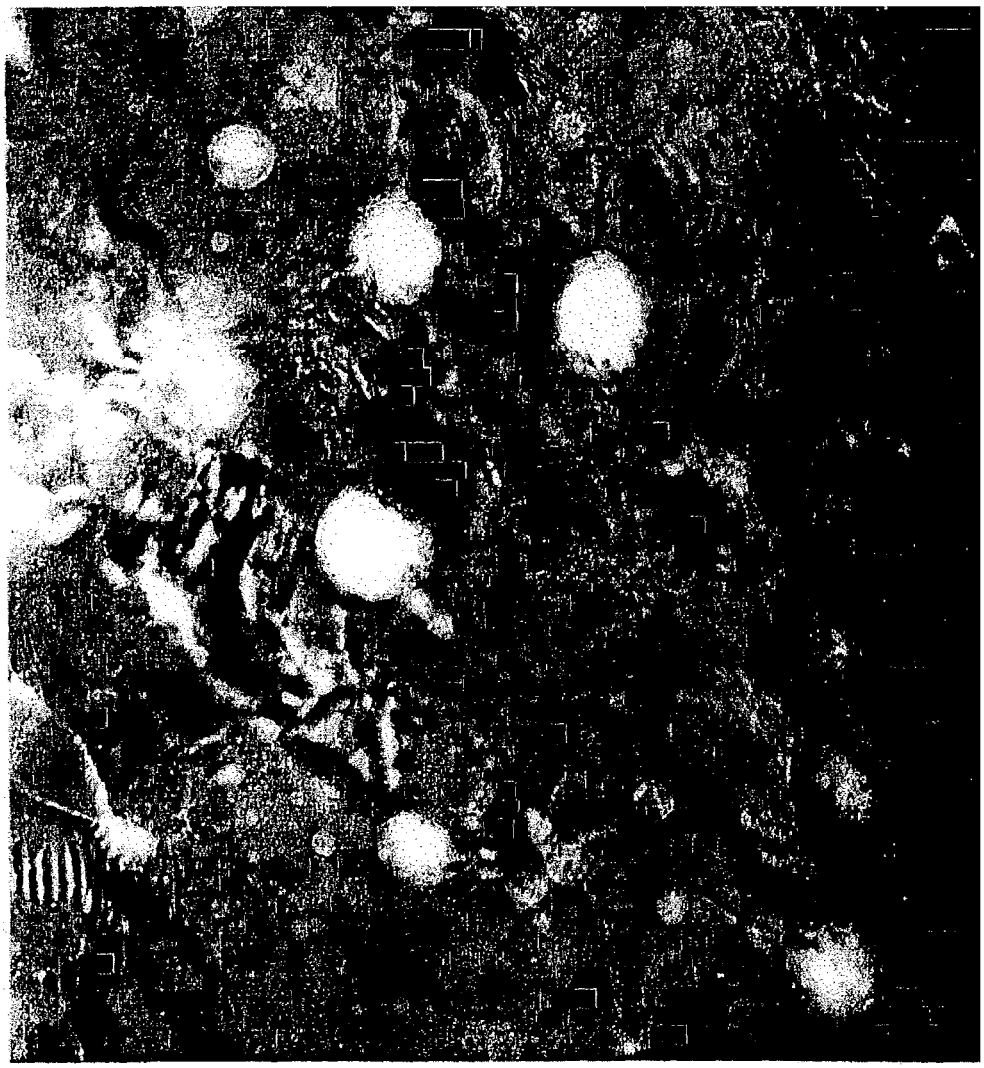
FIG. 32 shows a view of another UDD containing metal (gold) thin film according to the present invention, taken by a TEM.

With respect to a sample of a UDD and gold composite thin film layer of Example 11, a TEM photograph was taken and analyzed, in a similar manner to the taking and analysis of the SEM photography of the samples in Examples 9 and 10. Namely, the cross-section surface of the sample of Example 11 was ground (Finished; alumina 0.1 μm), and an ion etching (BAL-TEC RES100) was carried out, to take a TEM photograph, using Hitachi H-9000UHR (300 kV), followed by observing it. Comparing the film thickness at the front and back surfaces, the Au and UDD layer has a small variety in the film thickness depending on location. However, regardless of the film thickness, the UDD particle was shaped in an almost sphere, having a particle size of 2 to 40 nm, approximately, homogenously dispersed in the Au layer. FIG. 31 shows the result. Also, in order to observe the thin film layer in detail, a TEM photograph thereof was taken with 800,000 power magnifications. FIG. 32 shows the photograph. This photograph clearly shows, with the Moire pattern thereof, that the UDD is almost homogenously dispersed in the golden composite thin film layer.

Based on the TEM photograph image, an image analysis of the UDD particle was carried out under the following conditions:

(1) Image Input: Two views and Scanner Input—100 line/inch

Picture Size: 800×1000 Pixel

Calibration Value: 0.31646 nm/Pixel, 3.16 Pixel/nm (2) Diameter of an Equivalent Area Circle (Total of Two views)

The results are as follows:

| Basic Statistical Amount | |
|---|---|
| Average | 5.618684253 |
| Standard Variation | 0.290796079 |
| Median | 4.286070759 |
| Mode | 2.8796173 |
| Standard Deviation | 4.419717763 |
| Dispersion | 19.5339051 |
| Kurtosis | 17.33478826 |
| Degree of Distortion | 3.757725837 |
| Range | 32.0393311 |
| Minimum | 2.143035379 |
| Maximum | 34.18236648 |
| Total | 1297.916062 |
| Number of Samples | 231 |
| Maximum (1) | 34.18236648 |
| Minimum (1) | 2.143035379 |
| Reliable Range (95.0%) | 0.572964042 |

TABLE 26

| Data Region (nm) | Frequency | Rate (%) | Median (nm) | Accumulation Rate (%) |
|---|---|---|---|---|
| 4 | 98 | 2 | 42.42 | 42.42 |
| 8 | 103 | 6 | 44.59 | 87.01 |
| 12 | 14 | 10 | 6.06 | 93.07 |
| 16 | 10 | 14 | 4.33 | 97.40 |
| 20 | 1 | 18 | 0.43 | 97.84 |
| 24 | 1 | 22 | 0.43 | 98.27 |
| 28 | 1 | 26 | 0.43 | 98.70 |
| 32 | 2 | 30 | 0.87 | 99.57 |
| 34 | 0 | 33 | 0.00 | 99.57 |
| 36 | 1 | 35 | 0.43 | 100.00 |
| Total | 231 | | | |

Figure 33:
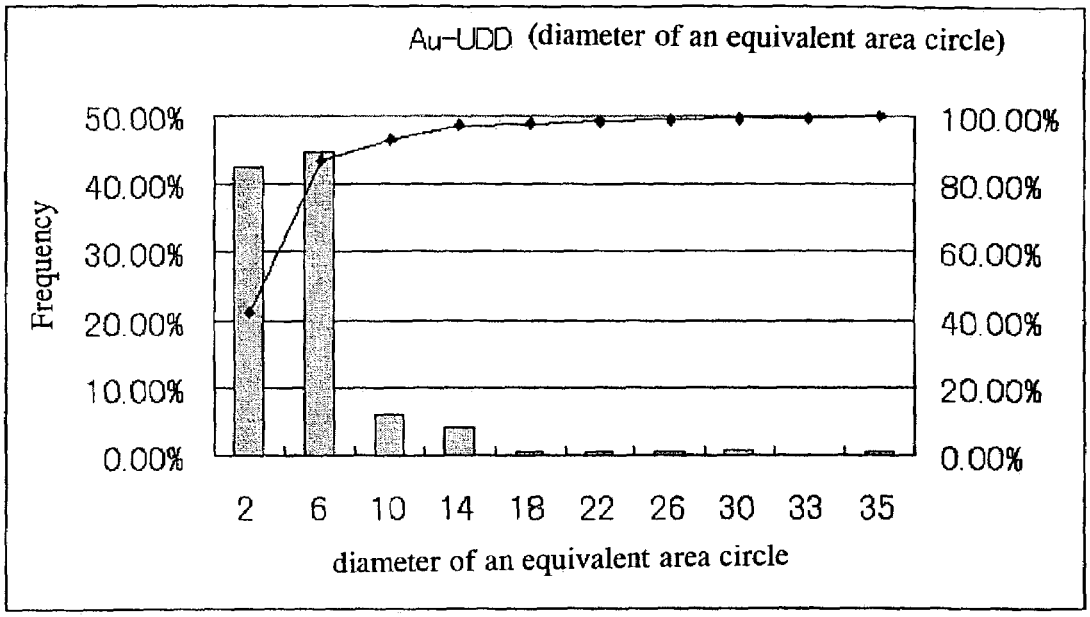
FIG. 33 shows a graph showing a diameter of an equivalent area circle and a number distribution thereof, with respect to a UDD particle of the present invention.

The results are summarized in FIG. 33.

(3) Long Axis/Short Axis (Total of Two Views)

| Basic Statistical Amount | |
|---|---|
| Average | 1.267671904 |
| Standard Variation | 0.011656865 |
| Median | 1.23278917 |
| Mode | #N/A |
| Standard Deviation | 0.177169013 |
| Dispersion | 0.031388859 |
| Kurtosis | 1.206783942 |
| Degree of Distortion | 1.063055744 |
| Range | 0.883814784 |
| Minimum | 1.000012048 |
| Maximum | 1.883826832 |
| Total | 292.8322097 |
| Number of Samples | 231 |
| Maximum (1) | 1.883826832 |
| Minimum Value (1) | 1.000012048 |
| Reliable Range (95.0%) | 0.022967863 |

TABLE 27

| Data Region (nm) | Frequency | Median (nm) | Rate (%) | Accumulation Rate (%) |
|---|---|---|---|---|
| 1 | 0 | 0.5 | 0.00 | 0.00 |
| 1.2 | 94 | 1.1 | 40.69 | 40.69 |
| 1.4 | 90 | 1.3 | 38.96 | 79.65 |
| 1.6 | 36 | 1.5 | 15.58 | 95.24 |
| 1.8 | 7 | 1.7 | 3.03 | 98.27 |
| 2 | 4 | 1.9 | 1.73 | 100.00 |
| 2.2 | 0 | | | |
| Total | 231 | | | |

Figure 34:
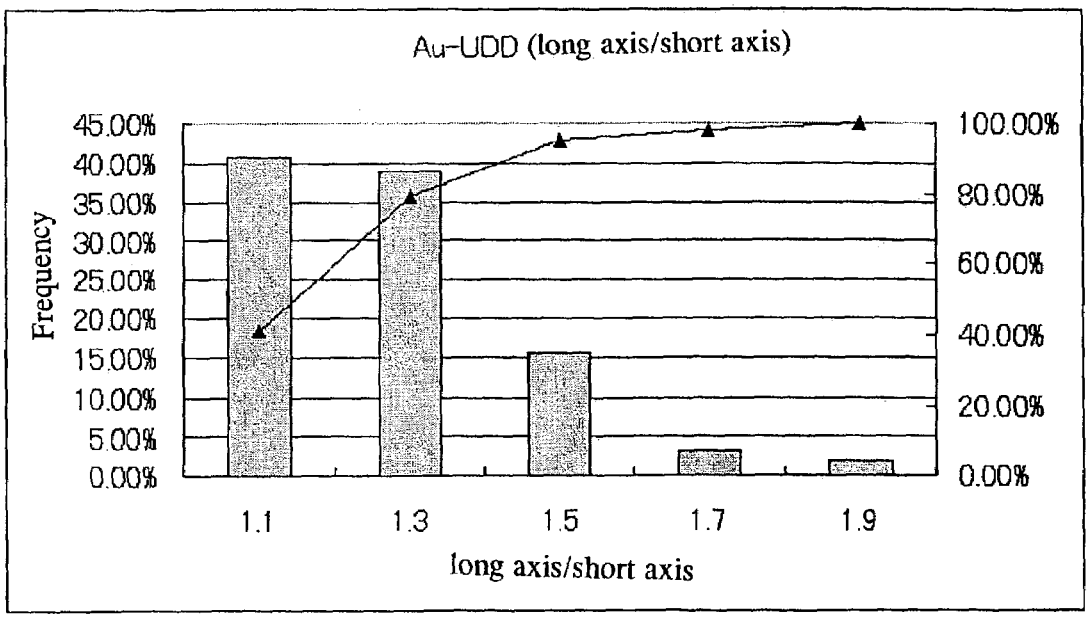
FIG. 34 shows a graph showing a ratio of a long axis to a short axis ratio, and a number distribution, with respect to a UDD particle of the present invention.

The results are summarized in FIG. 34.

The analyzed result of the TEM photograph of Example 11 (ultrasonic stirring) was compared with the analyzed result of the SEM photograph of Example 10 (magnetic stirrer). Namely, both of the photographs were inputted with a scanner (100 line/inch), which was digitalized, and then, a diameter of an equivalent area circle was calculated with respect to each of the particle portions. Also, a long axis and a short axis of each of the particles were measured to calculate a ratio of a long axis to a short axis. The result are shown as follows.

TABLE 28

| | Example 11 (TEM) | Example 10 (SEM) |
|---|---|---|
| Diameter of an Equivalent | | |
| Area Circle | | |
| Average | 5.62 nm | 9.56 nm |
| Standard Deviation | 0.29 nm | 0.41 nm |
| Median | 4.29 nm | 8.95 nm |
| Mode | 2.88 nm | 7.53 nm |
| Standard Deviation | 4.42 nm | 3.80 nm |
| Dispersion | 19.53 nm | 14.45 nm |
| Number of Samples | 231 | 85 |
| Long Axis/Short Axis | | |
| Average | 1.268 | 1.332 |
| Standard Variation | 0.012 | 0.022 |
| Median | 1.233 | 1.304 |
| Standard Deviation | 0.177 | 0.204 |
| Dispersion | 0.031 | 0.043 |
| Number of Samples | 231 | 85 |

These results show that the sample of Example 11, prepared with strongly stirring by a supersonic vibration, is superior to the sample of Example 10 prepared with using a magnetic stirrer.

As described above, the present invention uses an aqueous suspension solution comprising a super-fine diamond particle, which is well purified to have a narrow particle distribution and excellent in dispersion and surface activity, having a particle diameter having a unit of nanometer. Thus, the super-fine diamond particle is homogenously dispersed in a thin film at a high concentration, so as to provide a UDD and metal eutectoid film. Also, according to the present invention, there is provided an improved method to prepare a diamond fine particle and metal eutectoid film by means of an electroplating bath in accordance with an electroplating method.

Explanation of Symbols

The symbols in the figure means as follows: 1: plenty of water; 2: pressure resistance vessel made of pure titanium; 3: helmet; 4: pipe plugged at one end thereof; 5: detonating agent; 6: electric donator; and 7: autoclave.

What is claimed is:

1. A metal thin film comprising:

a metal material; and a diamond particle dispersed in the metal material, wherein the metal thin film has a film thickness of 5 nm to 35000 nm, wherein the diamond particle is dispersed almost homogeneously over the direction of the film thickness of the metal thin film, wherein the metal thin film has the diamond particle at a concentration of 1 to 12%, and wherein based on a conversion into a circle having an equivalent area, the diamond particle has a first particle size distribution with respect to a particle size of 16 nm or less, at a number average existence rate of 50% or more;

the diamond particle has a particle size distribution with respect to a particle size of 50 nm or more, at a number average existence rate of substantially 0%;

and the diamond particle has a particle size distribution with respect to a particle size of 2 nm or less, at a number average existence rate of substantially 0%.

and further wherein:

the diamond particle has an element composition including 72 to 89.5% of total carbon, 0.8 to 1.5% of hydrogen, 1.5 to 2.5% of nitrogen and 10.5 to 25.0% of oxygen, summing up to 100%, the diamond particle, at the time of being dried and when analyzed by a X-ray diffraction (XD) spectrum analysis using Cu—K α radiation, has the largest peak at a Bragg angle of 43.9° (2 θ±2 °), strong and characteristic peaks at either of Bragg angles of 73.5° and 95°, a significantly biased halo at a Bragg angle of 17°, and essentially no peak at a Bragg angle of 26.5°, the diamond particle has a specific surface area of $1.50\times 10^5$ $m^2$/kg or more, wherein all of the surface carbon atoms are substantially bonded with hetero atoms, wherein the diamond particle has a total absorption space of 0.5 $m^3$/kg or more.

2. A metal thin film according to claim 1, wherein the metal plate is selected from a group consisting of Au, Cr, Cu, In, Mo, Ni, Pd, Rh, V, or W.

3. A metal thin film according to claim 1, wherein the metal thin film has a film thickness of 32 nm to 30000 nm.

4. A metal thin film according to claim 1, wherein based on the conversion, the diamond particle has a particle size distribution with respect to a particle size of 16 nm or less, at a number average existence rate of 70% or more.

5. A metal thin film according to claim 1, wherein the metal thin film comprises the diamond particle having a ratio, with respect to a long axis to a short axis of the diamond particle based on an image analysis by SEM, of 2.2 or less, of substantially 100%.

6. A metal thin film according to claim 1, wherein the metal thin film comprises the diamond particle having a ratio, of a long axis to a short axis of the diamond particle based on an image analysis by SEM, of 1.4 or less, of 70% or more.

7. A metal material comprising:

a metal substrate; and a metal thin film provided on a surface of the metal substrate, the metal thin film comprising:

a metal material; and a diamond particle dispersed in the metal material, wherein the metal thin film has a film thickness of 5 nm to 35000 nm, wherein the diamond particle is dispersed almost homogenously over the direction of the film thickness of the metal thin film, wherein the metal thin film has the diamond particle at a concentration of 1 to 12 wt %, and wherein based on a conversion into a circle having an equivalent area, the diamond particle has a particle size distribution with respect to a particle size of 16 nm or less, at a number average existence rate of 50% or more;

the diamond particle has a particle size distribution with respect to a particle particle size of 50 nm or more, at a number average existence rate of substantially 0%; and the diamond particle has a particle size distribution with respect to a particle of 2 nm or less, at a number average existence rate of substantially 0%;

and further wherein:

the diamond particle has an element composition including 72 to 89.5% of total carbon, 0.8 to 1.5% of hydrogen, 1.5 to 2.5% of nitrogen and 10.5to25.0% of oxygen, summing up to 100%, the diamond particle, at the time of being dried and when analyzed by a X-ray diffraction (XD) spectrum analysis using Cu—K α radiation, has the largest peak at a Bragg angle of 43.9° (2 θ±2 °), strong and characteristic peaks at either of Bragg angles of 73.5° and 95°, a significantly biased halo at a Bragg angle of 17°, and essentially no peak at a Bragg angle of 26.5°, the diamond particle has a specific surface area of $1.50\times10^5$ $m^2$/kg or more, wherein all of the surface carbon atoms are substantially bonded with hetero atoms, wherein the diamond particle has a total absorption space of 0.5 $m^3$/kg or more.

8. A method for forming a metal thin film:

providing a plating bath;

preparing a plating solution in the plating bath, the plating solution including a diamond fine particle suspended therein;

providing a metal substrate in the plating bath; and carrying out an electrolytic plating in the plating bath to form a metal thin film dispersing the diamond particle on the metal substrate, wherein based on a conversion into a circle having an equivalent area, the diamond particle has a particle size distribution with respect to a particle size of 16 nm or less, at a number average existence rate of 50% or more;

the diamond particle has a particle size distribution with respect to a particle size of 50 nm or more, at a number average existence rate of substantially 0%; and the diamond particle has a particle size distribution with respect to a particle size of 2 nm or less, at a number average existence rate of substantially 0%;

wherein the diamond particle is suspended in the plating solution at a concentration of 0.01 g/liter to 120 g/liter; and wherein the diamond particle is dispersed almost homogeneously over the direction of the film thickness of the metal thin film, having the film thickness of 40 nm to 60000 nm;

and further wherein:

the diamond particle has an element composition including 72 to 89.5% of total carbon, 0.8 to 1.5% of hydrogen, 1.5 to 2.5% of nitrogen and 10.5 to 25.0% of oxygen, summing up to 100%, the diamond particle, at the time of being dried and when analyzed by a X-ray diffraction (XD) spectrum analysis using Cu—K α radiation, has the largest peak at a Bragg angle of 43.9° (2 θ±2°), strong and characteristic peaks at either of Bragg angles of 73.5° and 95°, a significantly biased halo at a Bragg angle of 17°, and essentially no peak at a Bragg angle of 26.5°, the diamond particle has a specific surface area of $1.50\times 10^5$ $m^2$/kg or more, wherein all of the surface carbon atoms are substantially bonded with hetero atoms, wherein the diamond particle has a total absorption space of 0.5 $m^3$/kg or more.

* * * * *